US011059086B2

(12) United States Patent
Dunwoody

(10) Patent No.: US 11,059,086 B2
(45) Date of Patent: Jul. 13, 2021

(54) METAL CONTAINERS AND METHODS OF MANUFACTURE

(71) Applicant: CROWN PACKAGING TECHNOLOGY, INC., Alsip, IL (US)

(72) Inventor: Paul Robert Dunwoody, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 232 days.

(21) Appl. No.: 16/072,083

(22) PCT Filed: Jan. 9, 2017

(86) PCT No.: PCT/GB2017/050029
§ 371 (c)(1),
(2) Date: Jul. 23, 2018

(87) PCT Pub. No.: WO2017/134413
PCT Pub. Date: Aug. 10, 2017

(65) Prior Publication Data

US 2019/0022730 A1 Jan. 24, 2019

(30) Foreign Application Priority Data

Feb. 4, 2016 (GB) ..... 1602042

(51) Int. Cl.
*B21D 22/28* (2006.01)
*B21D 22/30* (2006.01)
(Continued)

(52) U.S. Cl.
CPC ..... *B21D 22/283* (2013.01); *B21D 22/28* (2013.01); *B21D 22/30* (2013.01); *B21D 51/26* (2013.01);
(Continued)

(58) Field of Classification Search
CPC ..... B21D 22/28; B21D 22/283; B21D 22/30; B21D 51/26; B21D 51/34
See application file for complete search history.

(56) References Cited

U.S. PATENT DOCUMENTS 4,346,580 A 8/1982 Saunders
4,485,663 A 12/1984 Gold et al.
(Continued)

FOREIGN PATENT DOCUMENTS

AT 403893 B 6/1998
EP 0667193 A1 8/1995
(Continued)

*Primary Examiner* — Debra M Sullivan
(74) *Attorney, Agent, or Firm* — BakerHostetler

(57) ABSTRACT

A method of reducing a thickness and increasing a height of a cylindrical wall of a metal cup to form a can body comprises positioning a wall-ironing punch (40) inside the cup, moving an annular wall-ironing die (24) axially over the closed end of the cup towards the open end of the cup, but not beyond the open end of the cup, in order to iron the cylindrical wall from the closed end up to a position axially spaced from the open end and moving the wall-ironing die (24) back in an opposite direction to remove the can body from the die (24). Methods of altering a diameter of one or more regions of a can body are also disclosed.

10 Claims, 40 Drawing Sheets

(51) Int. Cl.
*B21D 51/26* (2006.01)
*B21D 51/34* (2006.01)

(52) U.S. Cl.
CPC ..... *B21D 51/34* (2013.01); *B21D 51/2692* (2013.01)

(56) References Cited

U.S. PATENT DOCUMENTS

| | | | | |
|---|---|---|---|---|
| 4,534,201 | A | 8/1985 | LaRosa et al. | |
| 4,828,112 | A | 5/1989 | Vollrath et al. | |
| 5,750,222 | A | 5/1998 | Komatsu et al. | |
| 5,778,722 | A * | 7/1998 | Saiki ..... | B21D 51/26 72/347 |
| 7,878,040 | B2 | 2/2011 | Taya et al. | |
| 2004/0244459 | A1 | 12/2004 | Shiokawa | |
| 2006/0159989 | A1 * | 7/2006 | Bouffard ..... | H01M 2/0225 429/164 |
| 2014/0182349 | A1 * | 7/2014 | Yonemura ..... | B21D 22/26 72/349 |

FOREIGN PATENT DOCUMENTS

| | | | |
|---|---|---|---|
| FR | 1490636 | | 8/1967 |
| GB | 1422707 | A | 1/1976 |
| GB | 2286364 | A | 8/1995 |
| JP | 2000-042644 | A | 2/2000 |
| WO | WO 2006/075132 | A1 | 7/2006 |
| WO | WO 2007/052364 | A1 | 4/2009 |
| WO | WO 2011/011848 | | 2/2011 |
| WO | WO 2014/109236 | A1 | 7/2017 |
| WO | WO 2017/134413 | A1 | 8/2017 |

* cited by examiner

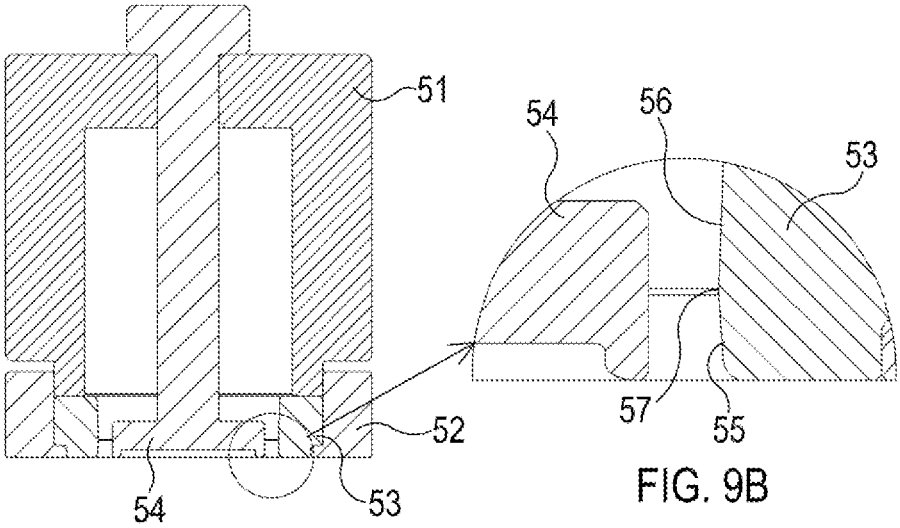
FIG. 9B
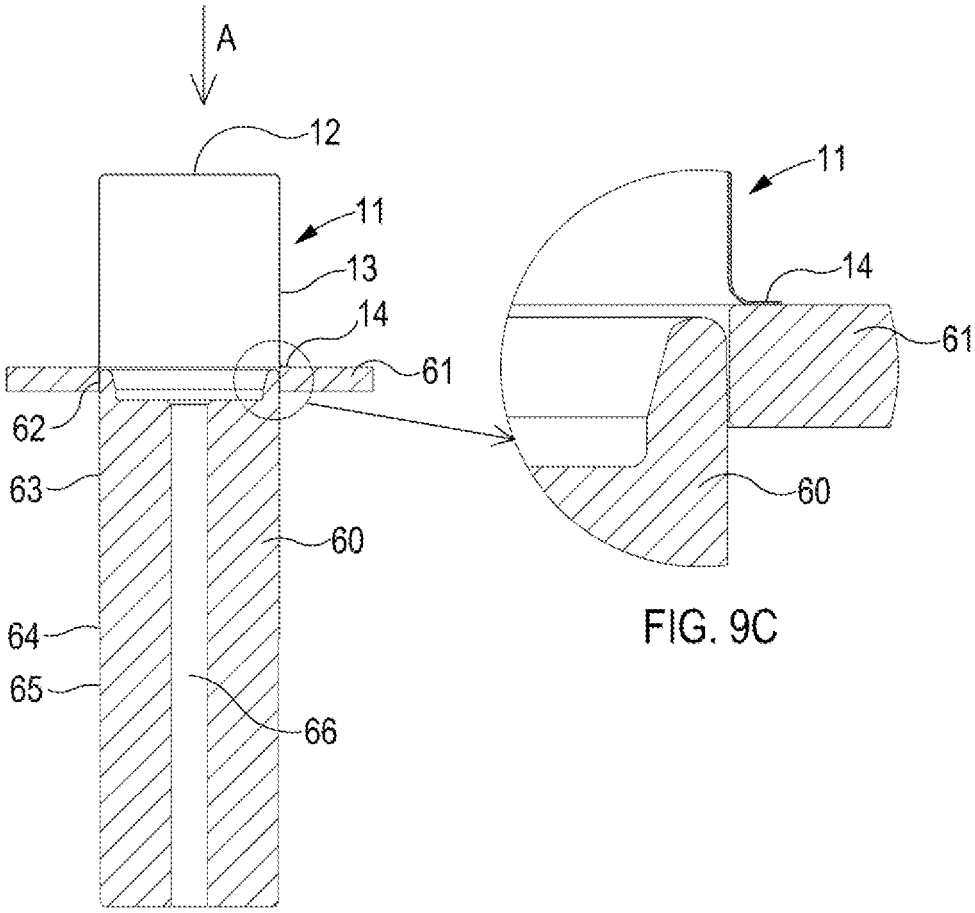
FIG. 9C
FIG. 9A

FIG. 15A
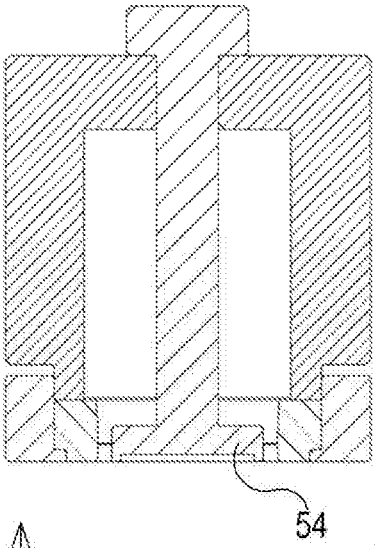
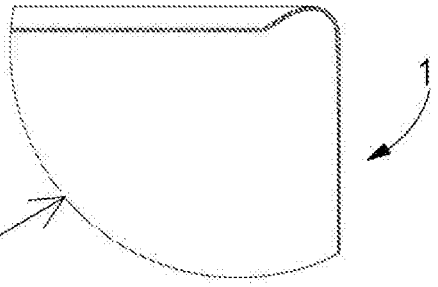
FIG. 15B
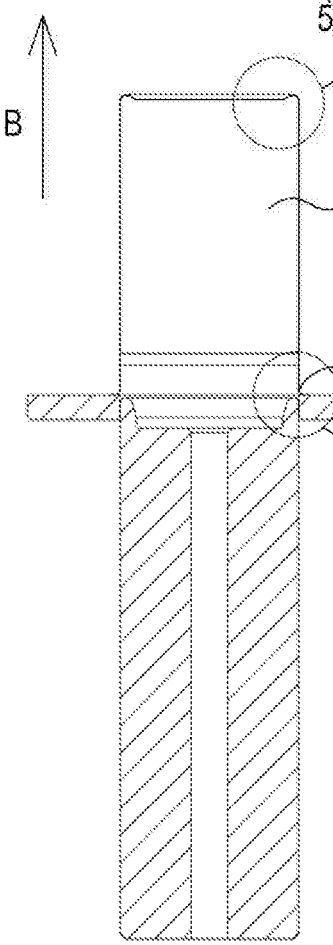
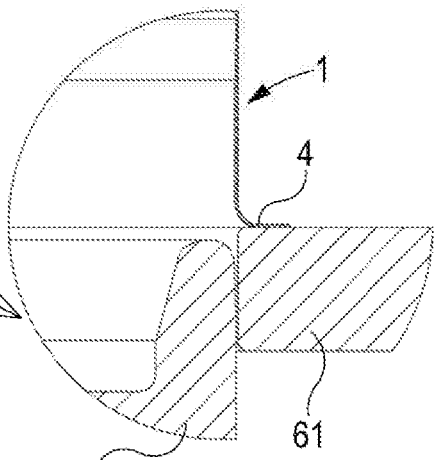
FIG. 15C 84
85
72'
92
90

92
85
73
A
73'
73"
83
91
90
94
73'
73"
83
74'
95
90
91

81
82
83
72'

73
76

73'
71'
73
B
73'
73'
77

73"
73"
91
93
90
94
95
98
73"
75'
74'

91

FIG. 23A
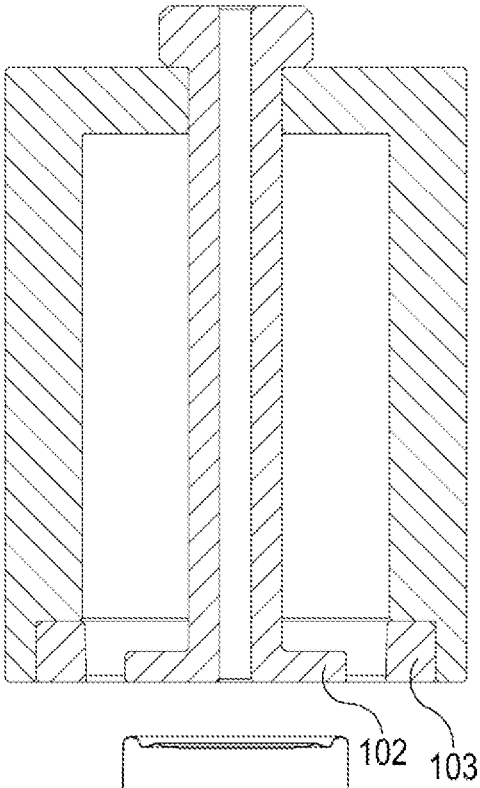
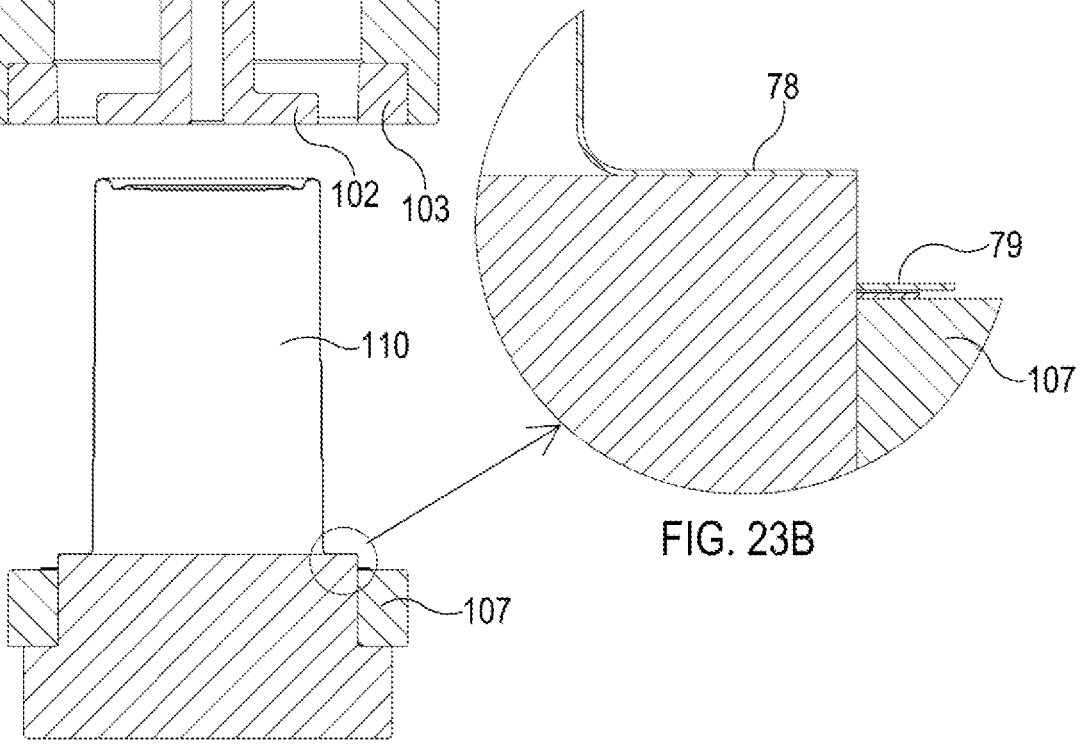
FIG. 23B

FIG. 26A
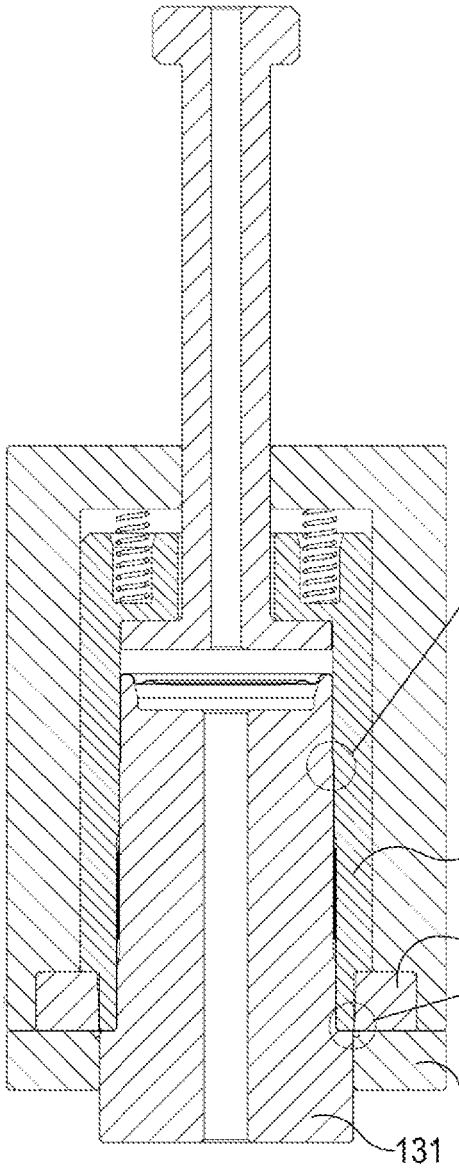
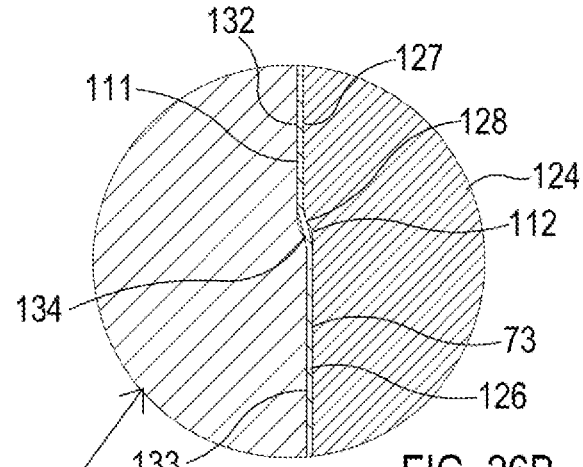
FIG. 26B
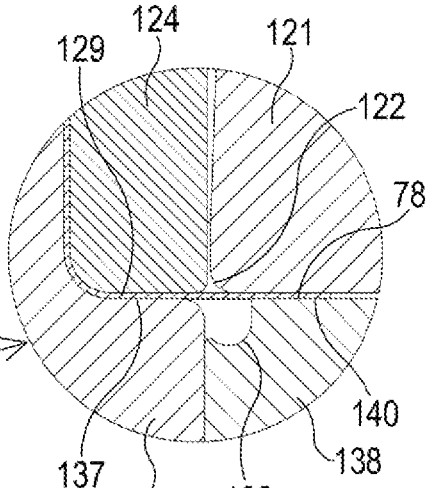
FIG. 26C

FIG. 27A
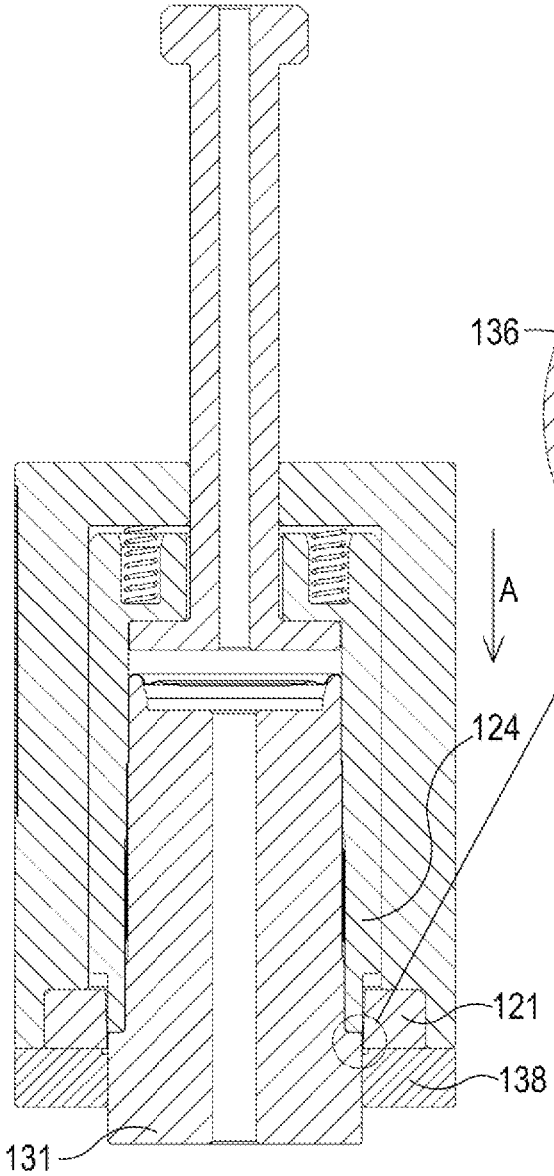
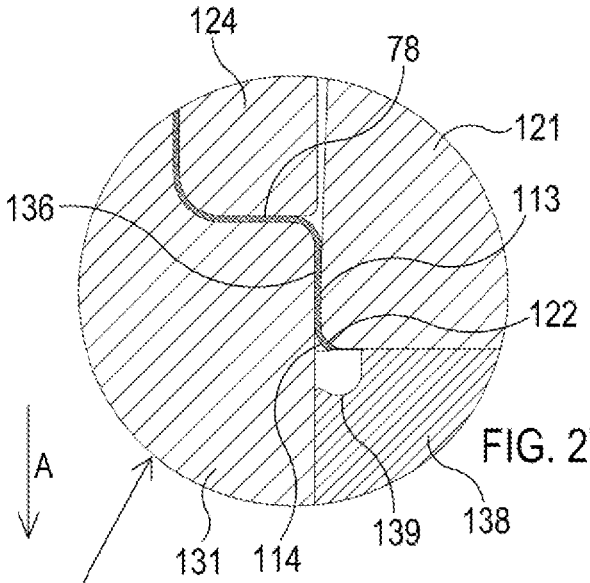
FIG. 27B

FIG. 28A
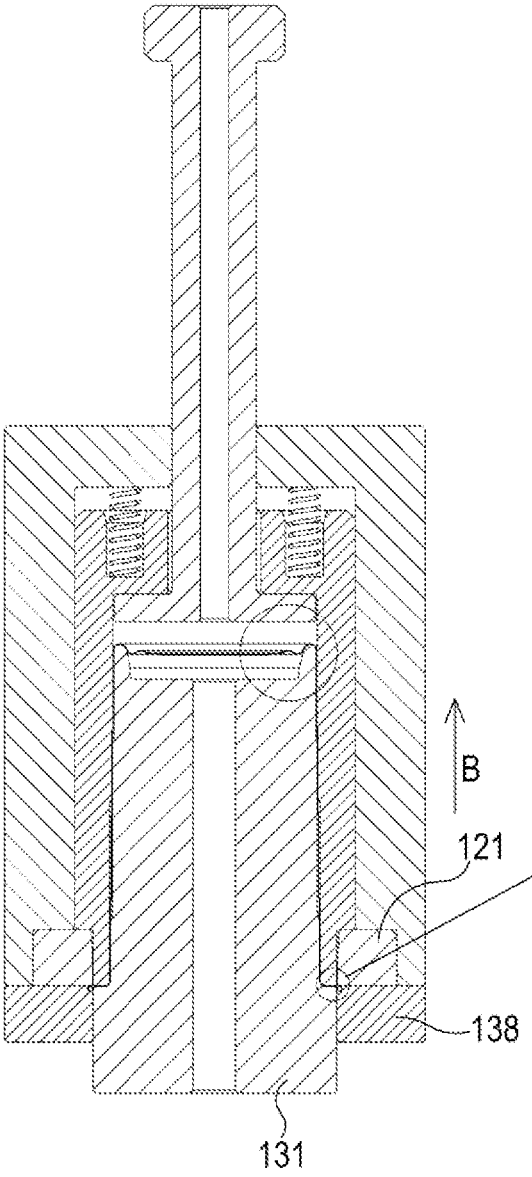
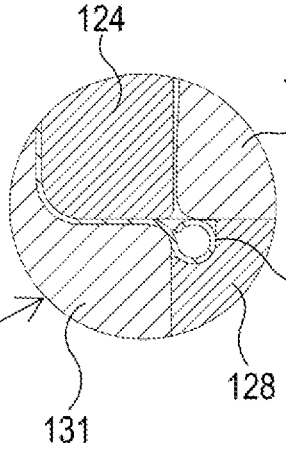
FIG. 28B

FIG. 29A
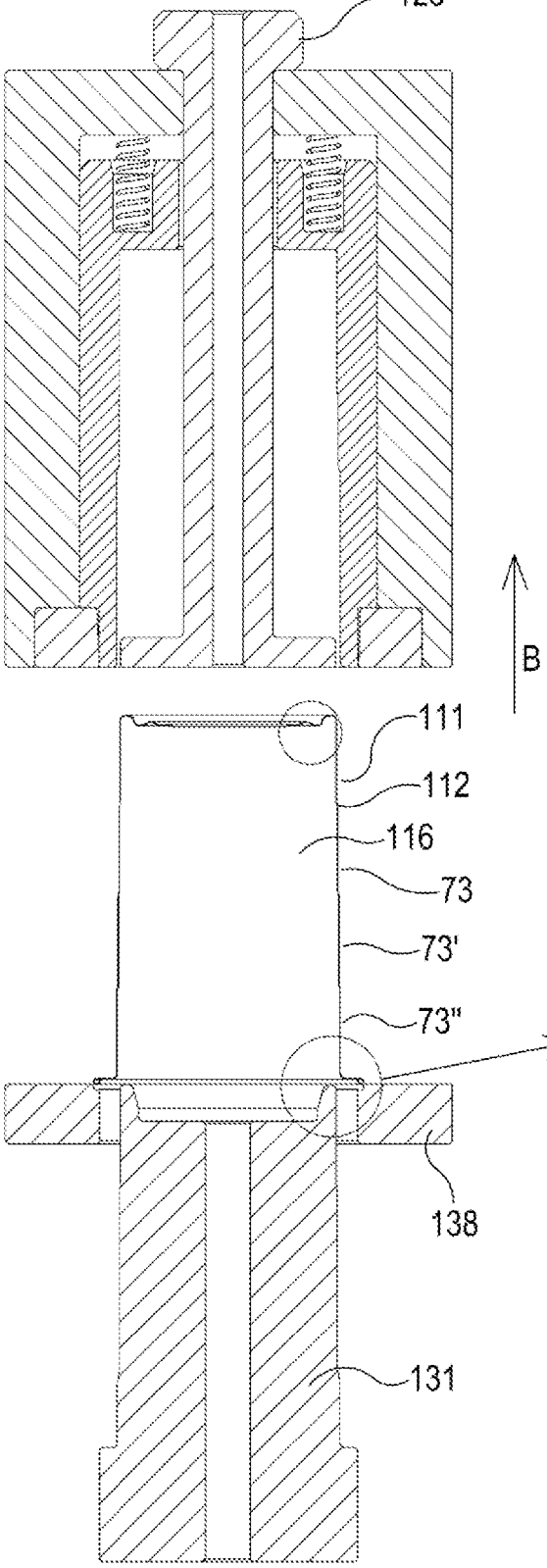
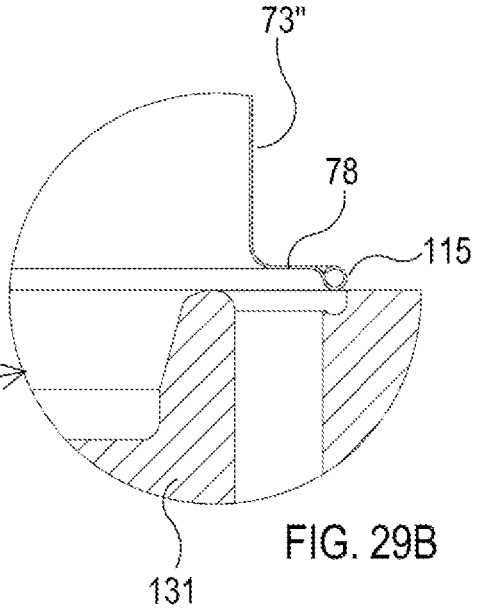
FIG. 29B

FIG. 30A
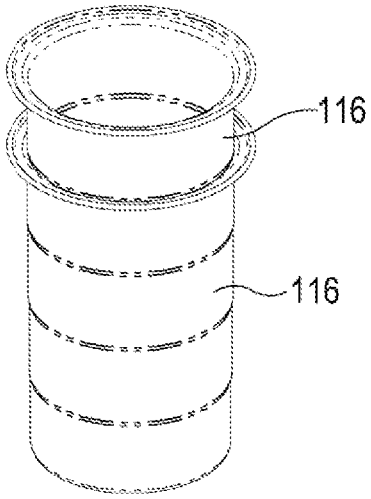
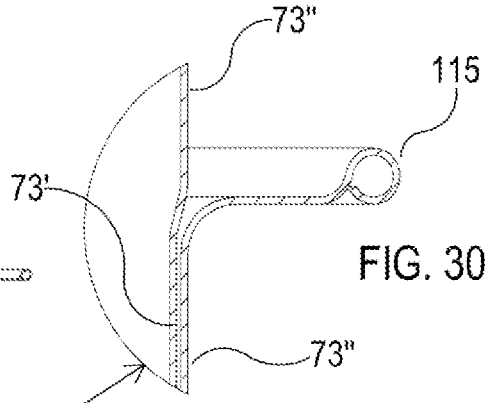
FIG. 30C
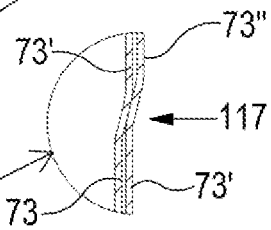
FIG. 30D
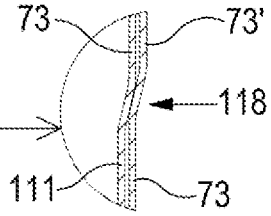
FIG. 30E
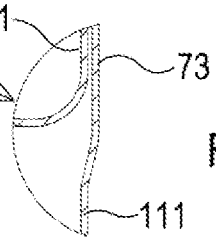
FIG. 30F
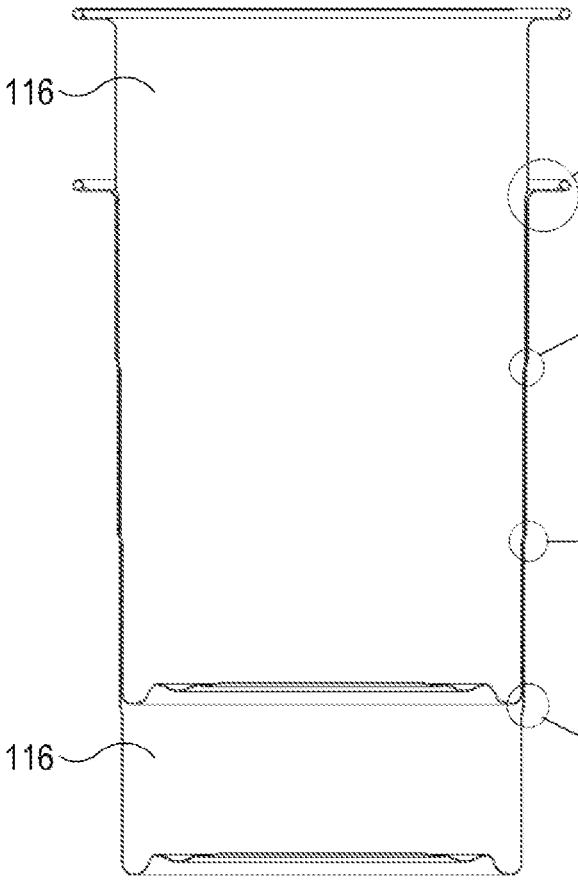
FIG. 30B FIG. 32A
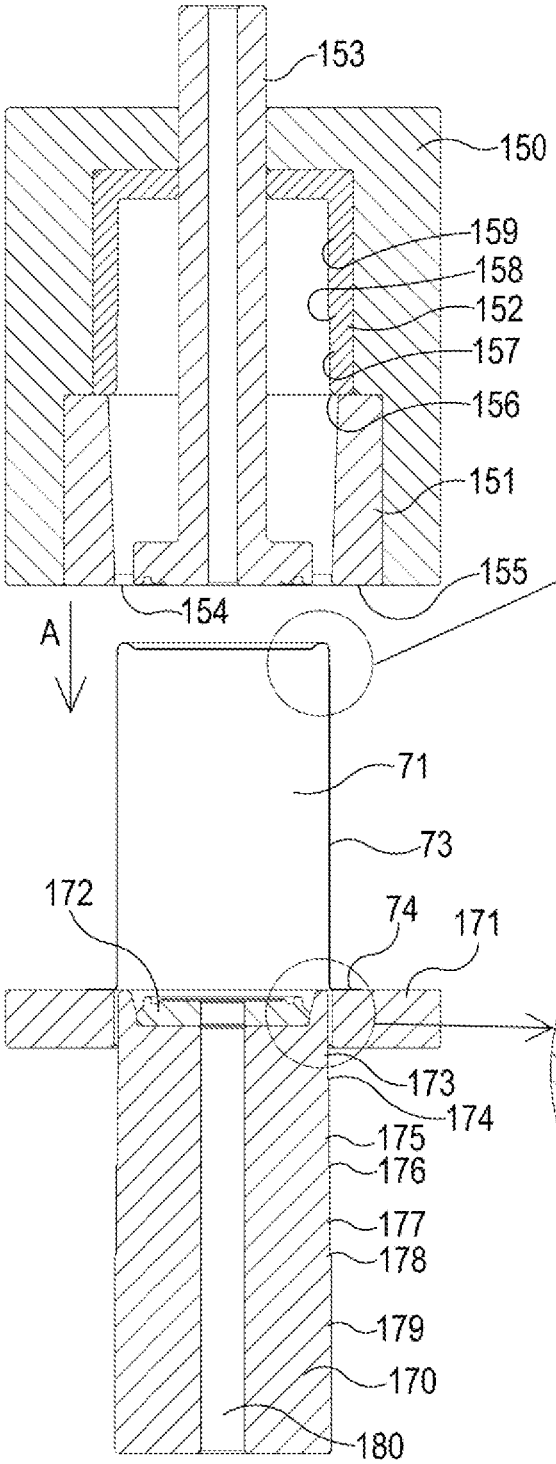
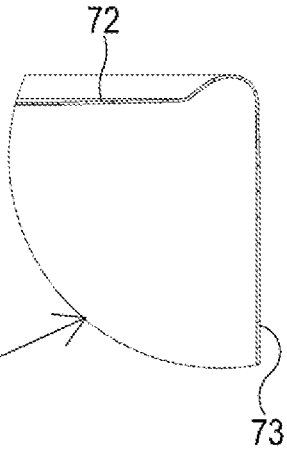
FIG. 32B
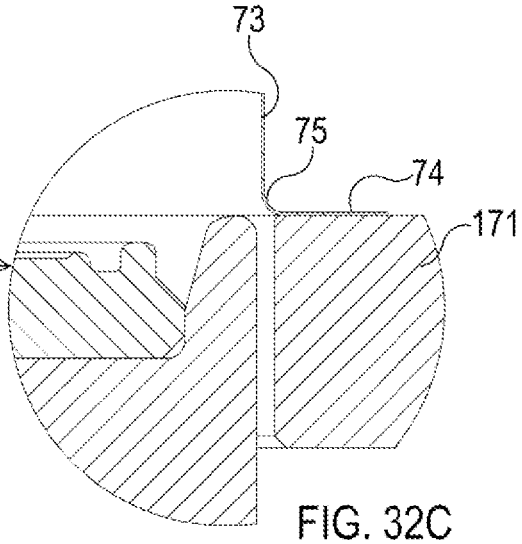
FIG. 32C

A
151
74
171
153
158
152
73
170

152
151
170

73
76
73'

73'
77
73"

153
72'
172
159
111
A
111
158
112
73
73''
151
154
151
170
171
170
74'
75'
171

FIG. 36A
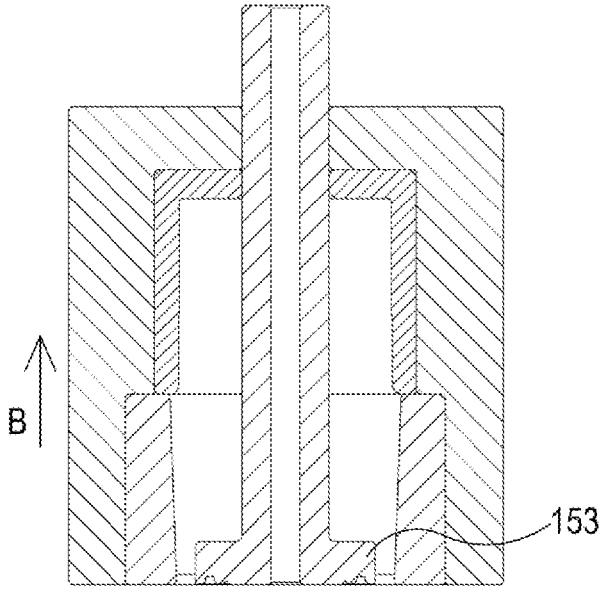
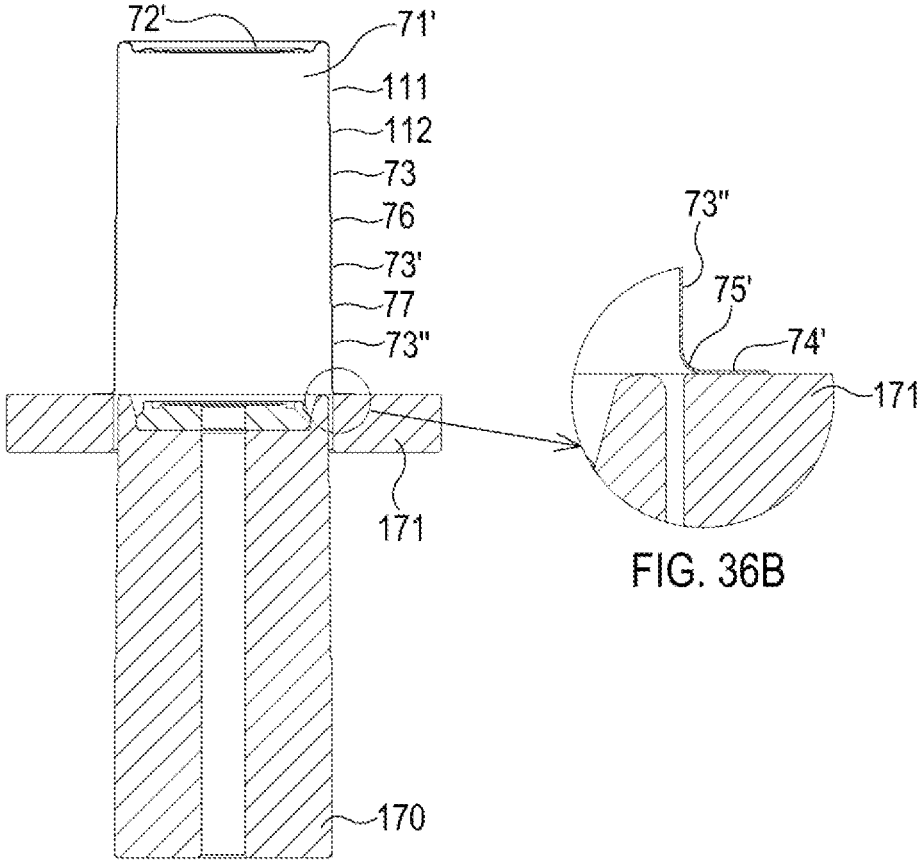
FIG. 36B

FIG. 37A
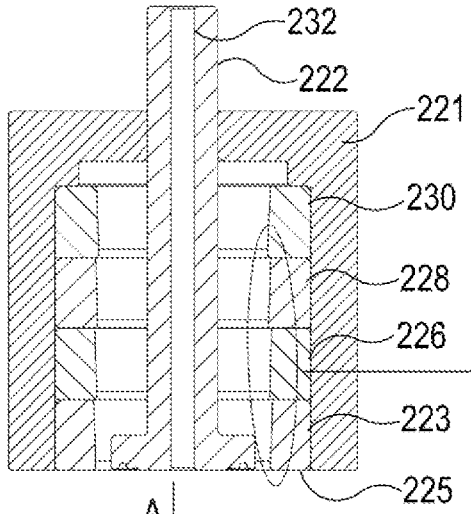
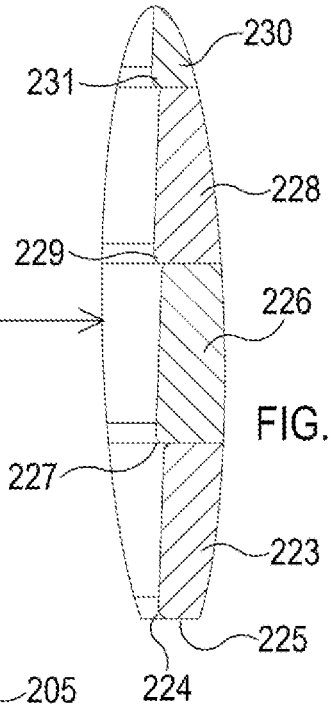
FIG. 37B
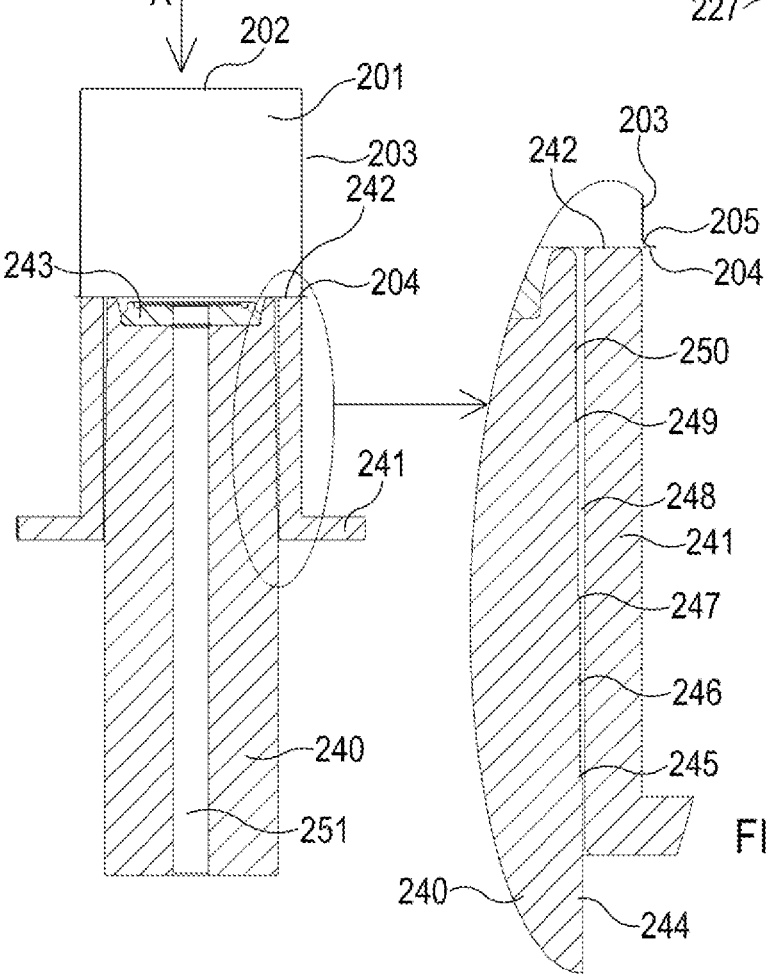
FIG. 37C

METAL CONTAINERS AND METHODS OF MANUFACTURE

CROSS-REFERENCE TO RELATED APPLICATIONS

This application is the National Stage of International Application No. PCT/GB2017/050029 filed Jan. 9, 2017, which claims the benefit of GB application number 1602042.2, filed Feb. 4, 2016, the disclosures of which are incorporated herein by reference in their entirety.

FIELD OF THE INVENTION

The invention relates to methods of manufacture of metal containers made from single blanks of coated metal sheet, and to metal containers manufactured using these methods.

BACKGROUND

Metal containers, usually known as "cans", are commonly manufactured from generally circular blanks of metal. Can manufacturers strive to minimise the cost of materials used in production, and the well-known process of wall-ironing is often used to achieve this by reducing the thickness of can walls.

A first manufacturing step is typically to blank and draw a number of shallow cups, each comprising a flat base region connected to a cylindrical wall. The press may comprise a plurality of stations operating in parallel.

In a typical wall-ironing machine, a shallow-drawn cup is re-drawn over a reciprocating wall-ironing punch, to form a can body comprising a flat base region connected to a cylindrical wall. The can body is then pulled through a number of wall-ironing dies that each have progressively smaller diameters, such that the wall thickness is reduced to slightly more than the gap between the wall-ironing punch and wall-ironing die at each stage of the progression. Because the wall-ironing dies are circular and the wall-ironing punch moves along the axis of the dies during wall-ironing, the resulting wall-ironed can wall is cylindrical.

The difference between the punch-to-die gap and the resulting wall thickness depends on the profile of the wall-ironing die, the rigidity of the wall-ironing ironing punch and of the wall-ironing die, the hardness of the metal in the can wall, and other factors including lubrication, temperatures and so on. As the metal in the can body passes through each wall-ironing stage it generally becomes more work-hardened, and so the process becomes more severe.

The raw edge of the can wall as it leaves the final wall-ironing ironing die is uneven, and the can wall fits tightly onto the wall-ironing punch. The tightness of the can on the wall-ironing punch depends on the amount of wall thickness reduction done in the last wall-ironing stage, and it is common for the final ironing stage to use a wall-ironing die with a different profile and a diameter selected to create only a small thickness reduction (for example, around 1%) to minimise the grip of the can onto the punch and facilitate subsequent stripping. Such a small thickness reduction is commonly known as "burnishing".

After the wall-ironing punch carries the wall-ironed body through the final wall-ironing die, it typically carries it through a stripping device equipped with spring-loaded fingers that close down onto the wall-ironing punch after the raw edge has passed through. A profile is then formed on the base region of the can body by profiled tools that oppose the end of the wall-ironing punch as it reaches the end of its forward stroke. When the wall-ironing punch travels back, the stripping device prevents the can body returning through the wall-ironing ironing dies, and compressed air is introduced into the can through the wall-ironing punch to prevent the can walls from collapsing inwards as the can body is stripped from the wall-ironing punch. The can body is then taken away by a conveyor to a trimming machine which removes the unevenly formed region and leaves the can body with the correct height.

It is common for the wall-ironing punch diameter to vary along its length so that the can wall is thicker towards its open end. This thicker wall is less prone to damage when the can is later stripped from the wall-ironing punch, and the thicker wall is also more suited to subsequent manufacturing steps including trimming and flange-forming.

Because the wall-ironing process generates high frictional forces which may damage coatings, wall-ironed cans are most commonly produced from un-coated metal, and liquid coatings are applied and cured after the walls have been ironed, and after the can has been cleaned, and also after some or all of the subsequent forming processes such as necking, flanging and beading have been carried out. It is however possible to wall-iron cans that are made from sheet metal that has been coated with a polymer such as for example polypropylene or polyester such as polyethylene terephthalate (PET). Such coatings are typically applied by extruding or laminating a film onto the metal surface, and creating a bond using heat and pressure. Different polymer formulations may be co-extruded to create films or coatings having layered properties to best suit bonding, permeability, strength and surface finish properties. Opposing sides of the metal sheet may be coated with different materials.

The use of polymer-coated metal to form cans, provides several advantages when compared to applying coatings to already formed can. These include:

- The presence of certain undesirable chemicals such as Bisphenol A may be avoided.
- Cans made from polymer-coated metal may be better suited to subsequent shape-forming processes than those with cured liquid coatings.
- The entire surface (except for its cut-edge) is coated evenly with polymer avoiding the limitations of coating using a spray or roller process.
- Can bodies coated with appropriate polymers are better suited to having heat-sealed lidding applied.
- The cost of providing equipment and materials for cleaning and coating cans may be avoided.

It is however very important that the can-manufacturing processes do not damage pre-applied polymer coatings, and so the manufacturing processes cannot be as severe for polymer-coated metal as they may be for uncoated metal. In particular, using current technology, it is not possible to achieve as great a thickness reduction by wall-ironing in the case of pre-coated metal as compared to uncoated metal.

Because it is not possible to achieve as great a thickness reduction by wall-ironing in the case of pre-coated metal as compared to uncoated metal, the wall-thickness may also be reduced when re-drawing the shallow cup, by providing a small radius on the re-drawing die. Such a small radius induces thinning as the metal is bent around the radius and then straightened again whilst under tension. This thickness reduction takes place prior to wall-ironing. The amount of thickness reduction achieved depends on the re-drawing die radius and the tension generated in the metal as it is being redrawn. Much of this tension is generated by drawing metal from the cup wall into the cup base, and so there is a reduction in this tension once all of the cup wall has been pulled into the cup base. Consequently, the wall thickness of the re-drawn cup is greater towards its open end than towards its base, and this may limit the extent of wall-ironing possible in the wall towards the open end of the can.

Another issue that arises when using pre-coated metal to manufacture cans is that, when cutting a blank, it is common for burrs to form at one side of the blank at its cut edge and for coating material to detach slightly from the opposite side of the blank at its cut-edge. When drawing a circular blank to form a cup on a drawing punch, the blank is clamped between a pressure pad and a drawing die to suppress wrinkling. The clamping force becomes concentrated on a small area adjacent to the cut-edge as the cut-edge is about to be drawn around the drawing radius on the drawing die. This can cause particles of burr and hairs of coating to detach either fully or partially. These can remain on the tools and become embedded in the coating of subsequent cups. The problem is repeated when the cup is re-drawn in the wall-ironing machine. The debris created can damage both the coatings and the tooling. Relieving the clamping force just prior to the edge passing the drawing radius may alleviate this, but timing is critical or wrinkles may still form.

As the uneven raw edge of the can leaves the ironing process, the alignment of the wall-ironing punch and die may be upset by the uneven can wall height creating uneven wall-ironing forces around the can, and these may deflect the wall-ironing punch from its axial path through the dies. Flakes of metal from the cut-edge and burr and coating hairs may easily be wiped from the can and stuck onto the surface of the wall ironing punch.

For these reasons, it has been taught by U.S. Pat. No. 7,878,040 to form a can having substantially no ironing at its open end. U.S. Pat. No. 5,750,222 (FIG. 7) teaches to redraw a flanged can body and simultaneously iron its wall. However it is undesirable to carry out redrawing at the same time as ironing because the additional stresses induced in the body-wall by re-drawing limit the amount of ironing reduction possible without tearing of the body-wall. The claim of up to 40 per-cent ironing reduction from t3 to t4 is not easily achievable at the same time that the cup 1*a* is being redrawn. The method described in U.S. Pat. No. 5,750,222 includes cutting the upper part of the sidewall and the flange, before forming a neck and flange from the body-wall, and so the flange left after the ironing step is discarded.

Stripping the can from the punch using fingers may also create debris and may damage coatings and tooling. It is possible to lift stripper fingers away from the can surface as the can passes through on the forward stroke, but the fingers will still tend to dig-in to the raw edge as the can is stripped from the wall-ironing punch and this may damage the surface of the wall-ironing punch.

Yet another issue that arises from traditional can body manufacturing processes is that, due to the wall-ironed can wall being cylindrical and work-hardened, it is not practical to subsequently form tapers or steps in the wall to allow can bodies to be nested inside one-another. The ability to nest can bodies is desirable to save transport and storage costs. Can bodies formed using traditional processes typically allow only a flange to be formed at the trimmed edge of the can. Any attempt to further form the can wall results in over-stretching and the forming of splits.

Nest-able cans having tapers or steps may be manufactured using a series of drawing and re-drawing stages, and a flange is usually retained on the can at each forming stage. However it is not usually practical to reduce wall thicknesses, for example by using small draw tool radii to induce stretching, due to risks of either splitting can walls due to over-stretching, or of forming wrinkles due to lack of support. Generally, nest-able cans need thicker walls which makes them expensive.

It is possible to expand cylindrical can walls to form tapers to provide nest-ability for example, by pushing a tapered tool into the open end of a can body. Likewise it is possible to reduce can wall diameters to provide nest-ability by pushing the closed end of a can into a tapered tool. Forming tapers is generally difficult because it is necessary to form a large area of can wall at any given moment. The ability to form a flange on a cylindrical wall-ironed can body may be limited by work-hardening caused by wall-ironing. It is difficult to expand a can wall to provide both a taper and a flange due to the risk of it splitting at the open end.

It is desirable for a can body to have a flange if it is to be shaped by expansion, to avoid it splitting at its open end, and it is further desirable for the flange not to have been work-hardened by wall-ironing in a previous manufacturing step.

WO2006075132A1 teaches how a tubular can body may be shaped to provide a flare (in other words a curved taper of varying angle) including the first step of forming a flange. This method is directed to forming a cylindrical metal tube that has no flange into a shape and illustrates the difficulty of forming shapes with steps and tapers from a cylindrical body without a flange. Unfortunately the method of WO2006075132A1 provides no means of leaving a flange on the final shaped article, and the risk remains of splitting during the first step of forming a flange.

It is desirable to provide a method of manufacturing cans using pre-coated metal which avoids damage to the coating caused by wall-ironing and by burrs of metal becoming detached from the cut-edge. It is also desirable to provide one or more methods of forming steps or tapers in can body walls to produce nest-able cans.

SUMMARY

According to a first aspect of the present invention, there is provided a method of reducing a thickness and increasing a height of a cylindrical wall of a metal cup so as to form a can body. The method comprises positioning a wall-ironing punch inside the cup, moving an annular wall-ironing die axially over the closed end of the cup towards the open end of the cup, but not beyond the open end of the cup, in order to iron the cylindrical wall from the closed end up to a position axially spaced from the open end and moving the wall-ironing die back in an opposite direction to remove the can body from the die.

The position may be between 1 mm and 20 mm from the open end of the formed can body.

The step of moving the wall-ironing die back in the opposite direction may be carried out with the punch positioned inside the can body in order to burnish a portion of the cylindrical wall.

The method may comprise pressing a tool against the outer surface of a base of the can body as the wall-ironing die is moved back in the opposite direction in order to form a profile in the base.

The method may comprise removing the punch from within the can body prior to moving the wall-ironing die back in the opposite direction.

The method may comprise pressing a tool against the outer surface of a base of the can body as the wall-ironing die is moved towards the open end of the cup in order to form a profile in the base.

The die may be shaped to pass across the region beyond the axially spaced position without ironing that region, and the profile may be formed in the base during this passage.

The metal cup may comprise a flange surrounding the open end and the method may comprise applying a force to the flange to remove the can body from the punch.

The can body may be pushed off the punch when the burnishing is complete.

The punch may comprise an internal longitudinal channel and the method may comprise introducing compressed air into the can body through the channel to remove the can body from the punch.

According to a second aspect of the present invention there is provided a method of increasing a diameter of at least one region of a can body having an open end surrounded by a flange. The method comprises clamping the flange and pushing a punch having a number of portions of different diameters, into the can body, through the open end, wherein a first portion of the punch has a diameter that provides a small clearance between the punch and an inner surface of the can body, such that a region of the can body adjacent a closed end of the end body is substantially not increased.

According to a third aspect of the present invention there is provided a method of reducing a diameter of one or more regions of a can body by pushing an annular tool having a number of portions of different diameter axially over the can body and pushing a punch inside the can body, the punch having a number of portions of different diameter, wherein at least one portion has a diameter corresponding to a desired reduced can body diameter, to form the can body wall against the punch.

The method of the third aspect above may be performed as part of a drawing operation.

The methods of the second and/or the third aspects above may further comprise forming a curl at the edge of a flange of the can body.

According to a fourth aspect of the present invention there is provided a method of increasing a diameter of one or more regions of a can body by pushing an annular tool having a number of portions of different diameter axially over the can body and pushing a punch inside the can body, the punch having a number of portions of different diameter, wherein at least one portion has a diameter corresponding to a desired increased can body diameter, to form the can body wall against the punch.

The method of the second, third and fourth aspects above may be configured to form a nestable can body.

The method of the second, third and fourth aspects above may be performed on a can body formed by the method of the first aspect.

The method of any of the first, second, third and fourth aspects above may be applied to a cup and/or a can body made from sheet metal pre-coated with a polymer such as polyester or polypropylene.

In any one of the second, third and fourth aspects described above, it will be appreciated that the steps of the method may be performed in any order.

DRAWINGS

FIG. 9A shows a cross-sectional view of an alternative tooling apparatus to wall-iron a cup, in an open position with a cup in place;

FIG. 9B and FIG. 9C show partial enlarged views of FIG. 9A;

FIG. 15A shows a cross sectional view of the tooling apparatus of FIG. 9A moved back to its original position with a wall-ironed can body in place;

FIG. 15B and FIG. 15C show partial enlarged views of FIG. 15A;

FIG. 23A shows a cross sectional view of the tooling apparatus of FIG. 21A moved back to its original position with a trimmed can body in place;

FIG. 23B shows a partial enlarged view of FIG. 23A;

FIG. 26A shows a cross sectional view of the tooling apparatus of FIG. 25A moved to a position to shape the wall and clamp the flange of the can body;

FIG. 26B and FIG. 25C show partial enlarged views of FIG. 26A;

FIG. 26C shows a partial enlarged view of FIG. 26A;

FIG. 27A shows a cross sectional view of the tooling apparatus of FIG. 25A moved to a position to draw the flange of the can body;

FIG. 27B shows a partial enlarged view of FIG. 27A;

FIG. 28A shows a cross sectional view of the tooling apparatus of FIG. 25A moved to a position to curl the drawn flange of the can body;

FIG. 28B shows a partial enlarged view of FIG. 28A;

FIG. 29A shows a cross sectional view of the tooling apparatus of FIG. 25A moved back to its original position with a shaped and curled can body in place;

FIG. 29B shows a partial enlarged view of FIG. 29A;

FIG. 30A shows a perspective view of two shaped and curled can bodies nested together;

FIG. 30B shows a cross-sectional view of the can bodies of FIG. 30A;

FIG. 30C, FIG. 30D, FIG. 30E and FIG. 30F show partial enlarged views of FIG. 30B;

FIG. 31B shows a cross-sectional view of the can bodies of FIG. 31A;

FIG. 31C, FIG. 31D, FIG. 31E and FIG. 31F show partial enlarged views of FIG. 31B;

FIG. 32A shows a cross-sectional view of an alternative tooling apparatus to shape a flanged can body, in an open position with a can body in place;

FIG. 32B and FIG. 32C show partial enlarged views of FIG. 32A;

Figures 35A, 35B, 35C, 35D:
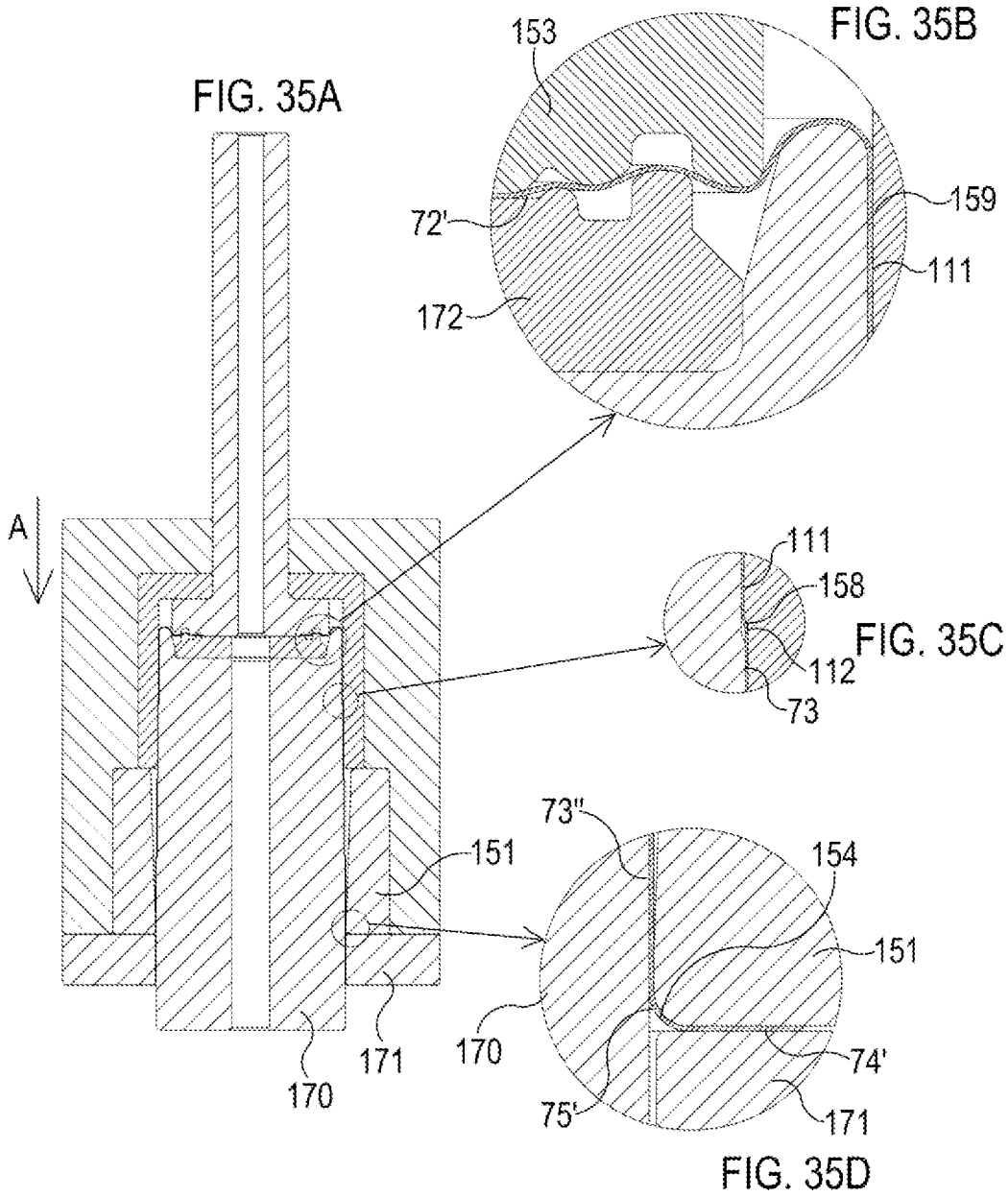
FIG. 35A shows a cross-sectional view of the tooling apparatus of FIG. 32A moved to a position to shape the can base and finish shaping the can wall.
Figures 38A, 38B, 38C:
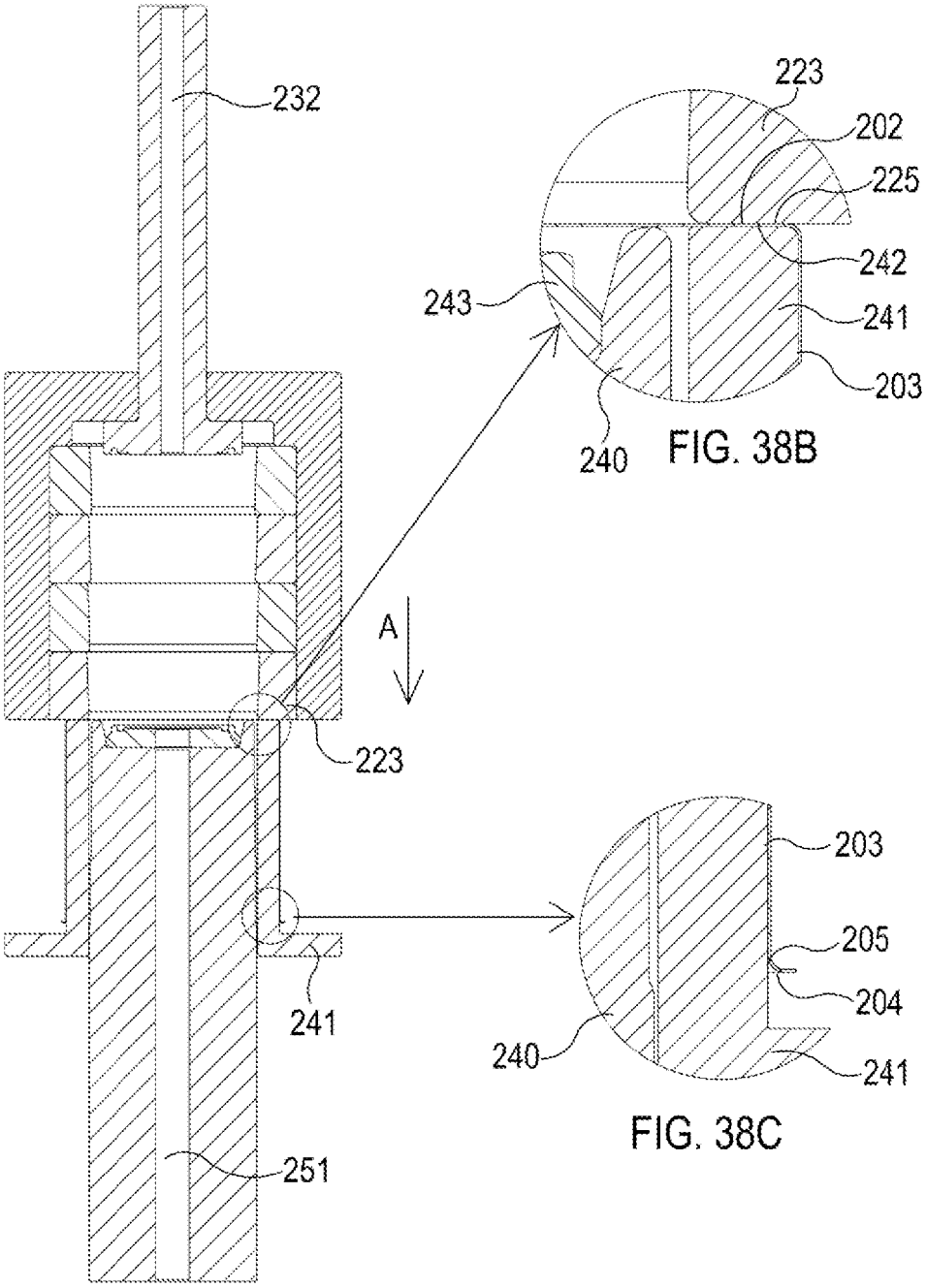
Figure 39A:
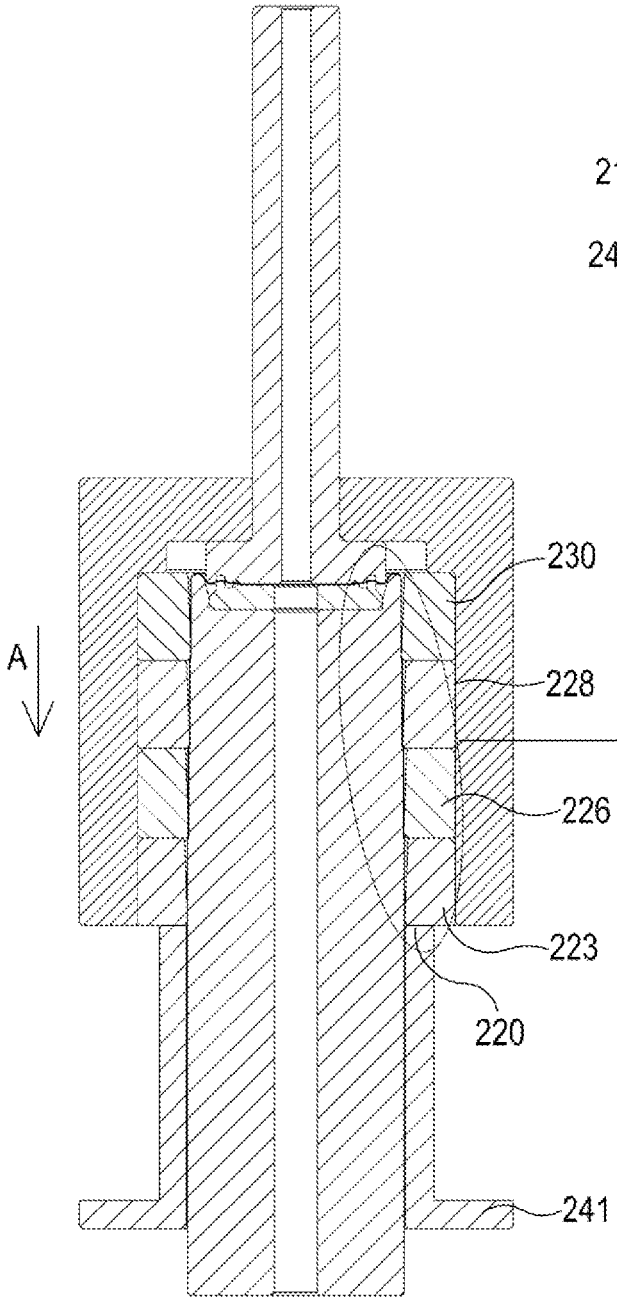
Figure 39B:
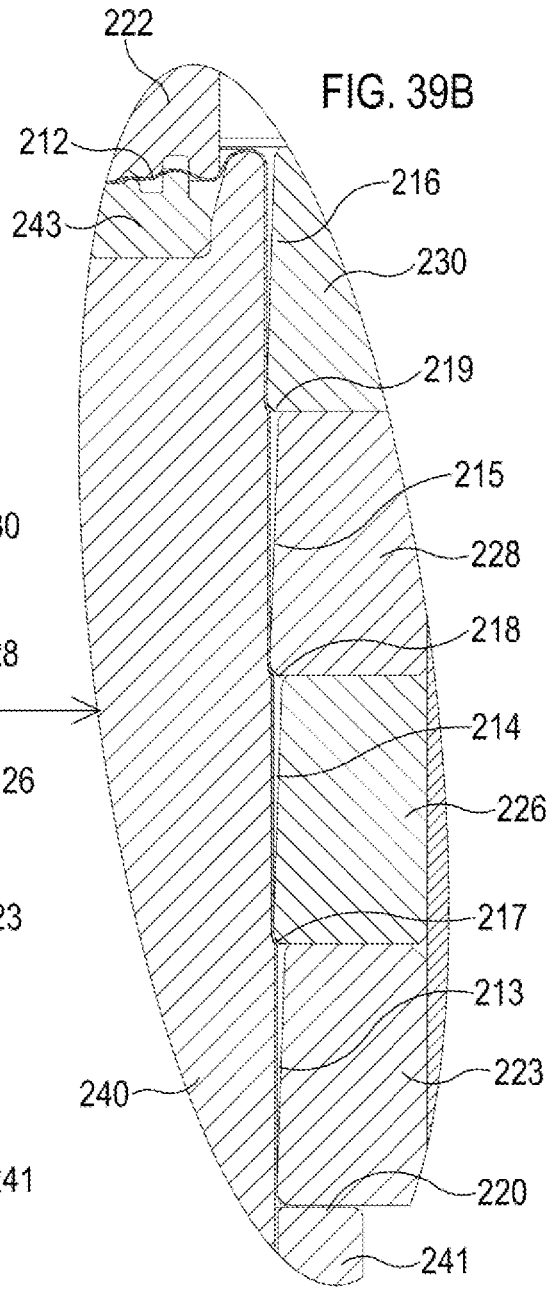
Figures 40A, 40B:
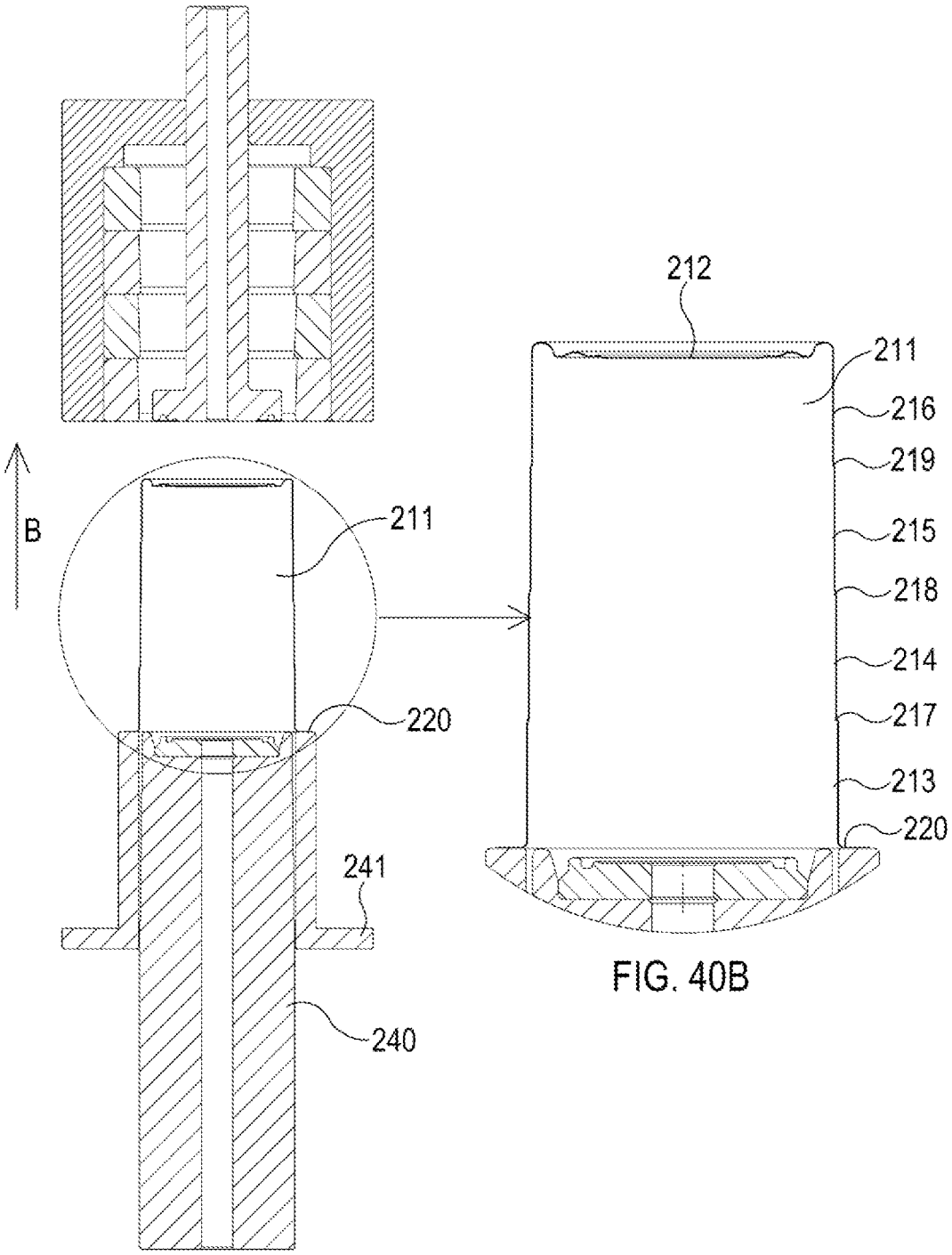

FIG. 35B, FIG. 35C, and FIG. 35D show partial enlarged views of FIG. 35A;

FIG. 36A shows a cross sectional view of the tooling apparatus of FIG. 32A moved back to its original position with a shaped can body in place;

FIG. 36B shows a partial enlarged view of FIG. 36A;

FIG. 37A shows a cross-sectional view of a tooling apparatus to draw a can body having a body-wall of a number of cylindrical portions of different diameter, from a cup, in an open position with a cup in place;

FIG. 37B and FIG. 37C show partial enlarged views of FIG. 37A;

FIG. 38A shows a cross sectional view of the tooling apparatus of FIG. 37A moved to a position to clamp the base of the cup;

FIG. 38B and FIG. 38C show partial enlarged views of FIG. 38A;

FIG. 39A shows a cross sectional view of the tooling apparatus of FIG. 37A moved to a position to draw the cup into a can body and to shape its base;

FIG. 39B shows a partial enlarged view of FIG. 39A;

FIG. 40A shows a cross sectional view of the tooling apparatus of FIG. 37A moved back to its original position, with a can body in place; and FIG. 40B shows a partial enlarged view of FIG. 40A.

DETAILED DESCRIPTION

FIGS. 1A to 1D illustrate a wall-ironed can body 1 made from sheet metal that has been pre-coated with a polymer, such as polypropylene, or a polyester such as polyethylene terephthalate (PET). Different polymers may be used on each side of the sheet. The can body 1 comprises a base 2 at its closed end, a cylindrical body wall 3 and a flange 4 surrounding its open end. The body wall 3 comprises a region 5 of similar thickness to the base 2 at its closed end, a transitional region 6, a central region 7 whose thickness has been reduced by wall-ironing, a further transitional region 8 and a region 9 at the open end of the can body, of a similar thickness to the flange 4. In other words, the thickness of the can body wall 3 is greater at the closed and open ends of the can body 1 than it is in the central region 7. However, the can body 1 is not nestable at this stage. A greater wall thickness at the closed end avoids a sudden change in thickness between base and body wall. A greater wall thickness at the open end of the body provides strength and formability to the junction between the body wall and the flange.

FIGS. 2 to 8 illustrate a two-part tooling apparatus used in a method of forming the can body of FIG. 1. The method comprises reducing the thickness and increasing the height of the wall of a flanged metal cup 11 by wall-ironing, and may leave a flange at the open end of the can body. The tooling, shown in various stages of operation, comprises a set of upper and lower tools. In this example, the upper tool set is moveable towards the lower set in the direction of arrow A.

The upper tools include a moveable pusher 21, a retainer 22, a number of pushing pins 23, an annular wall-ironing die 24 having a profiled inner surface, an outer base-clamping tool 25, an outer base-forming tool 26, a piston 27 and a number of springs 28. The piston 27 and hence the outer base-forming tool 26 is pushed downwards by compressed air pressure, and the outer base-clamping tool 25 is pushed downwards by the springs 28. The radially inner wall of the wall ironing die 24 comprises an entry 29, an exit 30 and a land 31, as described below.

The internal diameter of the wall-ironing die 24 at the smallest position within its profile is selected to create the desired can wall thickness and height. This part of the profile is known as the "land". The part of the profile between the "land" and the end towards the open end of the can body is known as the "entry" and the part of the profile between the "land" and the end towards the closed end of the can body is known as the "exit".

The land is cylindrical or slightly divergent by up to 5 microns in the direction towards the exit, with a width preferably between 100 and 1500 microns and more preferably between 200 and 800 microns. The entry adjacent to the land is conical with an angle of between 1 degree and 8 degrees relative to its axis when forming pre-coated metal sheet. The entry adjacent to the land is preferably conical with an angle between 1 degree and 5 degrees relative to its axis when forming pre-coated metal sheet, and more preferably between 2 degrees and 4 degrees. The exit adjacent to the land is conical with an angle of between 1 degree and 5 degrees relative to its axis. The exit adjacent to the land is preferably conical with an angle between 1 degree and 4 degrees relative to its axis when forming pre-coated metal, and more preferably between 1 degree and 3 degrees.

It is preferable to provide a small radius between the entry and the land and between the land and the exit, to create smooth transitions. An alternative profile may be used wherein the land is simply a curved portion connecting the entry and exit.

The portions of the die 24 profile that do not contact the body wall may be of any shape to suit the construction of the tooling and to provide suitable guidance of the cup and the tools before and after forming the can wall. It is preferable to limit the length of the entry to allow the part of the wall-ironing die that is reducing the can wall thickness to be moved as close as possible towards the open end of the can.

The lower tools include a wall-ironing punch 40 and a plate 42. The plate 42 is pushed upwards to the position in which it is shown by a device such as an air piston or springs (not shown here). The outer surface of the wall-ironing punch 40 is generally cylindrical, but its diameter may vary along its height, in order to control the thickness of the body-wall according to that desired in different regions. The radially outer wall of the wall-ironing punch 40 therefore comprises a transition portion 43 of gradually increasing diameter, leading to a portion of largest diameter 44, leading to a transition portion 45 of reducing diameter to a portion of smaller diameter 46. Further, the wall-ironing punch 40 is profiled at the end corresponding to the closed end of the can body according to the base profile desired to be formed. The wall-ironing punch 40 is smoothly tapered from this profile to the cylindrical portion of increased diameter, to create a gradual reduction in can body-wall thickness. The punch 40 is also tapered from the cylindrical portion to a portion of reduced diameter towards the end corresponding to the open end of the can body.

A fluid coolant may be fed through channels in the punch 40 and/or the die 24 to control its temperature and that of the can body being manufactured. The temperature and flow of the coolant may be controlled to control the temperature of the can walls. Alternatively, the temperature and flow of the coolant may be controlled to control the thermal expansion of the wall-ironing punch 40 relative to that of the wall-ironing die 24, or vice versa, and hence control the thickness and height of the can wall.

Figure 1A:
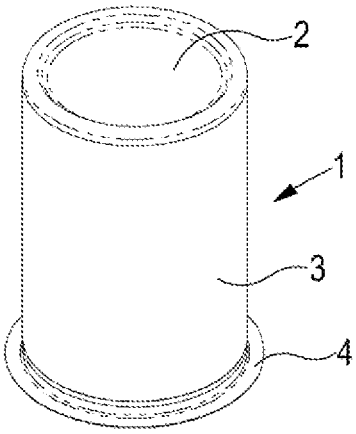
FIG. 1A shows a perspective view of a can body.
Figure 1B:
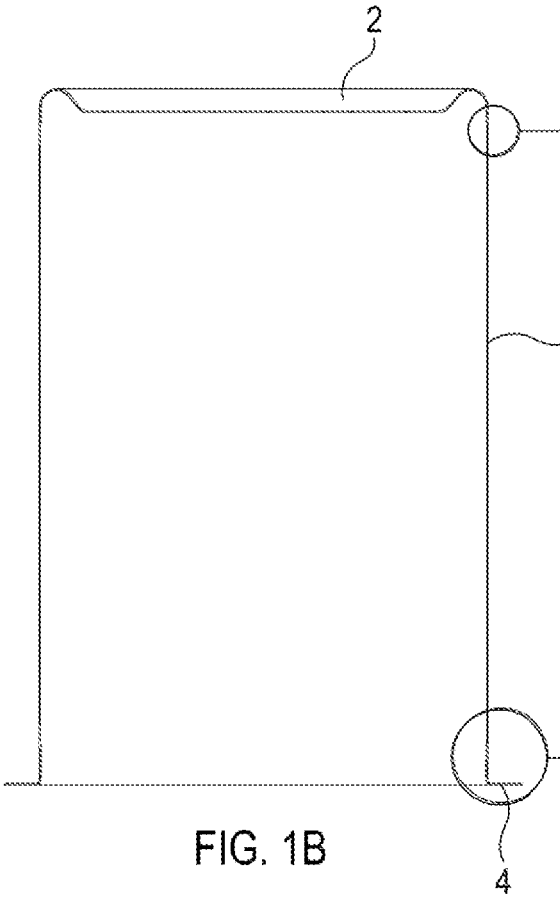
FIG. 1B shows a cross section of the can body of FIG. 1A.
Figure 1C:
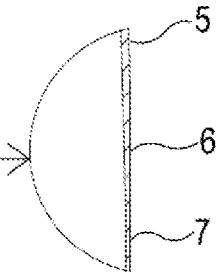
FIG. 1C and FIG. 1D show partial enlarged views of FIG. 1B.
Figure 1D:
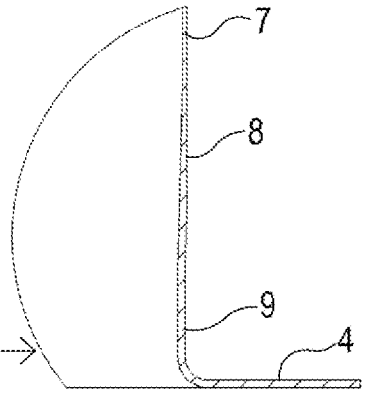
Figures 2A, 2B, 2C:
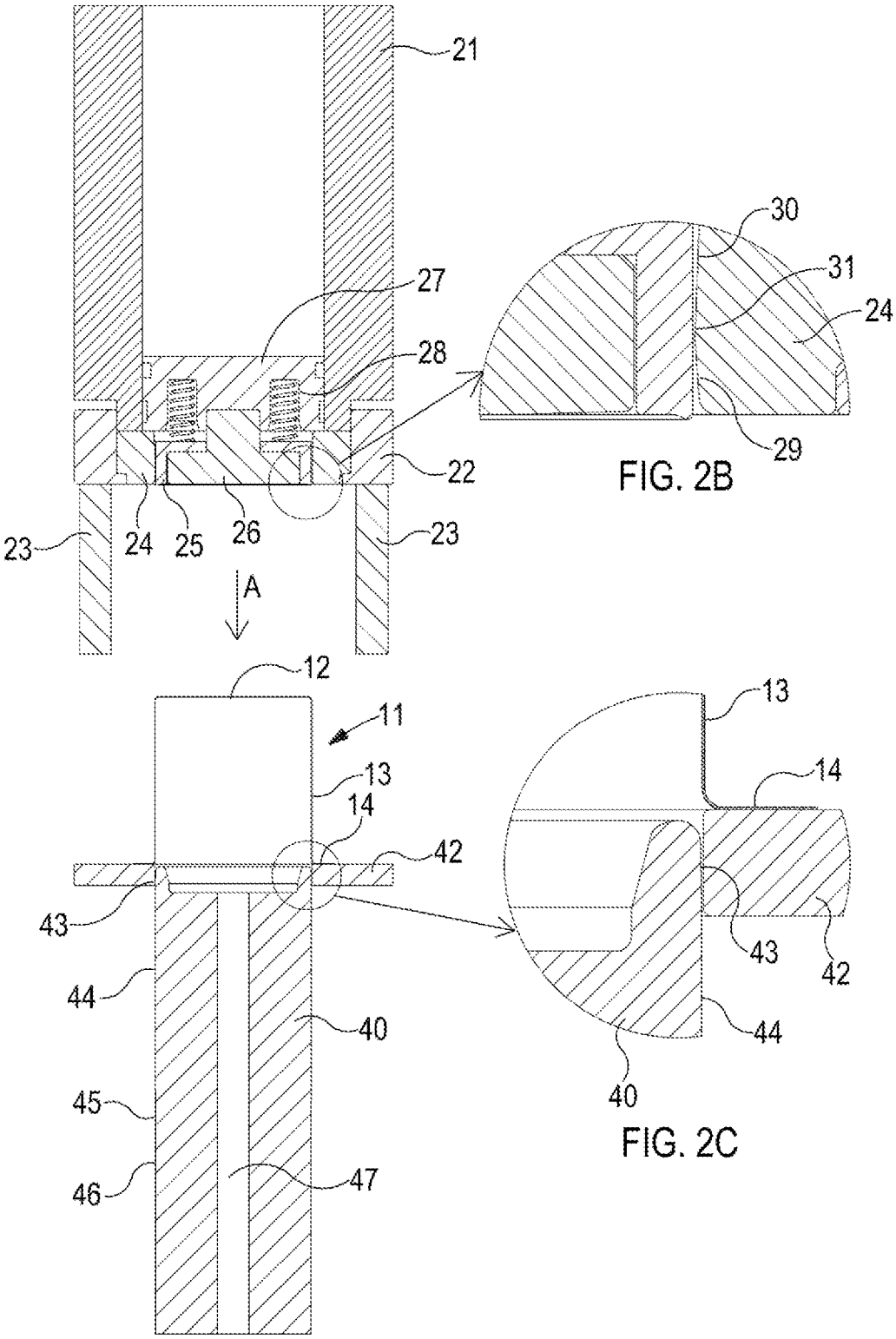
FIG. 2A shows a cross-sectional view of a tooling apparatus to wall-iron a cup, in an open position with a cup in place.
FIG. 2B and FIG. 2C show partial enlarged views of FIG. 2A.

FIGS. 2A, 2B and 2C illustrate the upper and lower tooling with the flanged cup 11 in place. The cup 11 comprises a base region 12, a cylindrical body-wall 13 and a flange 14, and is positioned to rest on the plate 42 axially central to the wall-ironing punch 40.

The gap between the land 31 of the wall-ironing die 24 and the largest diameter 44 of the wall-ironing punch 40 is less than the thickness of the cup body-wall 13, and the gap between the land 31 of the wall-ironing die and the smaller diameter 46 of the wall-ironing punch 40 is more than the thickness of the cup body-wall 13.

Figures 3A, 3B, 3C:
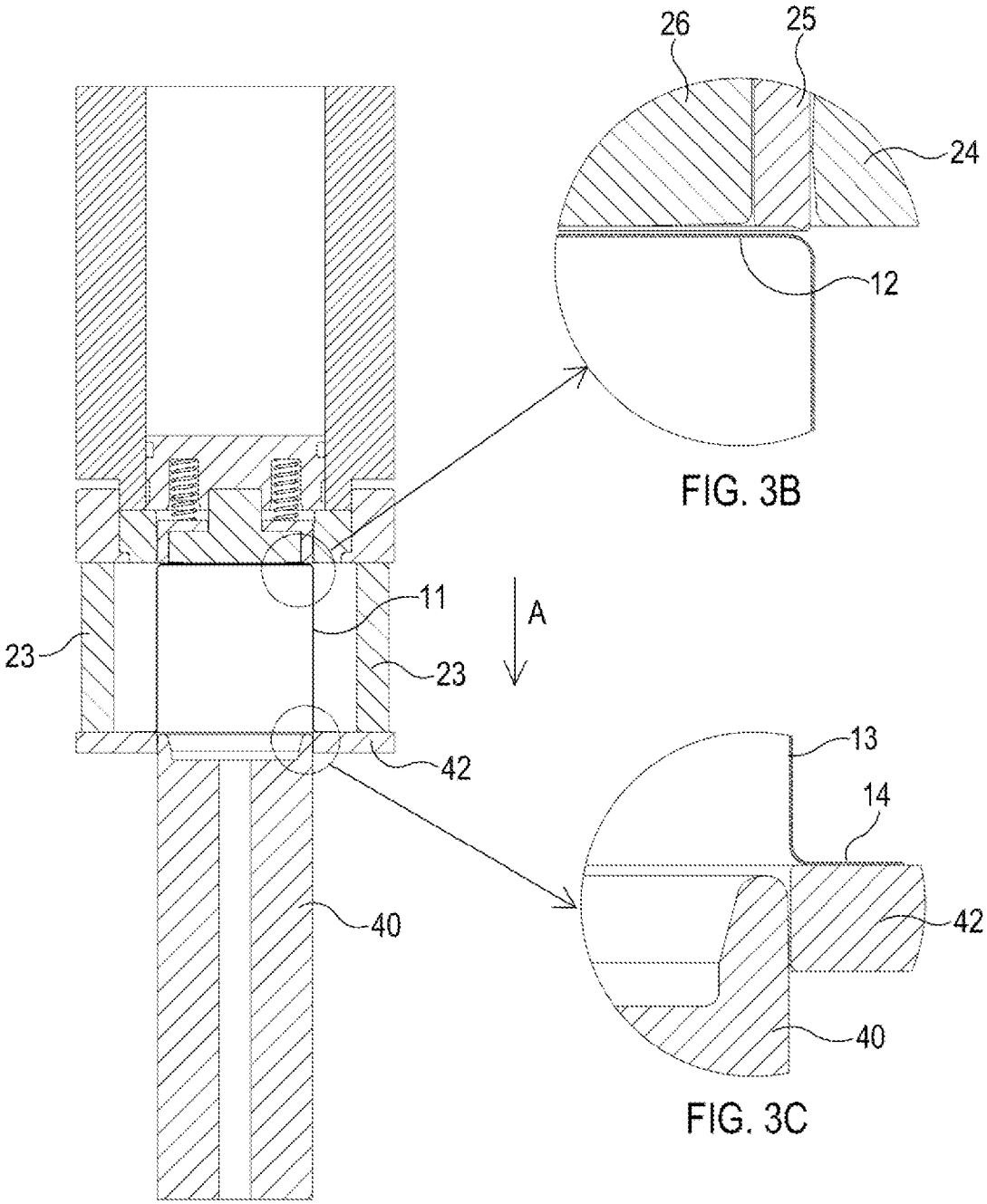
FIG. 3A shows a cross sectional view of the tooling apparatus of FIG. 2A moved to a position to start lowering the cup.
FIG. 3B and FIG. 3C show partial enlarged views of FIG. 3A.

Referring to FIGS. 3A, 3B and 3C, the upper tooling has been moved downwards in the direction of arrow A to a position wherein the pins 23 contact the plate 42. Any further movement will move the plate 42 and lower the cup 11 over the punch 40.

Figures 4A, 4B:
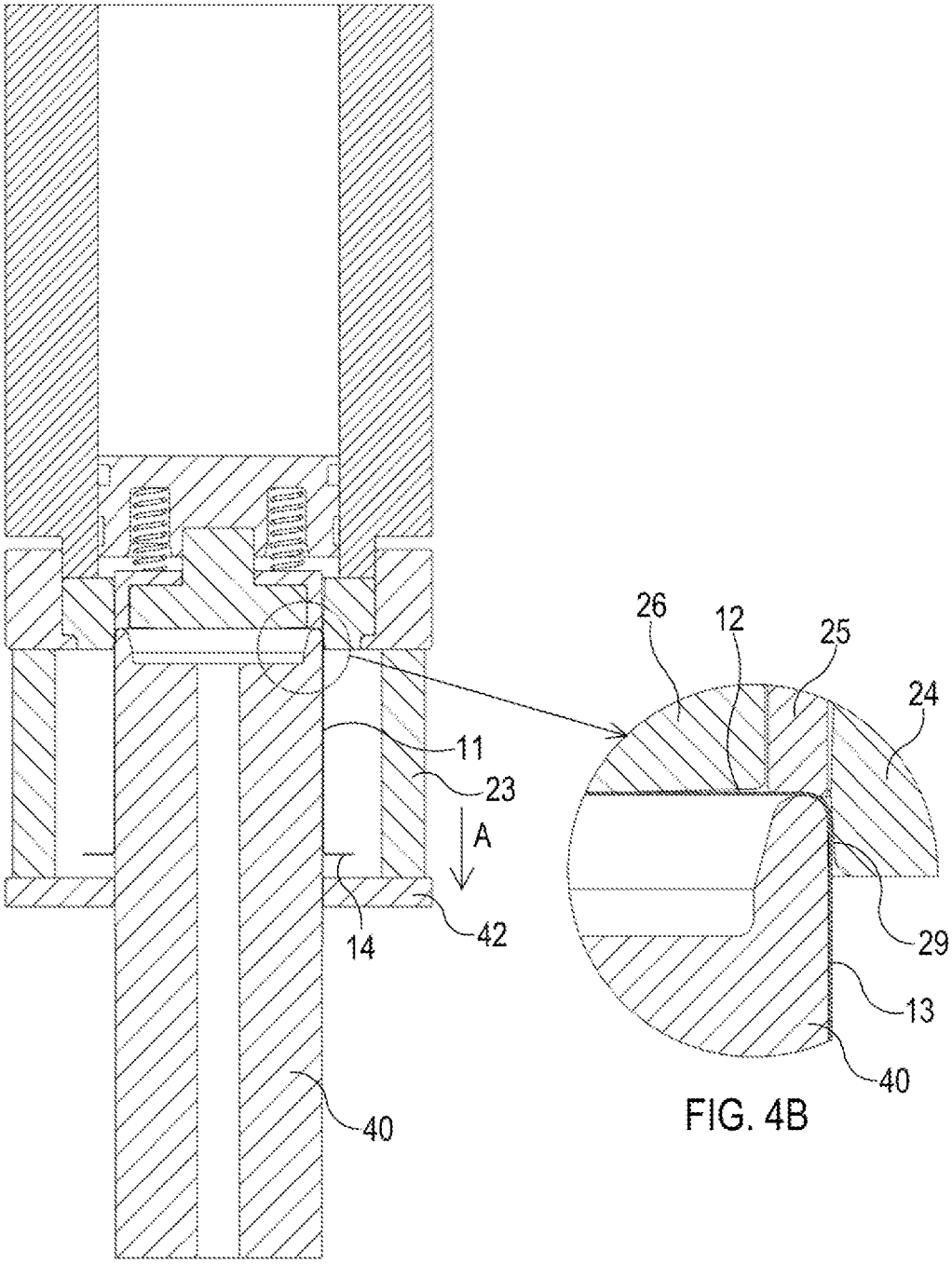
FIG. 4A shows a cross sectional view of the tooling apparatus of FIG. 2A moved further to a position to start wall-ironing the cup.
FIG. 4B shows a partial enlarged view of FIG. 4A.

Referring to FIGS. 4A and 4B, the upper tooling has been moved further downwards in the direction of arrow A to a position beyond which wall-ironing will commence. The base 12 of the cup 11 is now pushed against the punch 40 by the outer base-clamping tool 25 and the outer base-forming tool 26. The entry 29 of the die 24 is just coming into contact with the body-wall 13 of the cup 11. The pushing pins 23 have pushed the plate 42 down so that the flange 14 of the cup is no longer in contact with the plate 42.

During wall-ironing, the entry 29 of the wall-ironing die 24 squeezes or irons the body-wall against the wall-ironing punch, reducing its thickness and increasing its height.

Figures 5A, 5B, 5C:
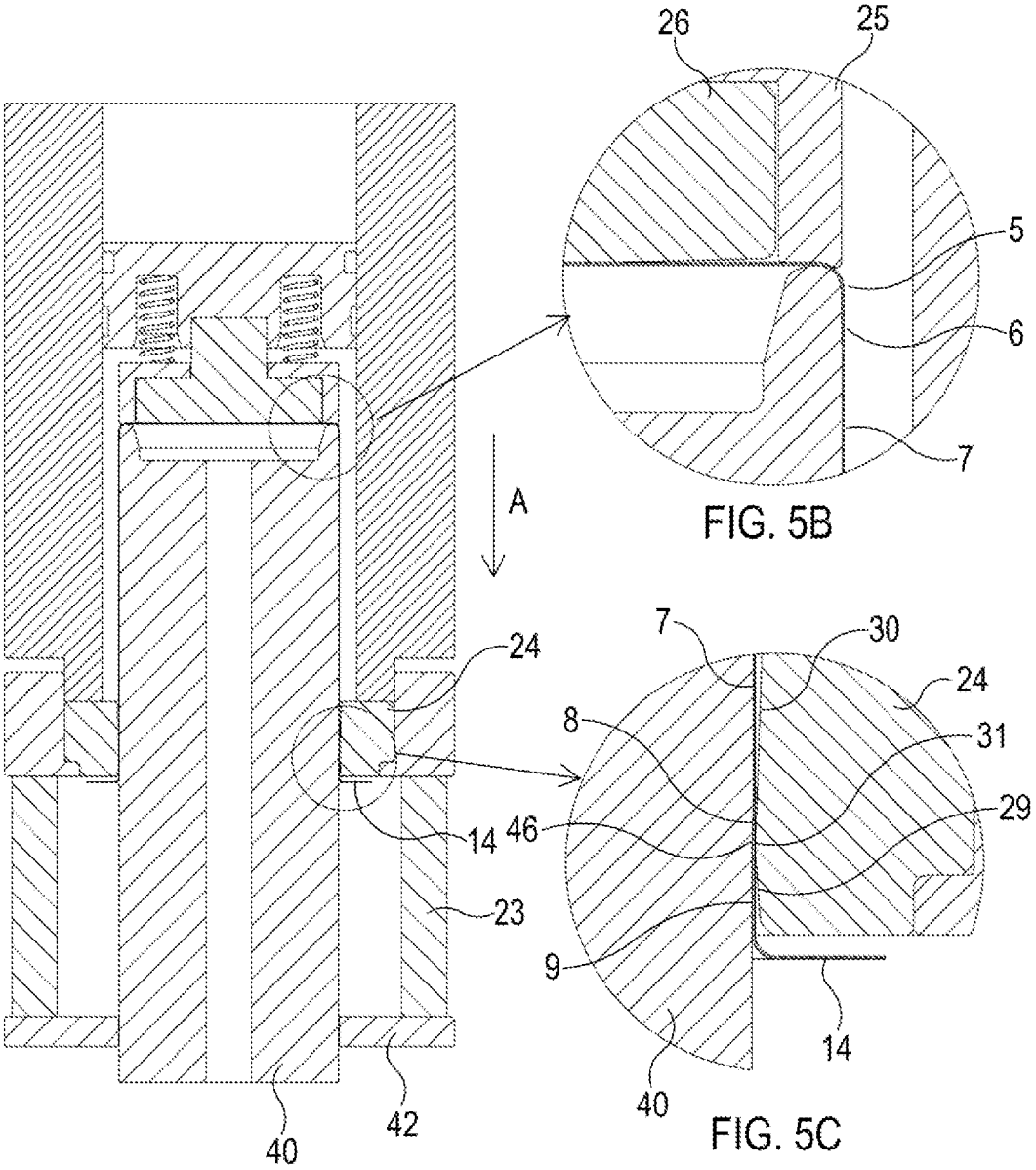
FIG. 5A shows a cross sectional view of the tooling apparatus of FIG. 2A moved further to a position to finish wall-ironing the cup.
FIG. 5B and FIG. 5C show partial enlarged views of FIG. 5A.

Referring to FIGS. 5A, 5B and 5C, the upper tooling has been moved to its lowermost position, which has wall-ironed the body-wall. The land 31 of the die 24 is now adjacent to the smaller diameter 46 of the punch 40. This smaller diameter 46 which corresponds to the position of the die 24 at the end of its downward movement is small enough to limit or avoid reduction of the body wall thickness in that region. This creates a smooth increase in wall thickness adjacent to the flange 14. With reference also to FIG. 1, region 9 of the can body-wall (adjacent to the flange 14 and corresponding to the smaller diameter 46 of the punch 40) is not wall-ironed, region 7 has been wall-ironed, and region 8 has been partially wall-ironed. In other words, wall-ironing stops at a position axially spaced from the open end of the can body, short of the flange 14 and the cut edge. This assists in preventing flakes or burrs of metal from the rough cut edge, or (where the can body is formed from pre-coated metal, as in this example) particles of coating from becoming detached. The position at which ironing stops may be between 1 mm and 20 mm from the open end of the formed can body.

Figure 6A:
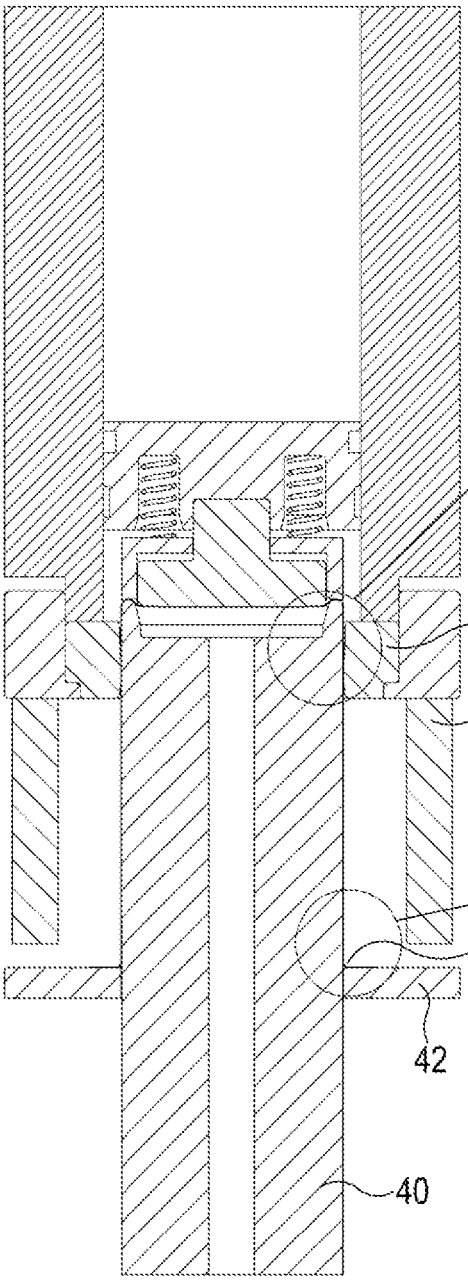
FIG. 6A shows a cross sectional view of the tooling apparatus of FIG. 2A moving back.
Figure 6B:
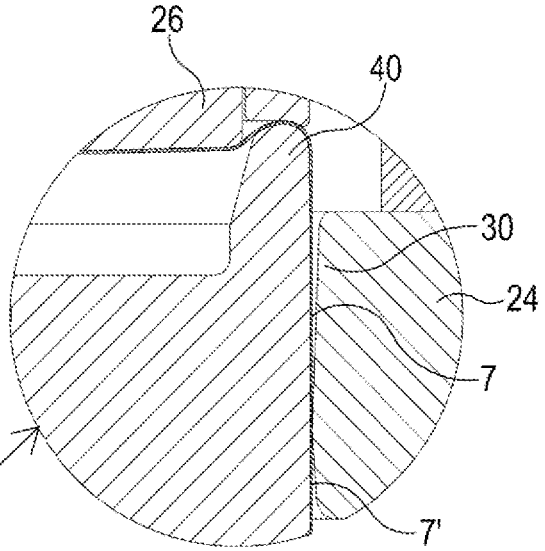
FIG. 6B and FIG. 6C show partial enlarged views of FIG. 6A.
Figure 6C:
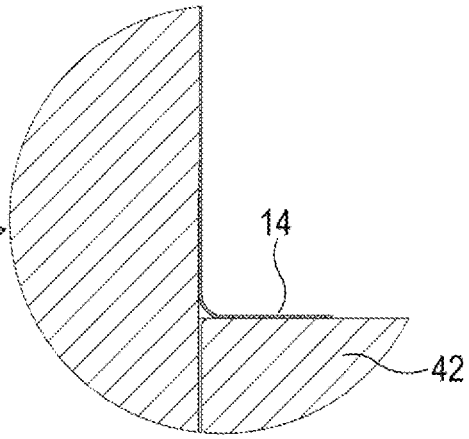

Referring to FIGS. 6A, 6B and 6C, the upper tooling is being moved back upwards in the direction of arrow B, and the wall-ironing die 24 is moving axially over the surface of the body-wall. As discussed above with reference to the term "burnishing", the exit 30 of the wall-ironing die 24 now squeezes or irons the wall-ironed body-wall 7 to a small extent against the wall-ironing punch 40, slightly further reducing its thickness at 7' and slightly further increasing its height. This helps to reduce the grip of the can body on the punch 40 and facilitates subsequent removal.

"Burnishing", as described above, occurs because as the wall-ironing die 24 is moved downwards to iron the can wall, it will expand elastically radially due to the ironing forces. Likewise the wall-ironing punch 40 will be compressed slightly. Thus when the wall-ironing die 24 is moved back over the can wall, it will exert forces on the can wall as a result of this elasticity. These forces will act compressively on the can wall with both radial and axial components depending on the profile of the land and adjacent exit portion. The can wall is also subjected to frictional forces, including those from contact with the wall-ironing punch 40, and forces applied by additional tools opposing the closed end of the can body. Thus the can wall will typically be ironed slightly or "burnished" as the wall-ironing die 24 is moved back.

The smaller diameter 46 of the punch 40 allows "burnishing" of the can wall to start gradually as the die 24 is moved back up, and helps avoid the die 24 penetrating into the can wall at the end of its stroke, which might then cause the can wall to be pulled back along the wall-ironing punch 40 as the wall-ironing die 24 is moved back.

The increasing height of the can body-wall during "burnishing" allows the end of the body-wall to be pulled around the end of the wall-ironing punch 40 by the outer base-forming tool 26, forming the base profile. The outer base-clamping tool 25 allows the region of the can body that it clamps to slide between itself and the end of the wall-ironing punch 40 and prevents the can body 1 from being pushed away from the end of the wall-ironing punch 40 during the upwards movement of the die 24, by applying a force to the closed end of the can body 1. The resulting base profile may satisfy the needs of the container, or may be formed further in a later manufacturing step.

In other words, since "burnishing" slightly further reduces the thickness and increases the height of the wall, and reduces its tightness on the wall-ironing punch 40, the outer base forming tool 26 is also configured to draw slack material thereby produced into the base profile region of the can body.

As the body-wall is ironed slightly as the die 24 is moved back up, it will become less tight a fit onto the punch 40. This inevitably will cause some slippage between the inside of the can body-wall and the punch 40. For this reason, and because the axial components of forces exerted by the die 24 will push the can body off the punch 40, it is important to provide a pushing force against the closed end of the can body whilst the die 24 is moving back along the can body-wall. In this example, the annular outer base clamping tool 25 tool is profiled with an offset to correspond to the punch 40, to support the profile of the outer closed end of the can body and prevent it being pushed away from the punch 40. However, the pushing force is limited to allow the bottom of the body wall to be pulled around the profile of the punch 40 to avoid the body wall crumpling between the die 24 and the closed end of the can body.

As the upper tooling is moved back upwards, the plate 42 comes back into contact and pushes against the flange 14. In this example, the plate 42 is therefore not in contact with the flange 14 until the step of "burnishing" is complete and so exerts no upward force on the flange 14 during "burnishing" which would push the can body off the punch 40.

Figures 7A, 7B, 7C:
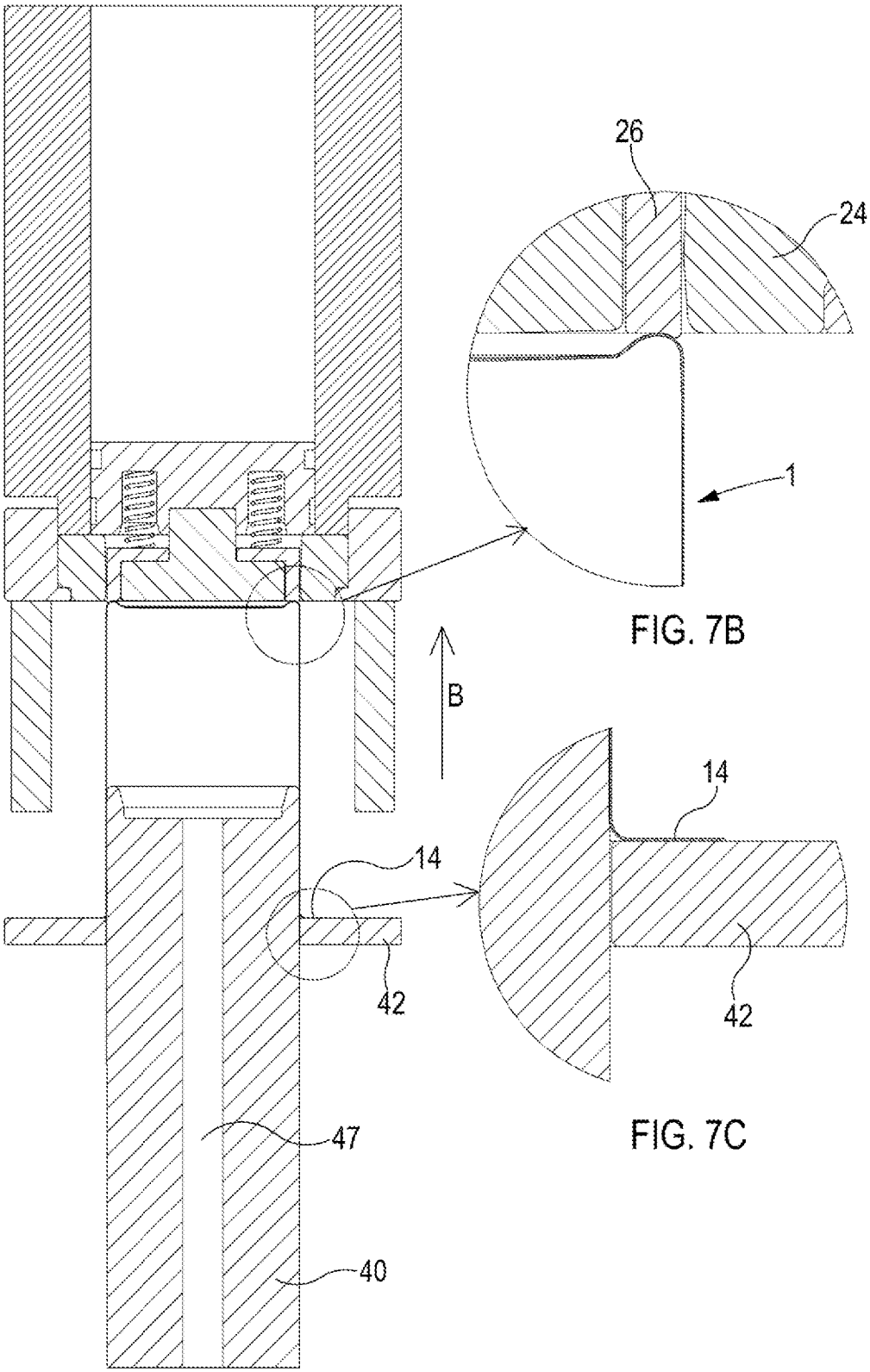
FIG. 7A shows a cross sectional view of the tooling apparatus of FIG. 2A moving further back.
FIG. 7B and FIG. 7C show partial enlarged views of FIG. 7A.

Referring to FIGS. 7A, 7B and 7C, the upper tooling has been moved back further upwards in the direction of arrow C, and the wall-ironing die 24 is no longer in contact with the can body 1. The plate 42 is now pushing against the flange 14 and is thus pushing the can body 1 off the wall-ironing punch 40. Compressed air is introduced into the can body 1 through channel 47 in the punch 40 to assist pushing and to prevent the creation of any vacuum within the can body 1. This ensures that the can body 1 does not collapse inwards. Removal of the can body 1 from the punch 40 is controlled by the outer base-forming tool 26.

Figures 8A, 8B, 8C:
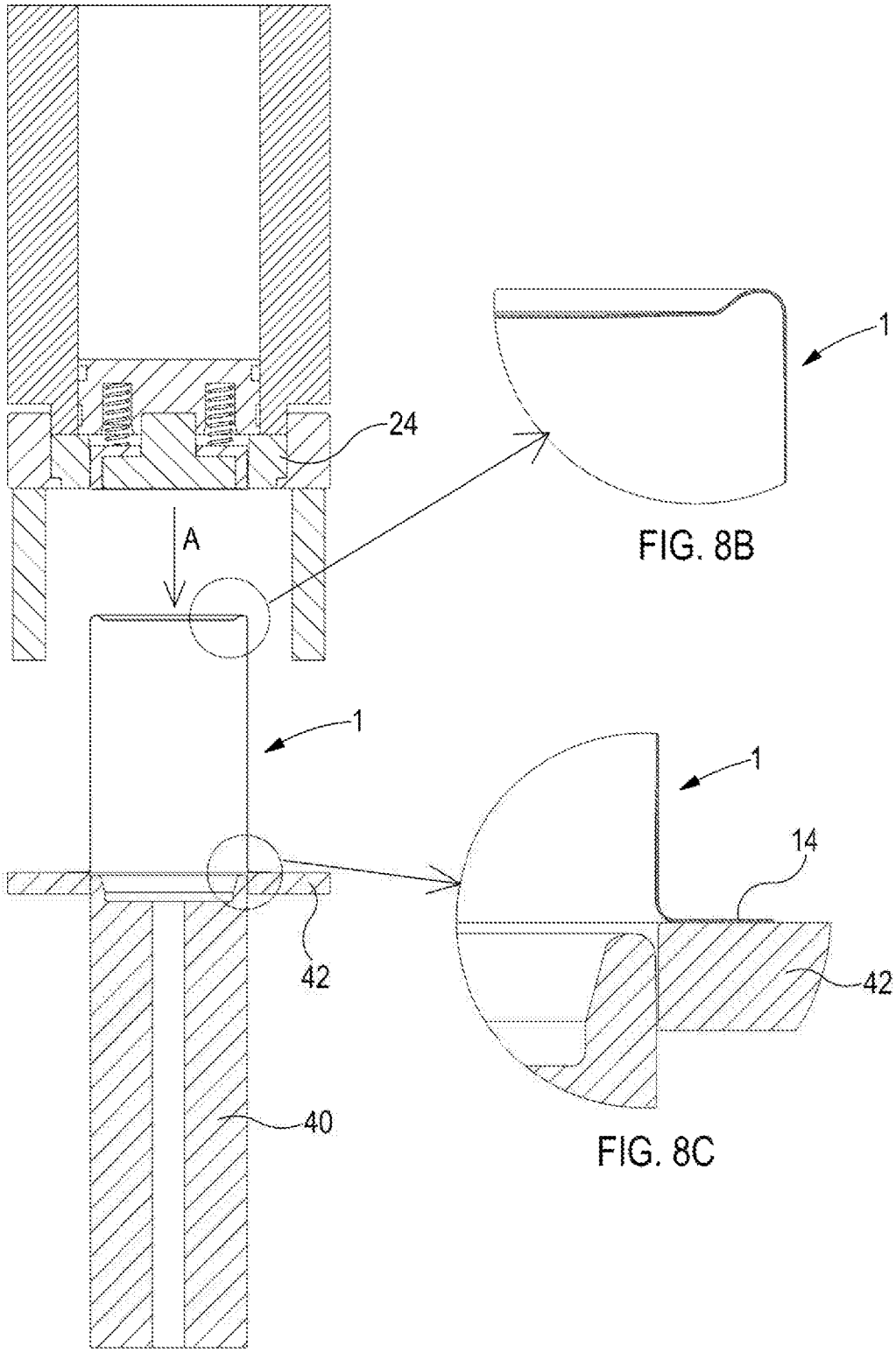
FIG. 8A shows a cross sectional view of the tooling apparatus of FIG. 2A moved back to its original position with a wall-ironed can body in place.
FIG. 8B and FIG. 8C show partial enlarged views of FIG. 8A.

Referring to FIG. 8, the upper tooling has returned to the same position as shown in FIG. 2, but with the wall-ironed can body 1 now in place. The wall-ironed can body 1 of FIG. 1 has now been produced from the flanged cup 11 of FIG. 2. Can body 1 comprises a flange, a profiled base and a body wall of varying diameter, as discussed with reference to FIG. 1.

In an alternative example to that shown in FIGS. 2 to 8, the cup to be wall-ironed by the tooling may have little or no flange, and the plate would therefore only contact the edge of the body-wall. Such an alternative example may be followed if it is desired to create a can body without a flange (not shown).

The height of the can body 1 produced by the method described above will depend on its wall thickness, which in turn will depend on the gap between the punch 40 and die 24, and thus it is preferable to control the height of the can body 1 by controlling this gap. In addition to controlling the temperatures of the punch 40 and the die 24, the gap may be controlled by any of: applying compressive forces from hydraulic pressures to the periphery of the wall-ironing die; applying expansive hydraulic pressures to a channel or channels within the wall-ironing die; and applying expansive hydraulic pressures to a channel or channels within the wall-ironing punch. The gap may be varied between the forward and the backward movement of the wall-ironing die 24 by altering these hydraulic pressures. Increasing the gap during the backward movement of the die 24 may be used to reduce or eliminate the forces exerted by the die 24 that would act to push the can body 1 off the wall-ironing punch 40.

The gap may also be varied between the forward and backward movement of the wall-ironing die 24 by mechanical forces. This may be achieved by providing a die 24 with a conical structure and driving it at its periphery, such that the axial forces applied to the die 24 moving in one direction create radial compression to reduce the gap, and that the axial forces applied to the wall-ironing die moving in the opposite direction create radial expansion to increase the gap.

For use in an alternative method to that discussed with reference to FIGS. 2 to 8 above, FIGS. 9 to 15 illustrate two parts of a tooling apparatus, in various stages of operation. The tooling comprises a set of upper and lower tools, and a flanged metal cup 11 is shown in position. In this alternative method, the can body is pushed off the wall-ironing punch at the same time as the wall-ironing die is moved back up.

As shown in FIGS. 9A, 9B and 9C, the upper tools include a moveable pusher 51, a retainer 52, a wall-ironing die 53, and an outer base-forming tool 54. The radially inner wall of the die 53 comprises an entry 55, an exit 56 and a land 57.

The lower tools include a wall-ironing punch 60 and a plate 61. The plate 61 is pushed upwards to the position in which it is shown by a device such as an air piston or springs, (not illustrated). The radially outer wall of the wall-ironing punch 60 comprises a transition portion 62 of gradually increasing diameter, leading to a portion of largest diameter 63 which, in this example wherein a base profile is to be formed, leads to a transition portion 64 of reducing diameter and to a portion of smaller diameter 65.

The flanged cup 11 comprises a base region 12, a cylindrical body-wall 13 and a flange 14, and is positioned to rest on the plate 61 axially central to the wall-ironing punch 60.

The gap between the land 57 of the die 53 and the largest diameter 63 of the punch 60 is less than the thickness of the cup body-wall 13 and in this example wherein a base profile is to be formed, the gap between the land 57 of the die and the smaller diameter 65 of the punch 60 is greater than the thickness of the cup body-wall 13.

Figures 10A, 10B, 10C:
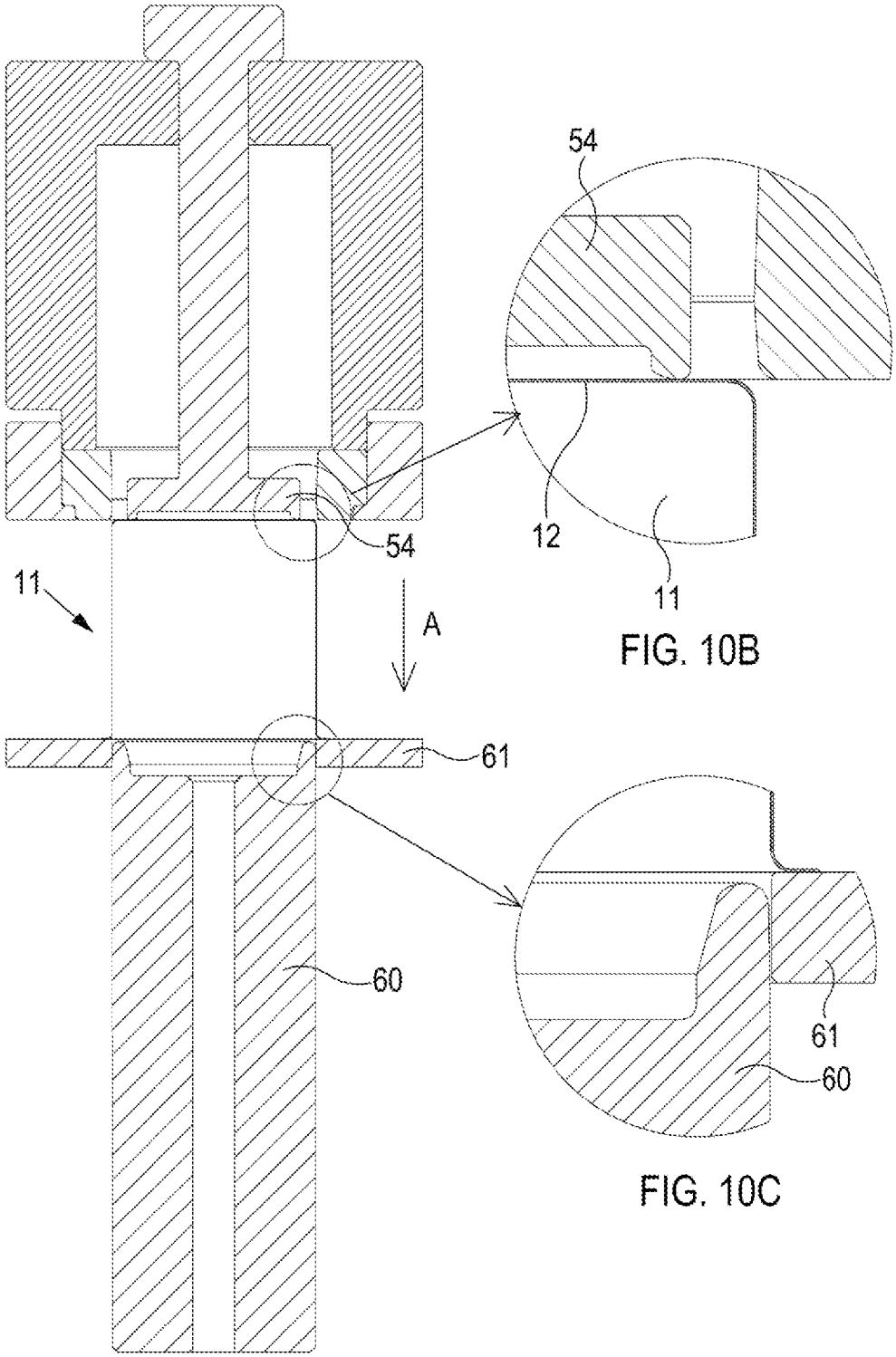
FIG. 10A shows a cross sectional view of the tooling apparatus of FIG. 9A moved to a position to start lowering the cup.
FIG. 10B and FIG. 10C show partial enlarged views of FIG. 10A.

Referring now to FIGS. 10A, 10B and 100, the upper tooling has been moved downwards in the direction of arrow A to a position wherein the outer base-forming tool 54 contacts the base 12 of the cup 11, so that any further movement will move the plate 61 and lower the cup 11 over the wall-ironing punch 60.

Figures 11A, 11B:
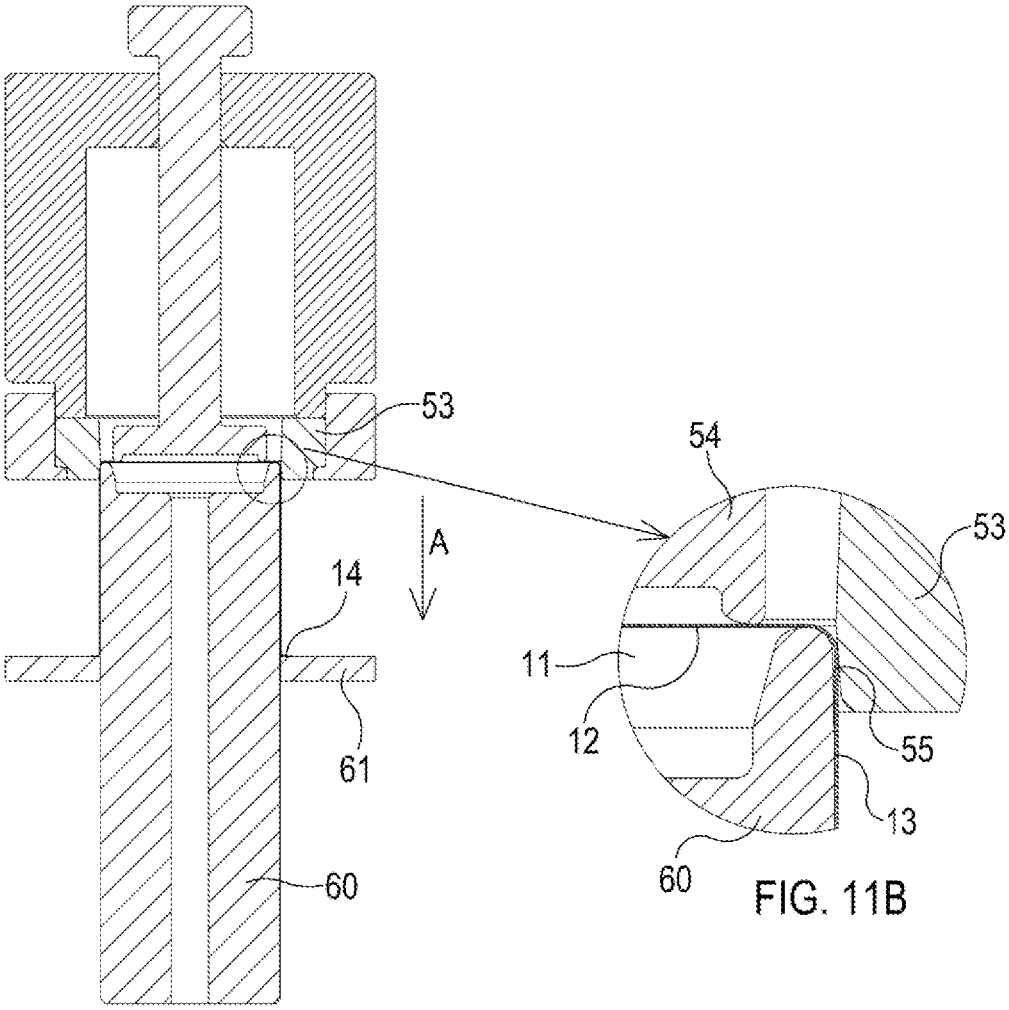
FIG. 11A shows a cross sectional view of the tooling apparatus of FIG. 9A moved further to a position to start wall-ironing the cup.
FIG. 11B shows a partial enlarged view of FIG. 11A.

Referring to FIGS. 11A and 11B, the upper tooling has been moved further downwards to a position beyond which wall-ironing will commence. The entry 55 of the wall-ironing die 53 is pushing against the body-wall 13 of the cup 11, and the base 12 of the cup 11 is now pushed against the wall-ironing punch 60. The base 12 of the cup 11 is also pushing against outer base-forming tool 54, which has caused the outer base forming tool to stop moving downwards with the other upper tools. The flange 14 of the cup 11 has pushed the plate 61 downwards.

Figures 12A, 12B, 12C:
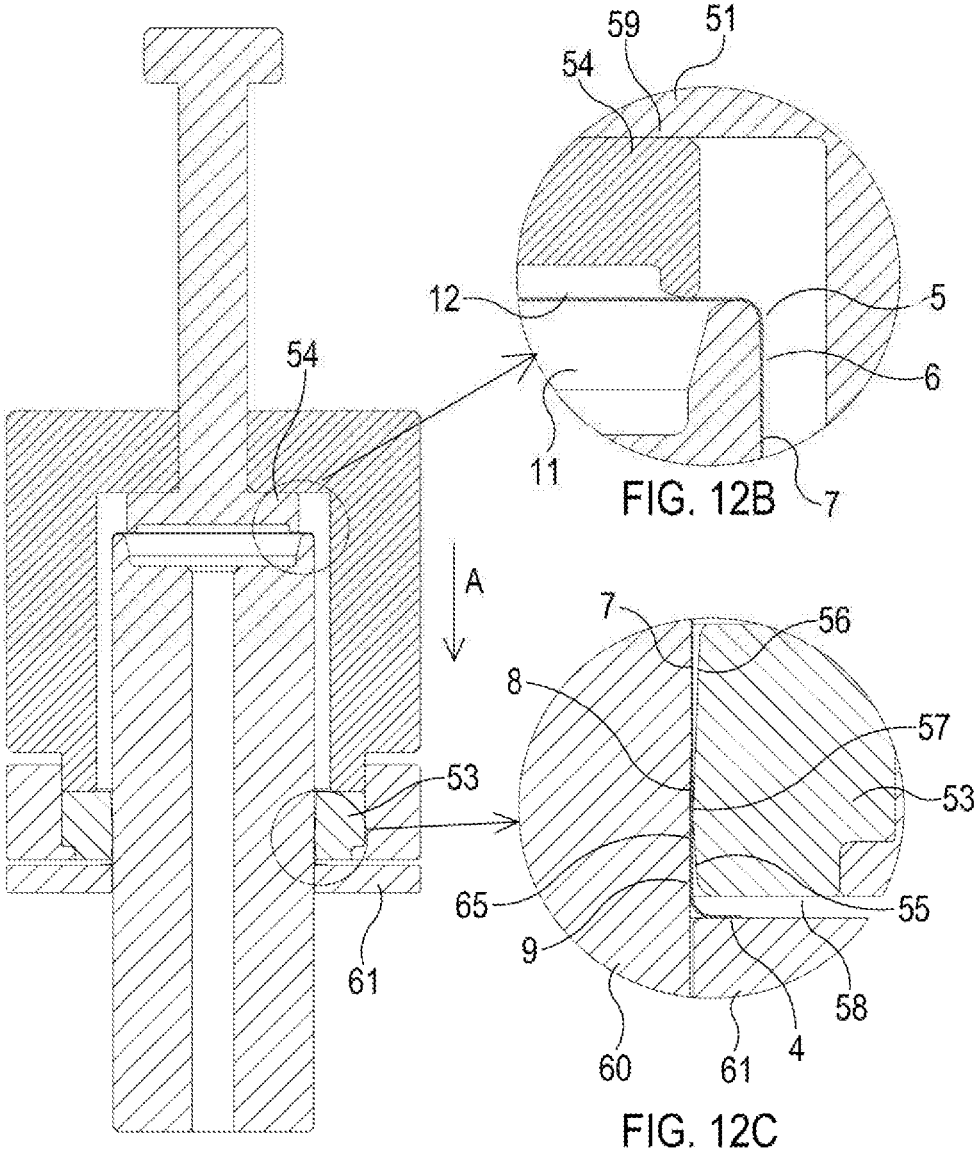
FIG. 12A shows a cross sectional view of the tooling apparatus of FIG. 9A moved further to a position to finish wall-ironing the cup.
FIG. 12B and FIG. 12C show partial enlarged views of FIG. 12A.

Referring to FIGS. 12A, 12B and 12C, the upper tooling has been moved downwards to an almost lowermost position, which has wall-ironed the body-wall. During wall-ironing, the entry 55 of the wall-ironing die 53 squeezes the body-wall against the wall-ironing punch 60, reducing its thickness and increasing its height. The land 57 of the wall-ironing die 53 is now adjacent to the smaller diameter 65 of the wall-ironing punch 60. With reference also to FIG. 1, region 9 of the can body-wall (which is adjacent to the flange 14 and which corresponds to the smaller diameter 65 of the wall-ironing punch 60) is not wall-ironed, region 7 has been wall-ironed, and region 8 has been partially wall-ironed. As discussed above, wall-ironing therefore stops short of the cut edge at the open end of the can body. This assists in preventing flakes or burrs of metal from the rough cut edge, or (in this example where the can body is formed from pre-coated metal) particles of coating from becoming detached.

As best shown in FIG. 12C, a small gap remains between the face 58 of the wall-ironing die 53 and the flange 4. The pusher 51 now contacts the outer base-forming tool 54 at face 59, so that any further downward movement will form a profile in the base 2 of the can body 1 that has been formed from the cup 11.

Figures 13A, 13B, 13C:
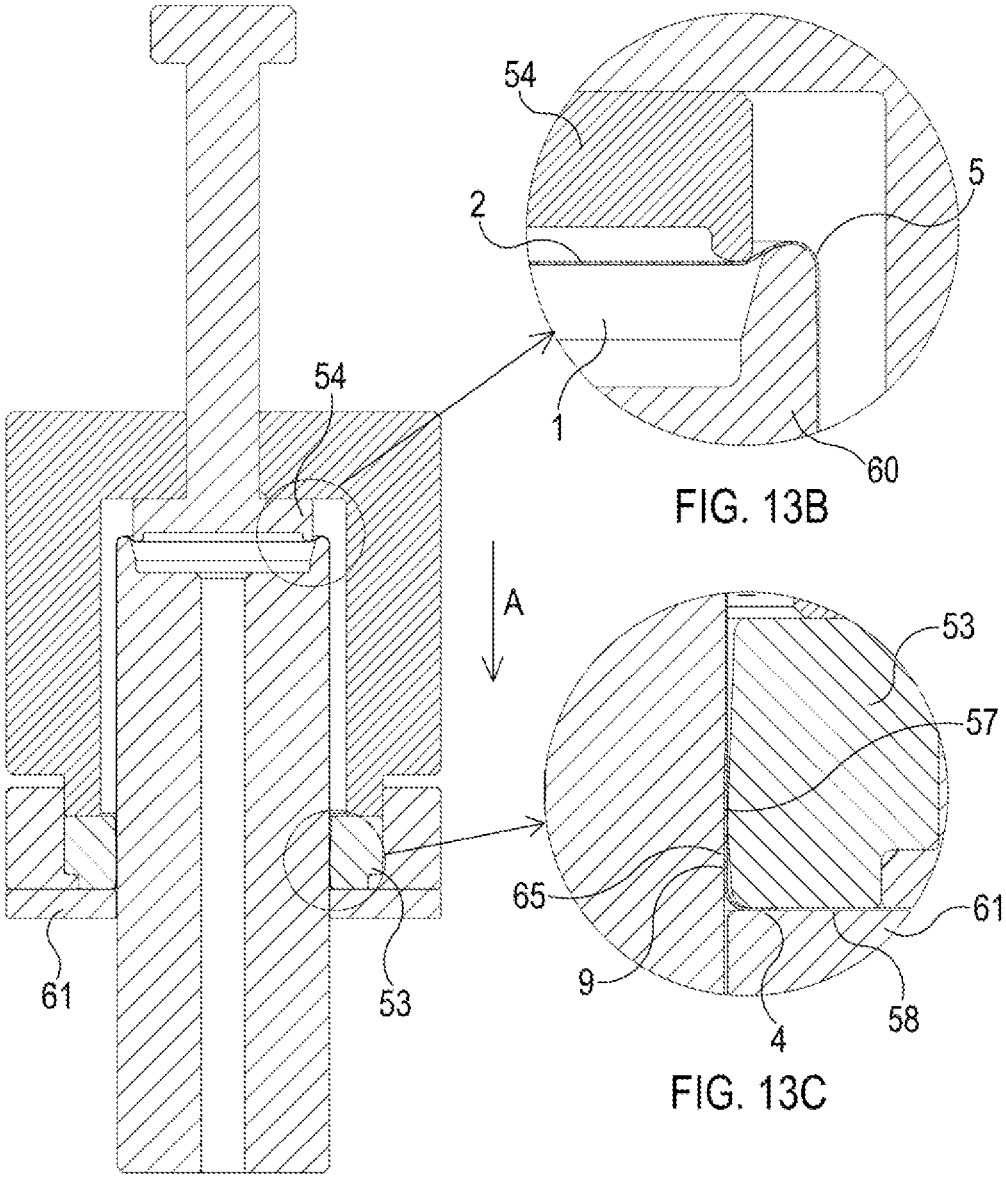
FIG. 13A shows a cross sectional view of the tooling apparatus of FIG. 9A moved further to a position to form the base of the cup.
FIG. 13B and FIG. 13C show partial enlarged views of FIG. 13A.

Referring to FIGS. 13A, 13B and 13C, the upper tooling has been moved further downwards in the direction of arrow A to a lowermost position. Region 5 of the body-wall 3 has been pulled partly around the end of the punch 60 by the outer base-forming tool 54 and the desired profile has been formed in the base 2 of the can body 1.

Region 9 of the body-wall 3 was free to move along the wall-ironing punch 60 because the gap between the land 57 of the wall-ironing die and the smaller diameter 65 of the wall-ironing punch 60 was more than the thickness of the cup body-wall 13. Therefore, in this example wherein a base profile is formed, region 9 of the body wall 3 remains substantially un-ironed. The position at which ironing stops may be between 1 mm and 20 mm from the open end of the formed can body. It will be noted that the gap between the face 58 of the wall-ironing die 53 and the flange 4 has closed. This maximizes the useable height of the resulting can, and any distortion of the flange 4 caused by contact with the die 53 may not be important if the flange 4 is ultimately to be trimmed off to create a flangeless can.

Figures 14A, 14B, 14C:
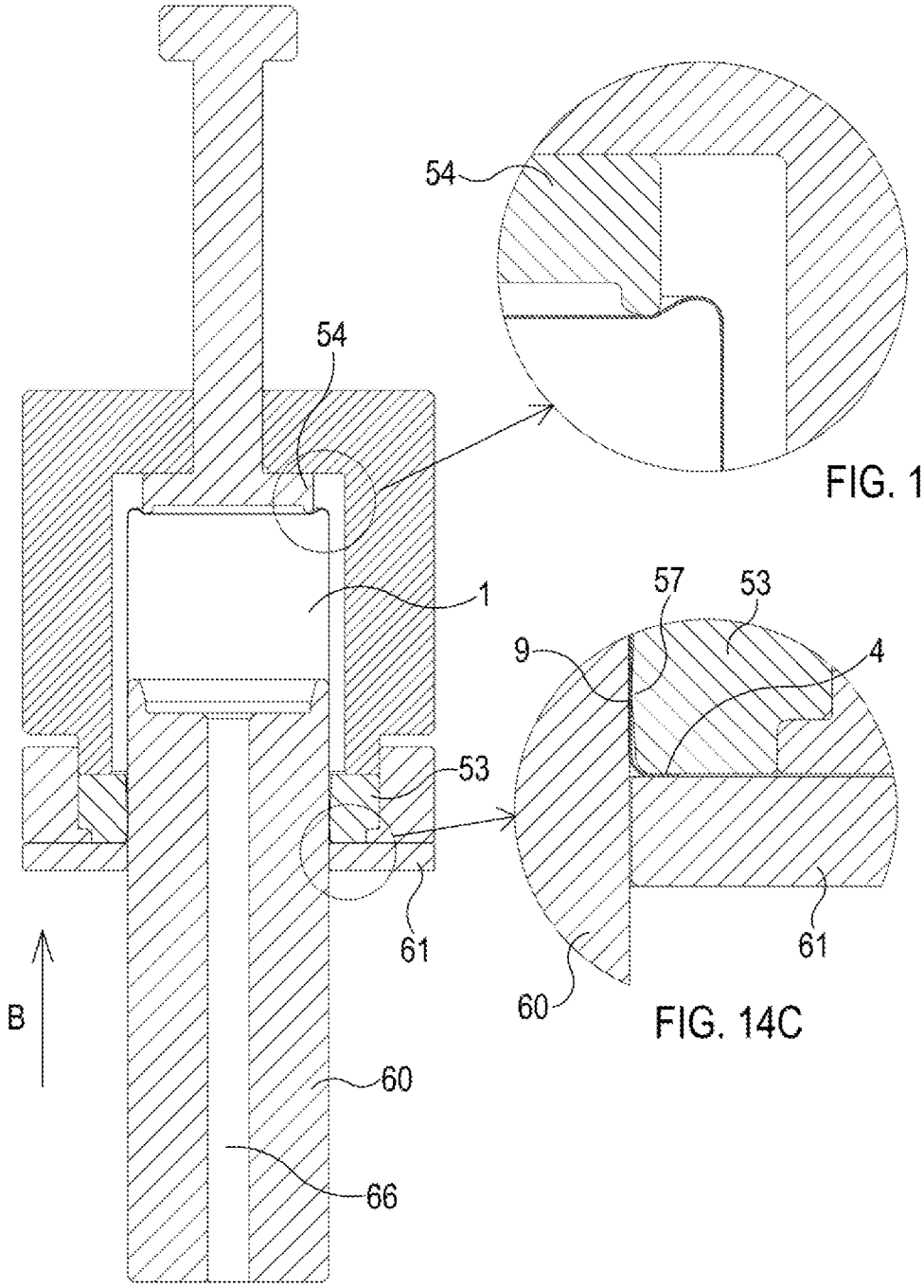
FIG. 14A shows a cross sectional view of the tooling apparatus of FIG. 9A moving back.
FIG. 14B and FIG. 14C show partial enlarged views of FIG. 14A.

Referring to FIGS. 14A, 14B and 14C, the upper tooling is being moved upwards in the direction of arrow B, and the wall-ironed can body 1 is being pushed off the punch 60 by the plate 61 pushing against the flange 4 as the upper tooling moves back up. The land 57 of the wall-ironing die 53 is also gripping region 9 of the can body wall 3.

Compressed air is also introduced into the can body 1 through channel 66 in the punch 60 to assist pushing the can body 1 off the wall-ironing punch 60 and to prevent the creation of any vacuum within the can body 1, which might cause it to collapse inwards.

Additionally or alternatively, tools positioned against the closed end of the can body may be moved together with the wall-ironing die 53 to control the movement of the can body, before it is pushed out from the die 53.

When this method is used, the inside surface of the can body adjacent to the die 53 may be abraded or damaged by the surface of the punch 60, and if this occurs it may be preferable to trim away that part of the can body and the flange using a conventional trimming machine. In this case it is preferable to move the die 53 further towards the open end of the can to contact the flange to maximize the useable height of the can body. Resulting distortion of the flange may not be important if the flange is to be trimmed off. Likewise, it is preferable for the flange to be as small as possible, and it is possible to adapt this method to form a can body that has no flange, provided that the die 53 does not pass the open end of the can body in contact with it.

Referring to FIGS. 15A, 15B and 15C, the upper tooling has returned to the position shown in FIG. 9, but with the wall-ironed can body 1 now in place. The can body 1 has been pushed fully off the punch 60 and its flange 4 is resting on the plate 61.

It will be appreciated that in the method illustrated by FIGS. 9 to 15, the can body 1 is not subject to "burnishing" as described with reference to FIGS. 2 to 8 above. The base profile is therefore formed on a downward movement of the upper tooling.

In an alternative example to that shown in FIGS. 9 to 15, the cup 11 may have little or no flange, and the plate 61 would therefore only contact the edge of the body-wall.

Such an alternative example may be followed if it is desired to create a can body without a flange (not shown).

The height of the can body 1 produced by either of the methods described above may vary due to variability of friction, anisotropy of the metal, temperature and other factors. It is therefore anticipated that further forming of the body 1 will be carried out to achieve the desired final can body height. This may be simply to draw the flange further into the wall as would be done in a conventional re-drawing operation, or it may be a combination or sequence of forming operations such as to expand the diameter of regions of the body wall, reduce the diameter of other regions of the body wall, form a base-profile in the closed end of the can, and trim and curl the flange.

There will now be described a range of methods of altering (i.e. increasing or reducing) the diameter of one or more regions of a can body. The methods may be used in combination to produce a can body that may be nest-able i.e. nested together with other can bodies that have been formed in the same way. The methods may be used with a wall-ironed can body produced from pre-coated sheet metal, as described above. Such a can body is more suitable for forming tapers or steps because it is less work-hardened towards its open end than a metal can body produced by a conventional wall-ironing process and because a flange may be left on the body to help avoid splitting and other defects.

Forming steps, as described below, is preferable to forming tapers. Firstly, less forming load is required. Secondly, the metal is subjected to less tensile strain. Thirdly, the can body wall is less likely to jam onto the tooling. Fourthly, the can bodies produced do not need to be provided with features to prevent them jamming together when nested. Tapered regions may be provided in addition to steps, if desired for aesthetic or other reasons, by adapting the tooling accordingly. Tapers may also be formed in a subsequent forming operation by stretching the stepped regions over a tapered tool.

Generally, the difference in diameter between all adjacent regions of the body wall should be kept to the minimum required to accommodate any local deviations in shape without risk of cans jamming together. In other words, it is preferred that the steps are small, so as to allow many steps to be produced for a given overall range of body diameter, and thus enable as many cans as possible to be nested within a given space without jamming together.

It is preferred that the length of each region of a can body wall of a given diameter is approximately equal to all the others. This enables the maximum number of can bodies to be nested together within a space. The can bodies will contact at the maximum number of transitions to share any axial loading that may occur in storage or transport. However, it is further preferred that the length of the uppermost regions is adjusted to just avoid contact between the uppermost transition and the flange radius of adjacent can bodies, and to avoid contact between the lowermost transition and the can body wall at the base. This is to avoid risk of can bodies jamming together at these features which have different stiffness to that of the body wall and which may be more prone to denting or distortion.

FIGS. 16 to 20 illustrate a two-part tooling apparatus used in a first method of increasing the diameter of one or more regions of a can body to form steps. The method comprises clamping the can body flange between a first annular tool (in this example, a die) positioned around the can body and a second tool (in this example, a clamping ring) on the opposite side of the flange; and pulling the can body over a punch having a number of portions of differing diameter. The number of portions is greater than two, and may be greater than three. One portion of the punch is of a diameter corresponding to guide the inside diameter of the can body.

FIGS. 16A to 16E illustrate an example of the tooling apparatus, which is used to shape the body-wall, form the base and adjust the height of a cylindrical flanged can body. The tooling comprises a set of upper and lower tools, and a flanged can body 71 is shown in position. The flanged can body 71 comprises a base 72, a body-wall 73 and a flange 74. The body wall 73 may vary in thickness, as shown in FIG. 1. The base 72 may be partially-formed as shown in this example, or it may be flat. The flange 74 is connected to the body-wall 73 by a curved region 75.

The upper tooling includes a first die 81, a second die 82 and a third die 83 which are all held in a holder 84, and an outer base-forming tool 85. The inside diameter of the first die 81 provides a small guiding clearance over the outside diameter of the body-wall 73. The diameter of the second die 82 is larger than the diameter of the first die 81 by at least twice the thickness of the body-wall, and the diameter of the third die 83 is larger than the diameter of the second die 82 by at least twice the thickness of the body-wall. Each of the dies 81, 82, 83 is provided with curved surfaces 86, 87, 88 respectively. Each of the dies 81, 82, 83 are provided with a radius and internal diameter corresponding to the radius and external diameter desired to be formed on the can body and are positioned axially to control the shape of the steps formed on the can body between each portion of a given diameter. The outer base-forming tool 85 is provided with a profile corresponding with that to be formed on the can base 72.

The lower tooling includes a shaping punch 90, a clamping ring 91 and an inner base-forming tool 92. The inner base-forming tool 92 is provided with a profile corresponding with that to be formed on the can base 72. The clamping ring 91 provides an upward clamping force when pushed downwards from its original position.

The shaping punch 90 has a portion 93 which has a diameter that provides a small clearance within the inside diameter of the body-wall 73, a portion 94 which has a diameter that is larger than the diameter of the portion 93 by at least twice the thickness of the body-wall 73, and a portion 95 which has a diameter that is larger than the diameter of the portion 94 by at least twice the thickness of the body-wall 73. Portions 93 and 94 are joined by a curved surface 96, and portions 94 and 95 are joined by a curved surface 97. The transition between each region of increased diameter of the punch 90 is preferably blended smoothly with radii. It is preferred for the radii to be kept small so that the angle formed between each region of the can wall is at least 10 degrees, and preferably greater than 15 degrees. This is to avoid cans becoming wedged tightly together when nested. It is also preferable for the radius blended with the larger of the punch 90 diameters at each transition to be small enough to direct the can body wall slightly away from the surface of the punch 90 to avoid the can becoming a tight fit onto the punch 90.

Figures 17A, 17B, 17C:
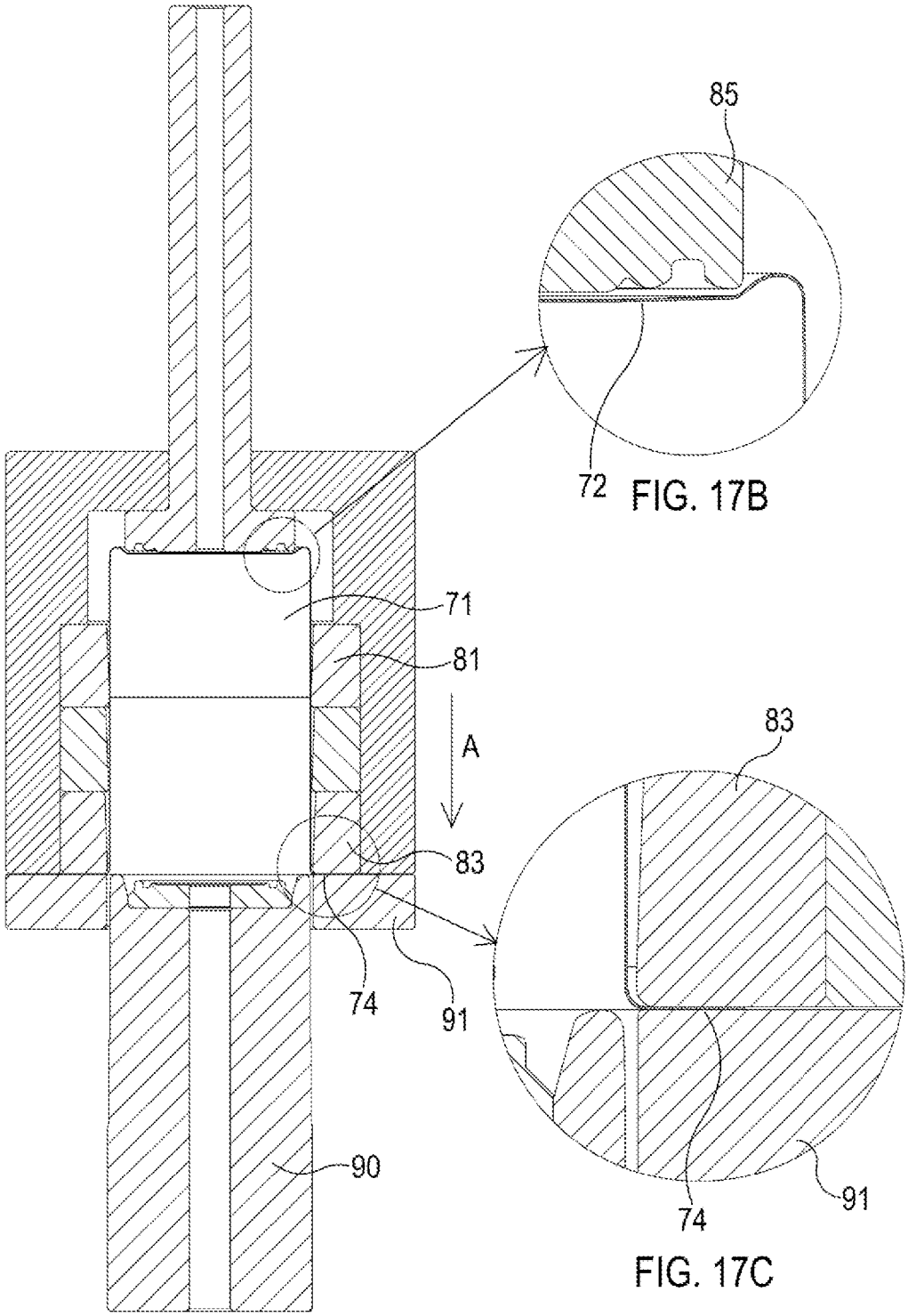
FIG. 17A shows a cross sectional view of the tooling apparatus of FIG. 16A moved to a position to clamp the flange of the can body.
FIG. 17B and FIG. 17C show partial enlarged views of FIG. 17A.

Referring to FIGS. 17A, 17B and 17C, the upper tooling has been moved downwards in the direction of arrow A to a position wherein the flange 74 has been clamped between the third die 83 and the clamping ring 91. The outer base-forming tool 85 is now close to the base 72 of the can body. The can body 71 is held centrally within the tooling by the first guiding die 81.

Figures 18A, 18B, 18C:
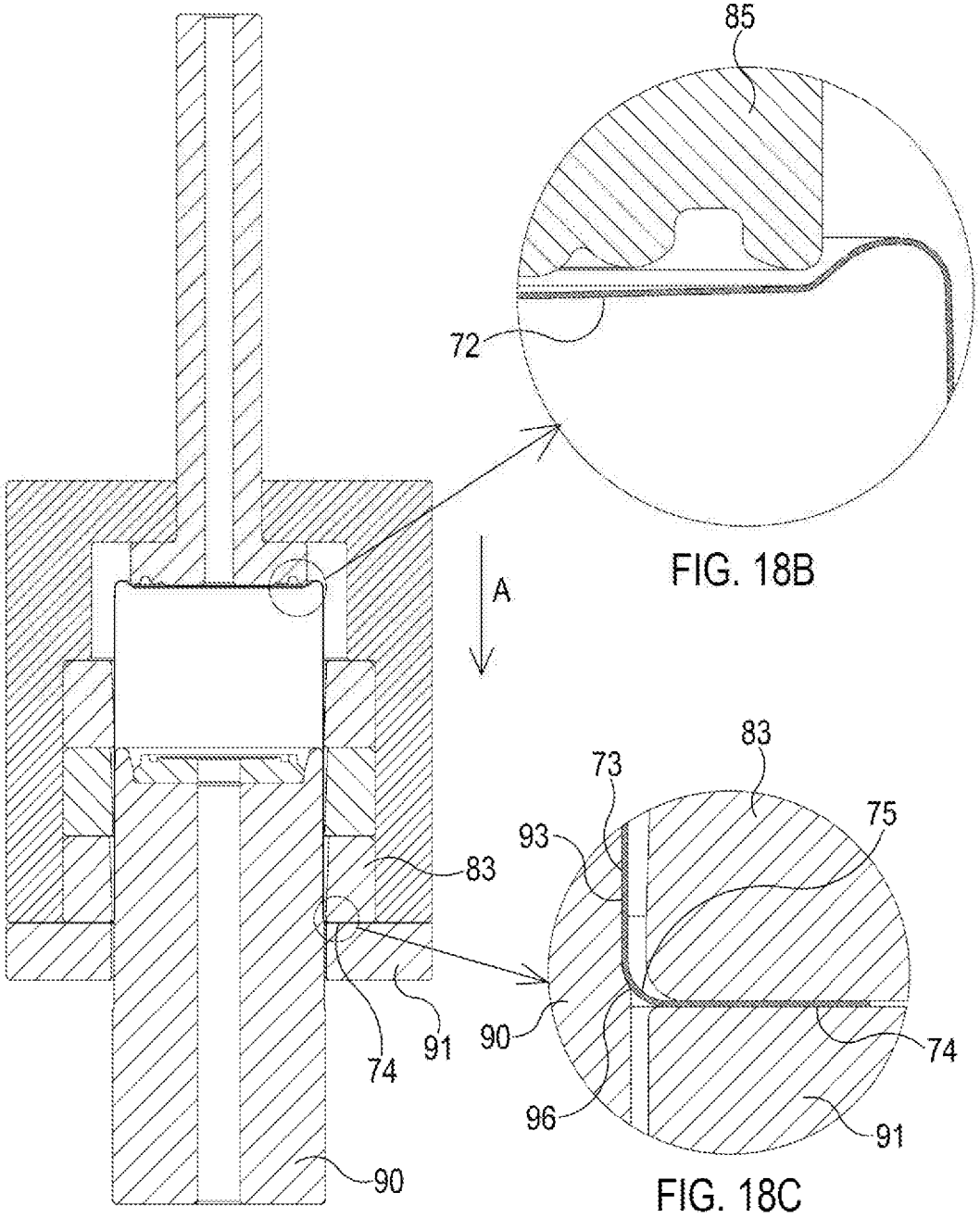
FIG. 18A shows a cross sectional view of the tooling apparatus of FIG. 16A moved to a position to start shaping the wall of the can body.
FIG. 18B and FIG. 18C show partial enlarged views of FIG. 18A.

Referring to FIGS. 18A, 18B and 18C, the upper tooling has been moved further downwards to a position wherein the clamping ring 91 has been pushed downwards together with the can body 71 by the third die 83. The body-wall 73 has been guided centrally over the portion 93 of the shaping punch 90, and the curved region 75 is now in contact with curved surface 96 of the shaping punch 90, such that any further downward movement of the upper tooling will start to expand the body-wall 73.

Figures 19A, 19B, 19C:
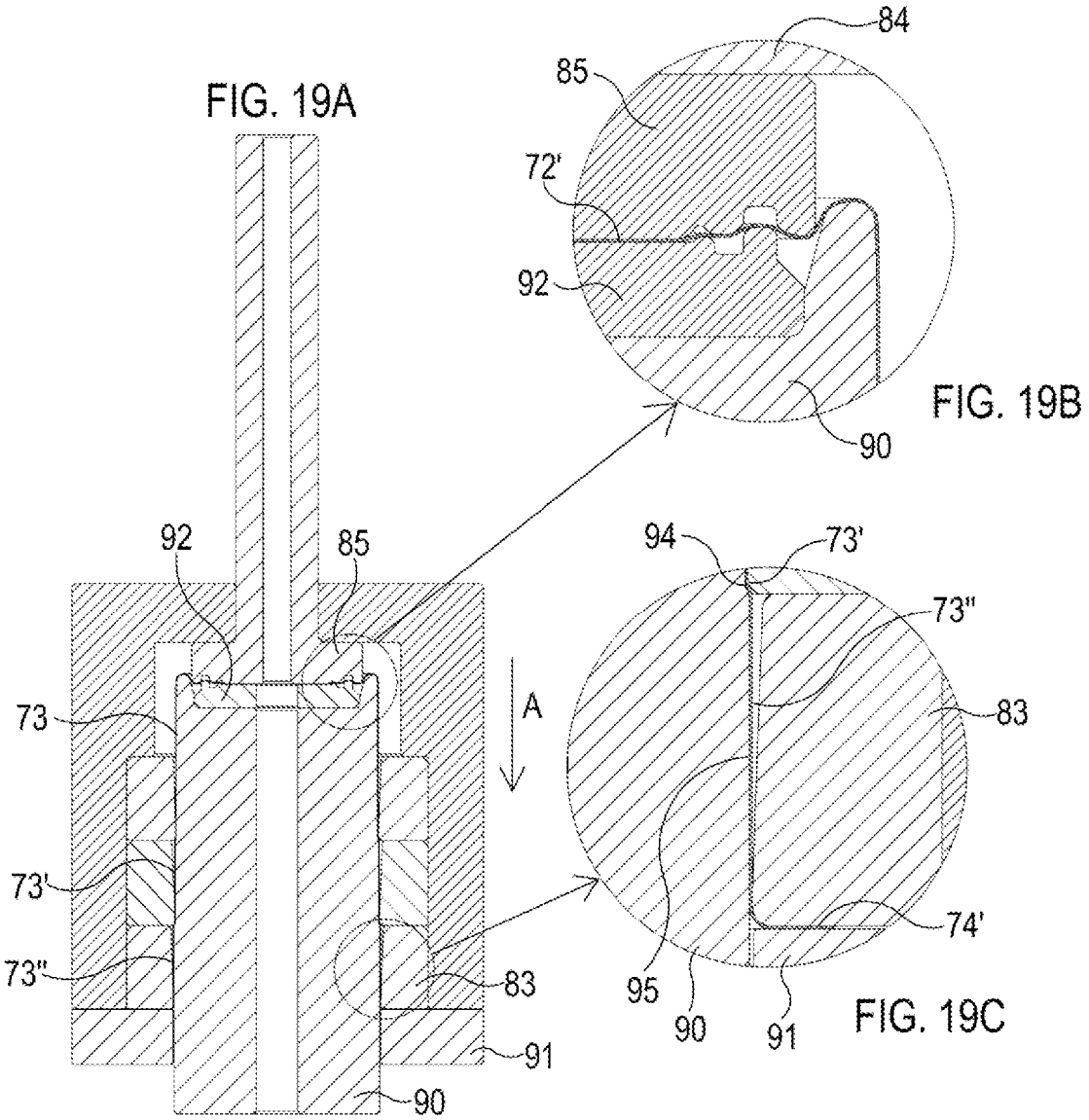
FIG. 19A shows a cross sectional view of the tooling apparatus of FIG. 16A moved to a position to finish shaping the wall and the base and the height of the can body.
FIG. 19B and FIG. 19C show partial enlarged views of FIG. 19A.

Referring to FIGS. 19A, 19B and 19C, the upper tooling has been moved downwards in the direction of arrow A to a lowermost position, wherein the body-wall has been shaped, the base has been formed and the height of the body has been adjusted by a combination of stretching and drawing the flange radially inwards by a small amount. Drawing the flange into the body wall in this way increases the height of the can body. The resulting shape of the can body 71' is best seen with reference to FIG. 20.

Figures 20A, 20B, 20C, 20D, 20E:
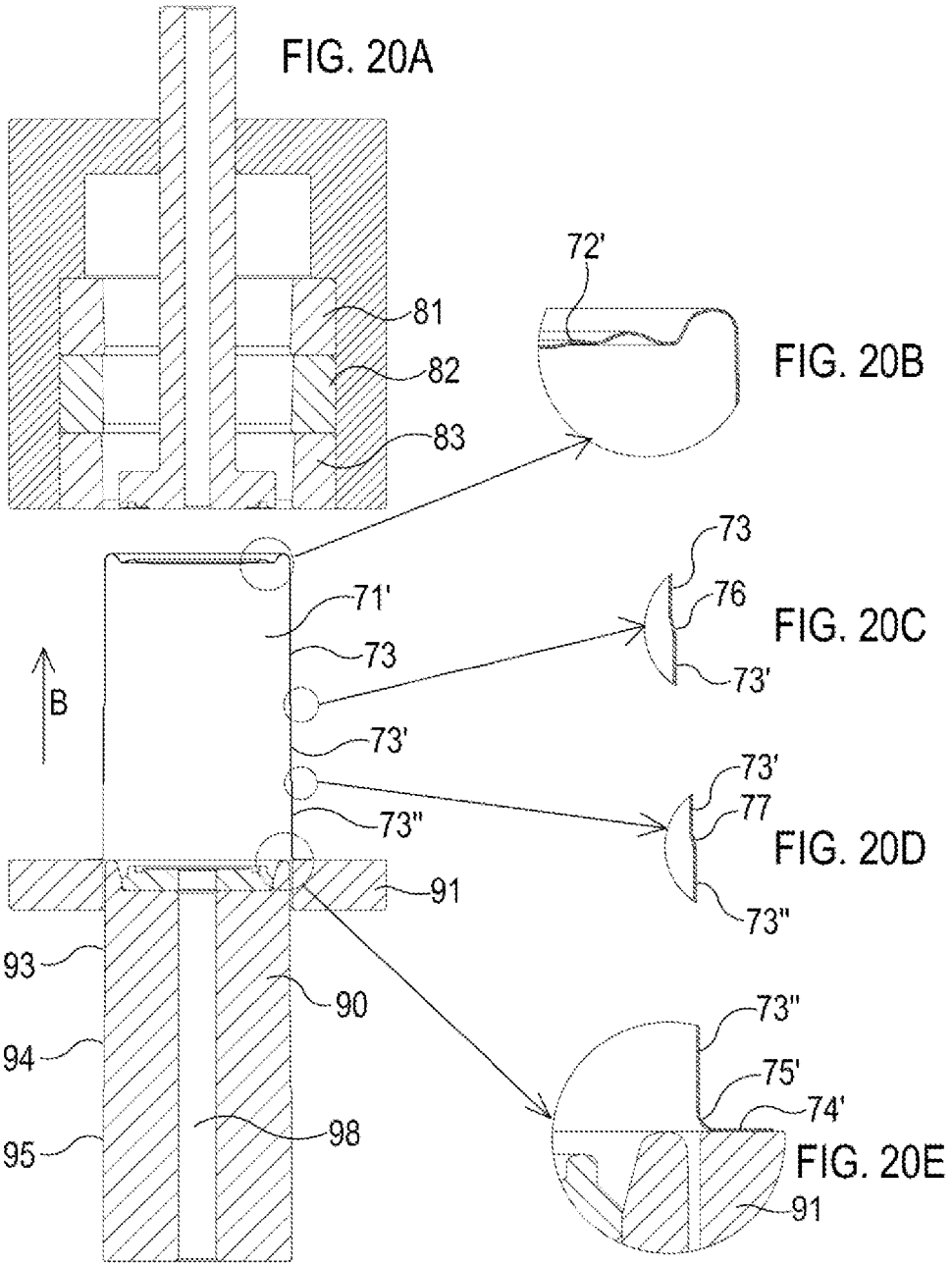
FIG. 20A shows a cross sectional view of the tooling apparatus of FIG. 16A moved back to its original position with a shaped can body in place.
FIG. 20B, FIG. 20C, FIG. 20D and FIG. 20E show partial enlarged views of FIG. 20A.

As shown in FIGS. 19B and 20B, formation of the base 72' is controlled by the shapes of the outer base-forming tool 85 and the inner base-forming tool 92, and by contact between the holder 84 and outer base-forming tool 85, and also in this example by indirect contact between the outer base forming tool 85 and the inner base-forming tool 92 through the thickness of the base 72'. Formation of the base 72' may draw some material radially inwards from the body-wall around the end of the punch 90.

As shown in FIG. 19C, formation of the shape of the body-wall is controlled mainly by the profile of the shaping punch 90, and the diameters of the body-wall regions 73' and 73" are expanded by the portions 94 and 95 respectively of the shaping punch 90. As the tooling moves from the position shown in FIG. 18A to that in FIG. 19A, the diameter of region 73" is firstly expanded by portion 94 and is secondly expanded further by portion 95 of the shaping punch 90. Portion 93 of the shaping punch provides guidance only and does not change the diameter of the adjacent body-wall 73, which is located towards the closed end of the can body.

As best shown in FIG. 20C, the shape and position of the step 76 between the resulting body-wall regions 73 and 73' is controlled by the curved surface 96 of the shaping punch 90, the curved surface 86 of the first die 81 and the position of these curved surfaces.

As best shown in FIG. 20D, the shape and position of the step 77 between the resulting regions 73' and 73" is controlled by the curved surface 97 of the shaping punch 90, the curved surface 87 of the second die 82 and the position of these curved surfaces.

As shown in FIG. 20E, the shape of the resulting curved region 75' connecting the flange 74' to the body-wall region 73" is controlled by the curved surface 88 of the third die 83. This curved surface is typically a radius corresponding to that required on the finished container.

The height of the resulting can body 71' is controlled by the position of the third die 83 relative to the shaping punch 90. Some of the material of the can body may be stretched to form the shaped can body 71', and some of the flange 74 may be drawn radially inwards to leave a smaller flange 74'. Any wrinkling of the flange during drawing is suppressed by the clamping force applied by the clamping ring 91.

Figure 16A:
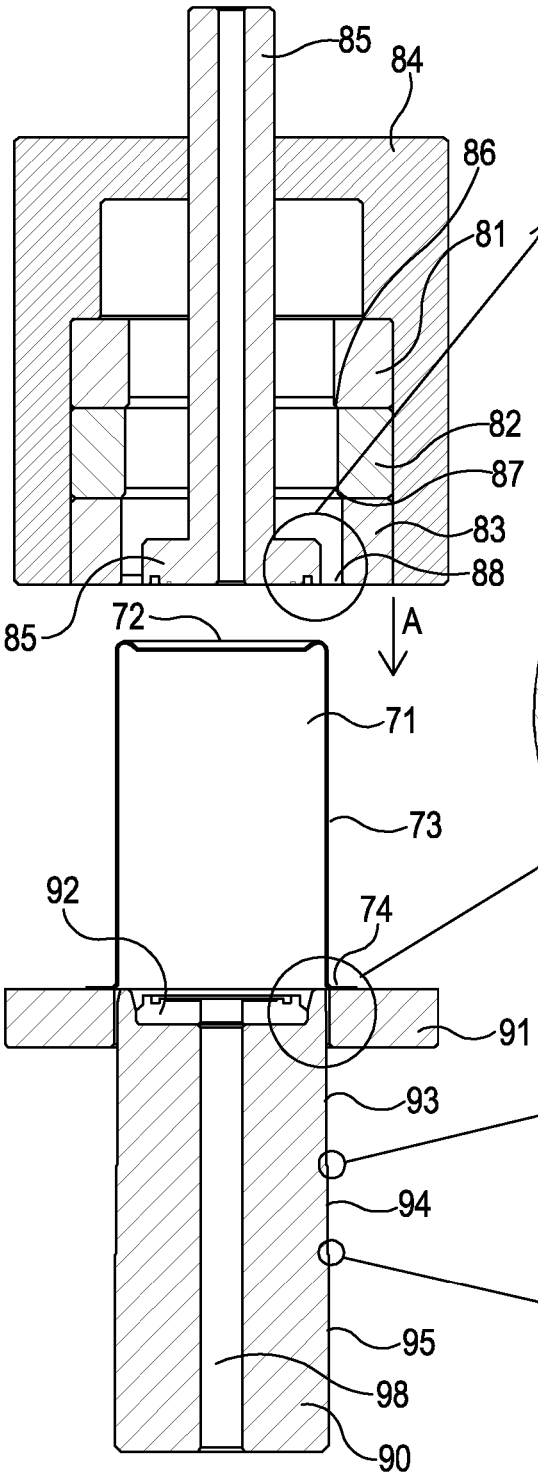
FIG. 16A shows a cross-sectional view of a tooling apparatus to shape a flanged can body, in an open position with a can body in place.
Figure 16B:
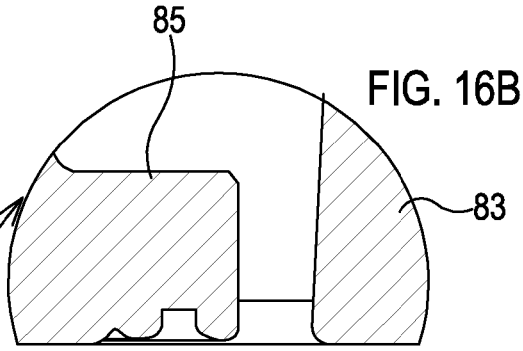
FIG. 16B, FIG. 16C, FIG. 16D and FIG. 16E show partial enlarged views of FIG. 16A.
Figure 16C:
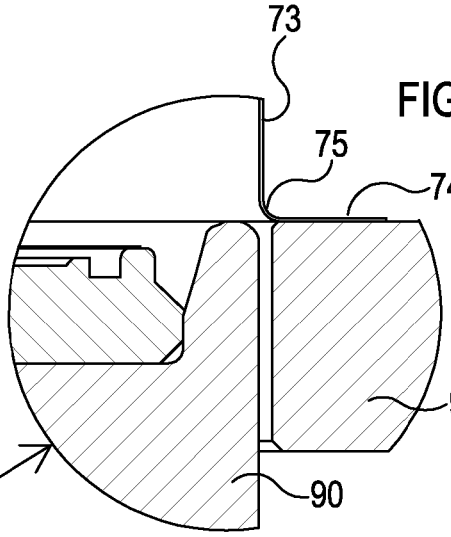
Figure 16D:
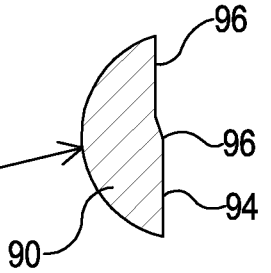
Figure 16E:
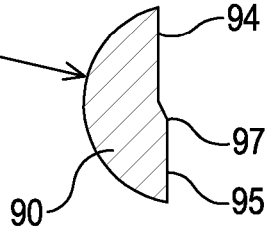

Referring to FIG. 20A, the upper tooling has been moved in the direction of arrow B to the same position as shown in FIG. 16A, but with the shaped can body 71' now in place. The shaped can body 71' has been pushed fully off the shaping punch 90 by the clamping ring 91 and its flange 74' is resting on the clamping ring 91. The positioning of the outer base-forming tool 85 prevents the can body 71' from remaining within the upper tooling. Compressed air is introduced into the can body 71' through channel 98 in the shaping punch 90 to assist pushing the can body 71' off the shaping punch 90 and to prevent the creation of any vacuum within the can body.

The shaped can body 71' produced by the method illustrated in FIGS. 16 to 20 above may be nested together with other can bodies formed by the same method.

A known method of trimming the flange 74' of shaped can body 71' will now be described with reference to FIGS. 21 to 24.

Figures 21A, 21B:
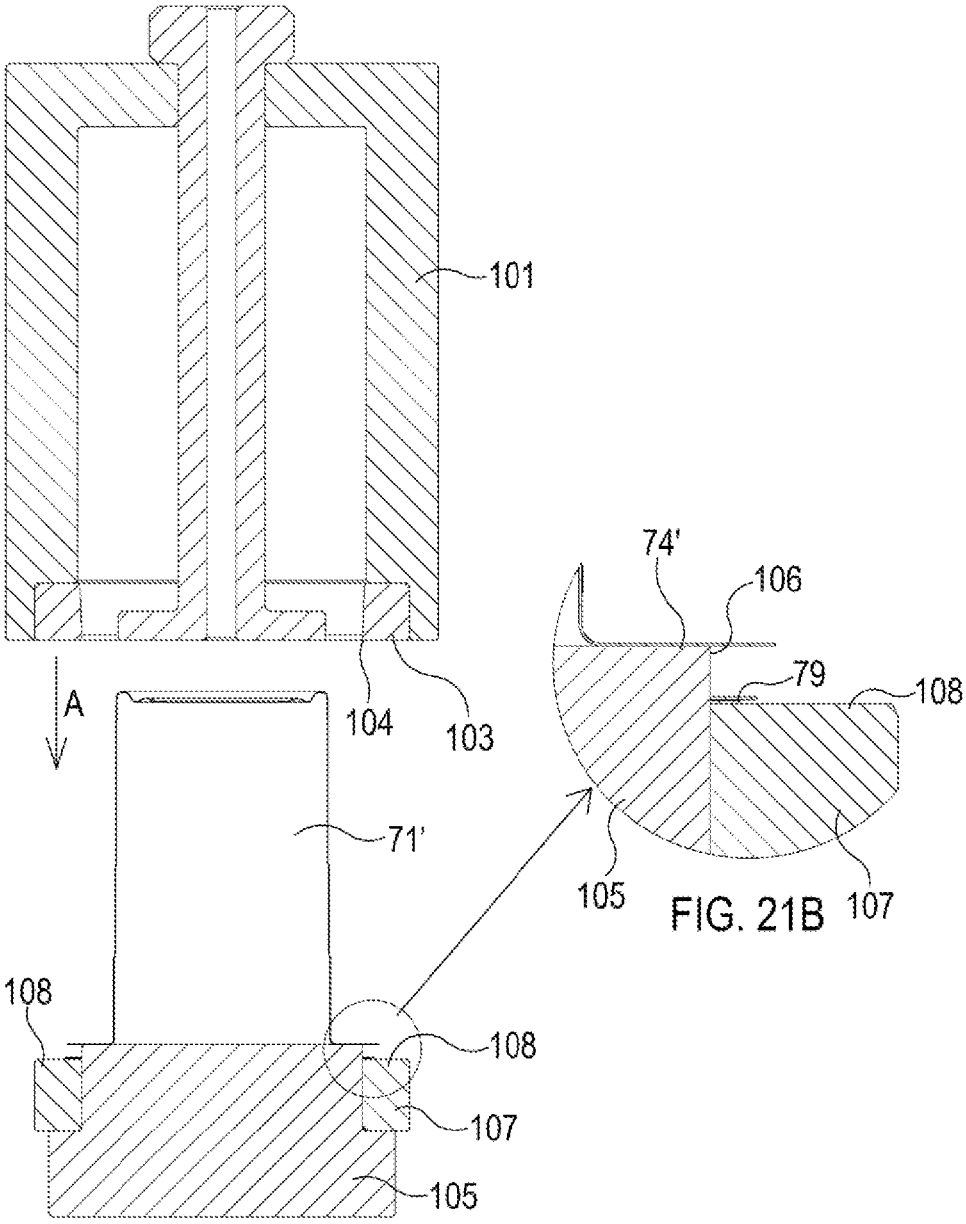
FIG. 21A shows a cross-sectional view of a prior-art tooling apparatus to trim the flange of a can body, in an open position with a can body and previously trimmed scrap portions in place.
FIG. 21B shows a partial enlarged view of FIG. 21A.

FIGS. 21A and 21B illustrate an example of a prior-art tooling apparatus used to trim the flange of a can body, and break the scrap piece into two parts for easy removal. This is described here to show how the step of trimming the flange may be incorporated into the manufacture of a finished can body. The tooling comprises a set of upper and lower tools, and a flanged can body 71' is shown in position. In this example, the can body 71' is equivalent to that shown in FIGS. 20A to 20E.

The upper tooling includes a holder 101, a pad 102, and a cutting die 103 having a sharp circular edge 104. The upper tooling may also include parts to centralise and clamp the can body in position.

The lower tooling includes a cutting punch 105 having a sharp circular edge 106 and a scrap-breaking ring 107 having a pair of sharp edges 108. Also shown on the lower tooling of FIG. 21A is a number of trimmed scrap pieces 79 from previous operations of the tool, that are resting on top of the edges 108 of the scrap-breaking ring 107.

Figures 22A, 22B:
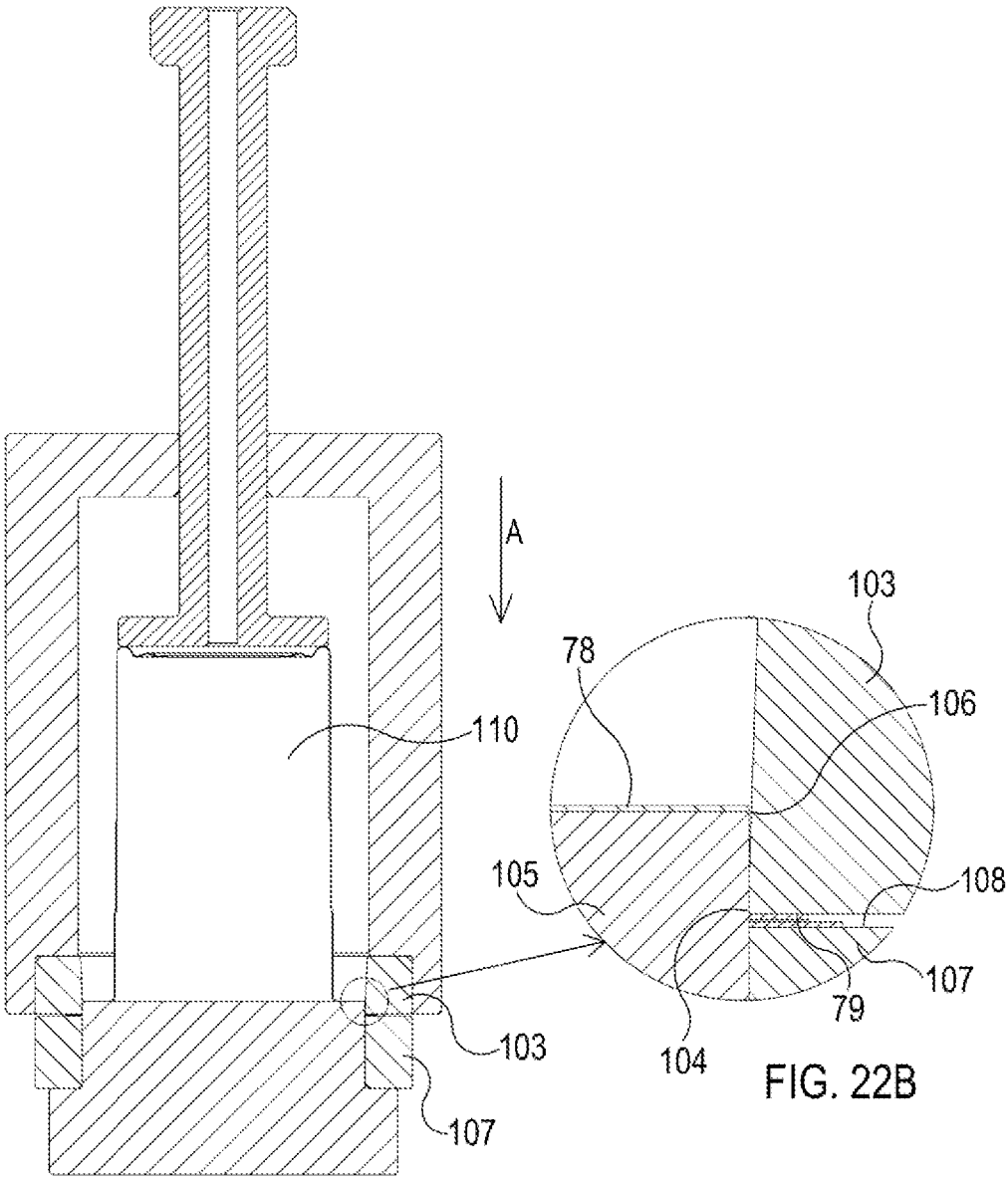
FIG. 22A shows a cross sectional view of the tooling apparatus of FIG. 21A moved to a position to trim the flange of the can body.
FIG. 22B shows a partial enlarged view of FIG. 22A.
Figures 24A, 24B:
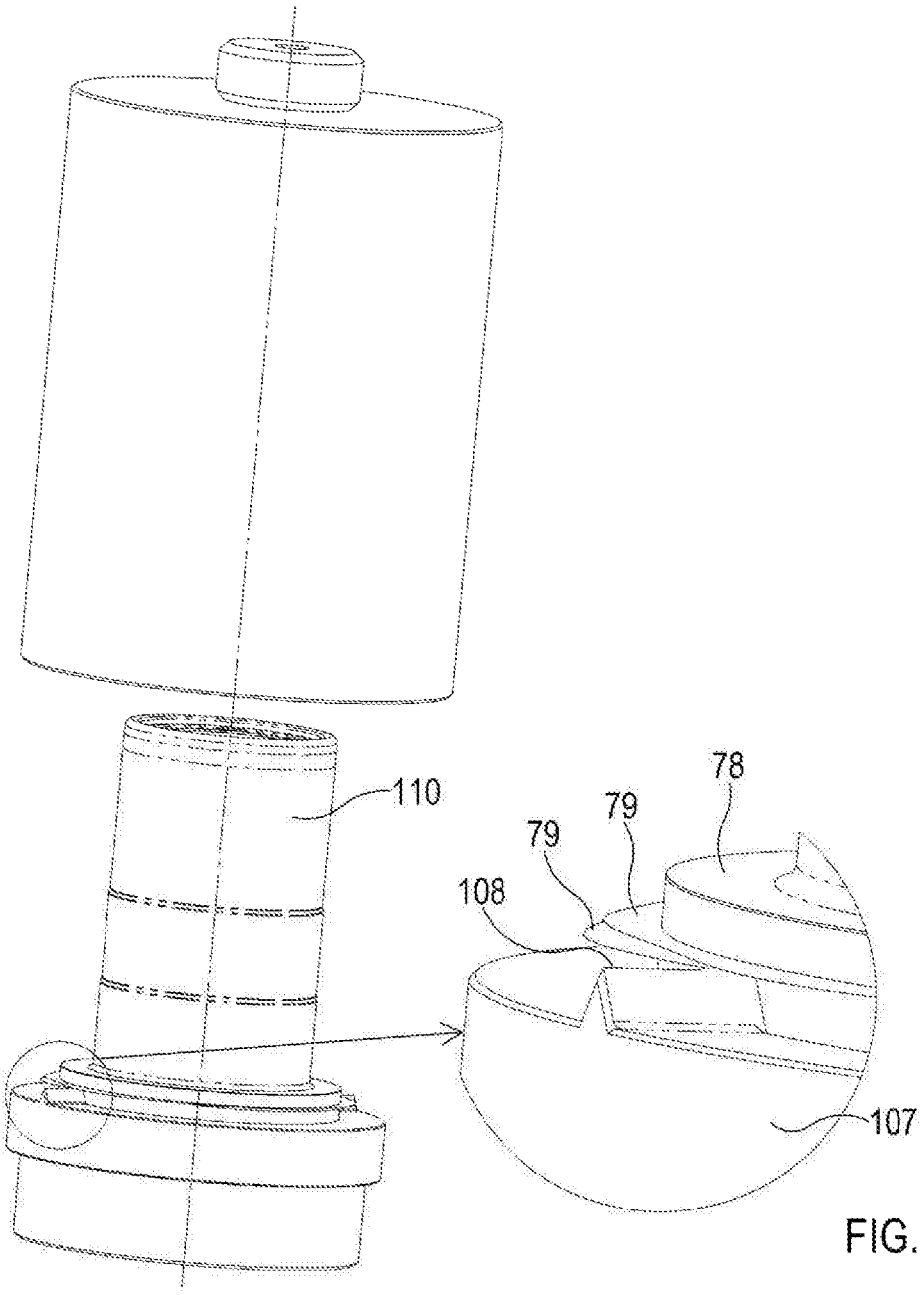
FIG. 24A shows a perspective view of the tooling apparatus of FIG. 23A.
FIG. 24B shows a partial enlarged view of FIG. 24A.

Referring to FIGS. 22A and 22B, the upper tooling has been moved to a lowermost position in the direction of arrow A, so that the circular cutting edges 104 and 106 of the cutting die 103 and the cutting punch 105 respectively have passed one-another to shear the flange 74' to create a trimmed flanged can body 110 from shaped can body 71', the created can body 110 having a trimmed flange 78 and a fresh scrap piece 79. This fresh scrap piece has been pushed down onto the existing scrap pieces 79 to force the lowermost scrap piece against the edge 108 of the scrap-breaking ring 107, so that this lowermost scrap piece is broken into two parts and falls away (not shown). Breaking the scrap piece allows it to be more easily removed from the tooling.

Referring to FIGS. 23A, 23B and 24A, 24B, the tooling has been moved back to its original position to allow the trimmed can body to be easily removed. The pad 102 has prevented the can body 110 from being lifted within the upper tooling.

The above known method of trimming the flange of a shaped can body, as illustrated in FIGS. 21 to 24, may be used as a separate manufacturing step in combination with any of the inventive methods described herein.

A second method of altering (decreasing) the diameter of one or more regions of a can body will now be described with reference to FIGS. 25 to 29. This method may be used to extend the number of diameters or the range of diameters formed without exceeding the overall expansion limit of the can wall. This method may be combined with the first method (as illustrated in FIGS. 16 to 20) or the third method (as illustrated in FIGS. 32 to 36 below) to both increase and reduce diameters of portions of the can body in one press operation. This method may be combined with a subsequent forming stage, such as for example curling the periphery of the trimmed flange of the can body 110.

In this second method, the diameter of a region of the body wall adjacent to the closed end of a flanged can is decreased. The can body wall is positioned co-axially with a punch having a number of portions of differing diameter, at least one portion of the punch being of a diameter corresponding to guide the inside diameter of the can body. An annular tool (forming sleeve 124) having a portion of reduced diameter is pushed axially over the closed end of the can body to form the body wall against the punch.

Figures 25A, 25B, 25C:
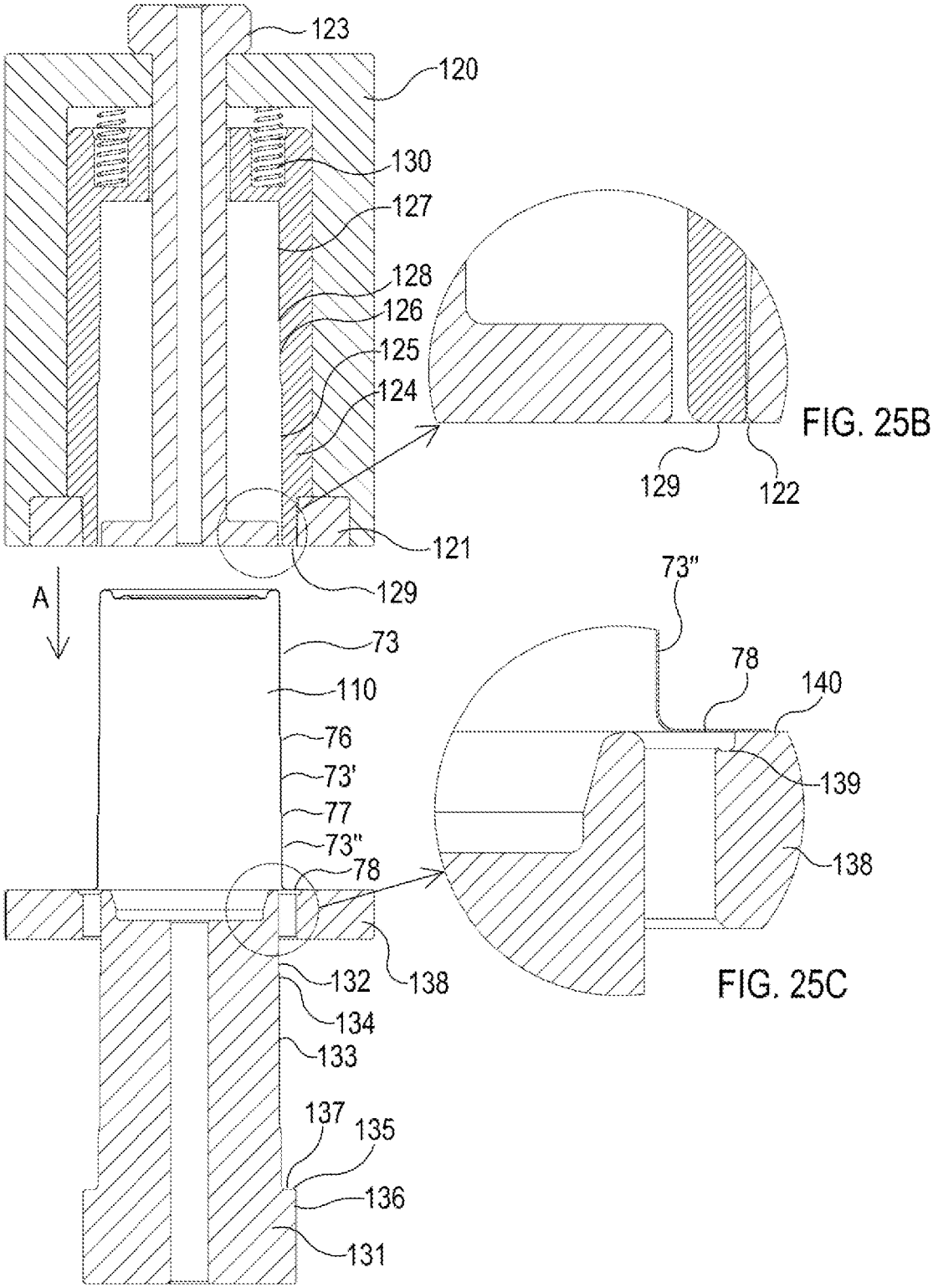
FIG. 25A shows a cross-sectional view of a tooling apparatus to shape the wall and curl the flange of a can body, in an open position with a can body in place.
FIG. 25B and FIG. 25C show partial enlarged views of FIG. 25A.
Figure 31A:
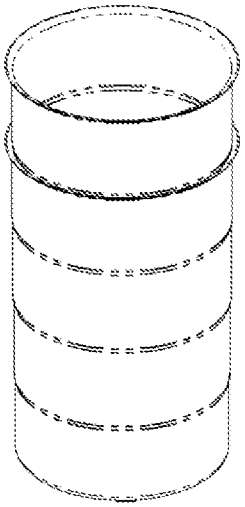
FIG. 31A shows a perspective view of two flanged and trimmed can bodies nested together.
Figure 31A:
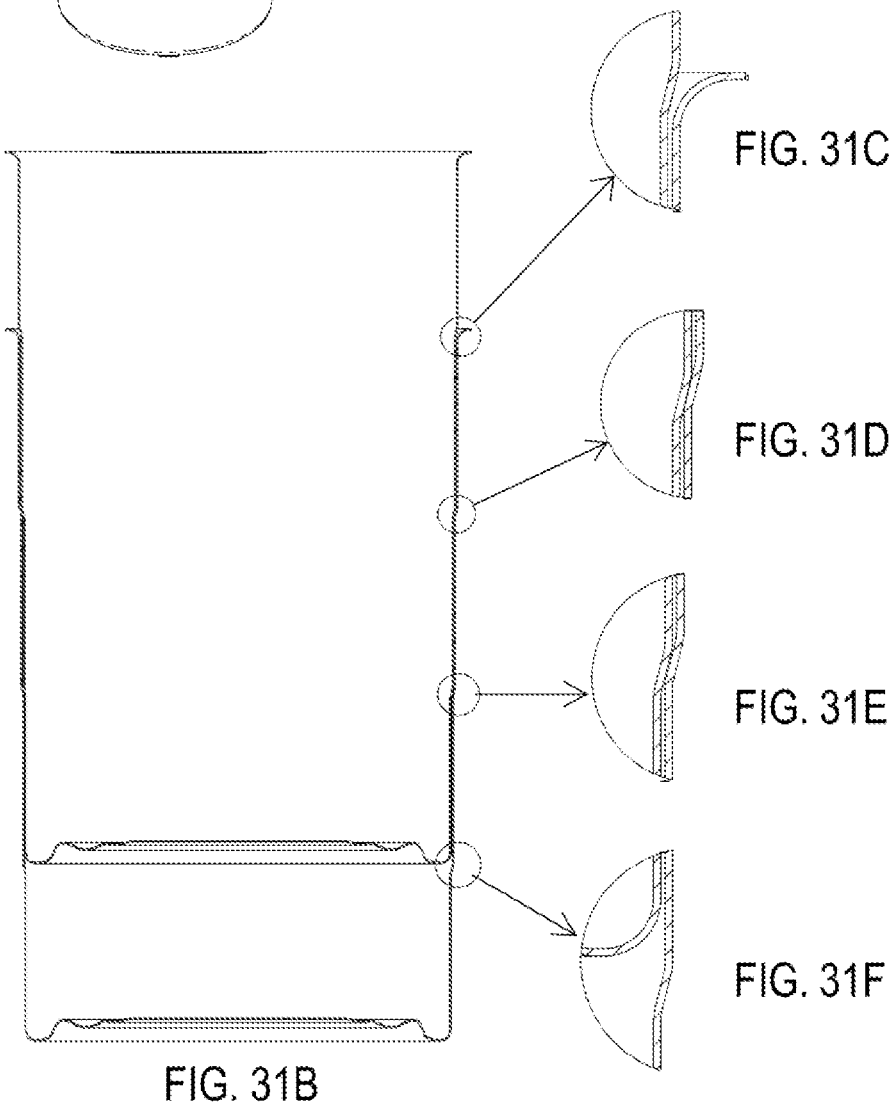

FIGS. 25A, 25B and 25C illustrate an example of a two-part tooling apparatus used to shape the body-wall and to form a curl at the edge of the flange of a cylindrical flanged can body. The tooling comprises a set of upper and lower tools, and a flanged can body is shown in position. In this example, the can body 110 is equivalent to that shown in FIGS. 23A and 23B.

The can body 110 in this example has a body-wall portion 73 which is joined to an expanded body-wall portion 73' by a curved portion 76, which in turn is joined to a further-expanded body-wall portion 73" by a curved portion 77. The can body also has a trimmed flange 78 connected to the body-wall portion 73".

The upper tooling includes a holder 120, a draw die 121 having a drawing radius 122, a pad 123, a forming sleeve 124 and a number of springs 130. The forming sleeve 124 has guiding portions 125, 126 and a forming portion 127. The guiding portion 126 is joined to the forming portion 127 by a curved surface 128. The diameter of the guiding portion 126 provides a small guiding clearance over the can body-wall portion 73. The diameter of the forming portion 127 is smaller than the diameter of the can body-wall portion 73. The forming sleeve also has a clamping face 129.

The transition between each region of the forming sleeve 124 is preferably blended smoothly with radii. It is preferred for the radii to be kept small so that the angle formed between each region of the can body wall is at least 10 degrees, and preferably greater than 15 degrees. This is to avoid cans becoming wedged tightly together when nested. It is also preferable for the radius blended with the smaller of the diameters to be small enough to direct the can body wall slightly away from the punch surface to avoid the can becoming a tight fit within the forming sleeve 124.

The lower tooling includes a forming punch 131 having a form portion 132, and a guide portion 133 joined by a curved portion 134. The punch 131 also has a drawing profile 135 that is typically a radius, joining a clamping surface 137 to a cylindrical drawing portion 136. The lower tooling also includes a profiled pressure ring 138, having a clamping face 140 and a curling profile 139. The profiled pressure ring 138 is adapted to provide an upward force when it is pushed downwards from its original position.

Referring to FIGS. 26A, 26B and 26C, the upper tooling has been moved downwards in the direction of arrow A to a position wherein the radially inner part of the trimmed flange 78 is clamped between the clamping face 129 of the forming sleeve 124 and the clamping surface 137 of the forming punch 131, and the radially outer part of the trimmed flange 78 is clamped between the draw die 121 and the clamping face 140 of the profiled pressure ring 138. The forming sleeve has also reduced the diameter of part of the body-wall portion 73 to become a new portion 111 joined to the remaining body-wall portion 73 by a curved portion 112. The shape and position of the step 112 between the resulting body-wall regions 73 and 112 is controlled by the form portion 132 of the shaping punch 131, the curved surface 128 of the forming sleeve 124 and the position of these curved surfaces.

Referring to FIGS. 27A and 27B, the upper tooling has been moved further downwards in the direction of arrow A to a lowermost position. The draw die 121 has pushed the pressure ring 138 down, and has drawn the outermost region of the flange radially inwards and down the drawing portion 136 of the punch 131 to become a short cylindrical portion 136 having a small curved portion 114 at its edge. Formation of wrinkles has been supressed by the clamping force between the draw die 121 and the pressure ring 138 to the trimmed flange 78 as it has been drawn radially inwards.

Referring to FIGS. 28A and 28B, the upper tooling has been moved upwards slightly in the direction of arrow B to approximately the same position as in FIG. 26A. Since the flange is no longer positioned between the clamping faces of the draw die 121 and the pressure ring 138, the pressure ring 138 has moved back upwards in contact with the draw die 121. This movement of the pressure ring 138 has curled the curved portion 114 and the cylindrical portion 113 of the flange into a curl 115.

Referring to FIGS. 29A and 29B, the upper tooling has been moved back in the direction of arrow B to its original position and the shaped and curled can body 116, produced from trimmed flanged can body 110, is shown in position. The pad 123 has prevented the can body 116 from being lifted within the upper tooling.

FIGS. 30A to 30F illustrate two of the can bodies 116 of FIGS. 29A and 29B that have been shaped to nest within one-another. For each can body 116 nested within another, portion 111 is free to slide within portion 73, portion 73 is free to slide within portion 73' and portion 73' is free to slide within portion 73". When stacked together, the can bodies 116 in this example contact at two contact positions 117 and 118. The curled flanges 115 shown in FIG. 30C are typical of those adapted to heat-sealing of flexible lidding material onto the flange where the surface has been pre-coated with a suitable polymer such as polypropylene.

FIGS. 31A to 31F illustrates two flanged cans that have been shaped to nest within one another in substantially the same way as those in FIG. 30A. In this example, however, the flanges of the cans are not curled. Flanges may be useful in nested cans, which otherwise might be difficult to separate. The flanges shown are typical of those adapted to seaming on of ends.

FIGS. 32 to 36 illustrate a third method of altering (increasing) the diameter of one or more regions of a can body to produce a nest-able can body. The can body may be formed from pre-coated metal, as discussed above. The third method comprises positioning a can body co-axially with a punch having a number of portions of differing diameter, wherein one portion is of a diameter corresponding to guide the inside diameter of the can body; and pushing the can body over the punch by moving a pushing tool against the closed end of the can body. It is preferable that the number of portions of different diameter is greater than two, and further preferable that the number of portions of different diameter is greater than three.

FIGS. 32A, 32B and 32C illustrate an example of a two-part tooling apparatus used to shape the body-wall and form the base of a flanged can body 71. The tooling comprises a set of upper and lower tools, and a can body 71 is shown in position.

The flanged can body 71 comprises a base 72, a body-wall 73 and a flange 74. The body-wall 73 may have varying thickness, as shown in FIG. 1. The base may be partially-formed as shown in this example, or it may be flat. The flange 74 is connected to the body-wall 73 by a curved region 75.

The upper tooling includes a holder 150, a flange-control die 151, a shaping die 152 and an outer base-forming tool 153. The flange-control die 151 has a radius 154 and a face 155. The shaping die 152 has a radius 156, a portion 157 which has a diameter to provide a small clearance over the diameter of the can body-wall 73, a portion 159 which has a diameter that is smaller than the can body-wall diameter by at least twice the thickness of the can body-wall, and a curved portion 158 joining portions 157 and 159. The outer base-forming tool 153 in this example is adapted to provide a downwards force on the can base 72.

The lower tooling includes a shaping punch 170, a plate 171, and an inner base-forming tool 172.

The shaping punch 170 has a portion 175 which has a diameter to provide a small clearance within the diameter of the can body-wall 73, a portion 173 which has a diameter that is smaller than the can body-wall diameter by at least twice the thickness of the can body-wall, and a curved portion 174 joining portions 175 and 173. The shaping punch also has a portion 177 which has a diameter that is larger than the can body-wall diameter by at least twice the thickness of the can body-wall, and a curved portion 176 joining portions 175 and 177. The shaping punch 170 also has a portion 179 which has a diameter that is larger than that of portion 177 by at least twice the thickness of the can body-wall, and a curved portion 178 joining portions 177 and 179.

The transition between each region of increased diameter of the punch 170 is preferably blended smoothly with radii. Preferably, the radii are kept small so that the angle formed between each region of the body wall is at least 10 degrees, and preferably greater than 15 degrees. This avoids can bodies becoming wedged tightly together when nested. It is also preferable for the radius blended with the larger of the punch 170 diameters at each transition to be small enough to direct the body wall slightly away from the punch 170 surface to avoid the can becoming a tight fit onto the punch 170.

The plate 171 is pushed upwards to the position in which it is shown by a device such as an air piston or springs, which are not illustrated.

Figures 33A, 33B, 33C:
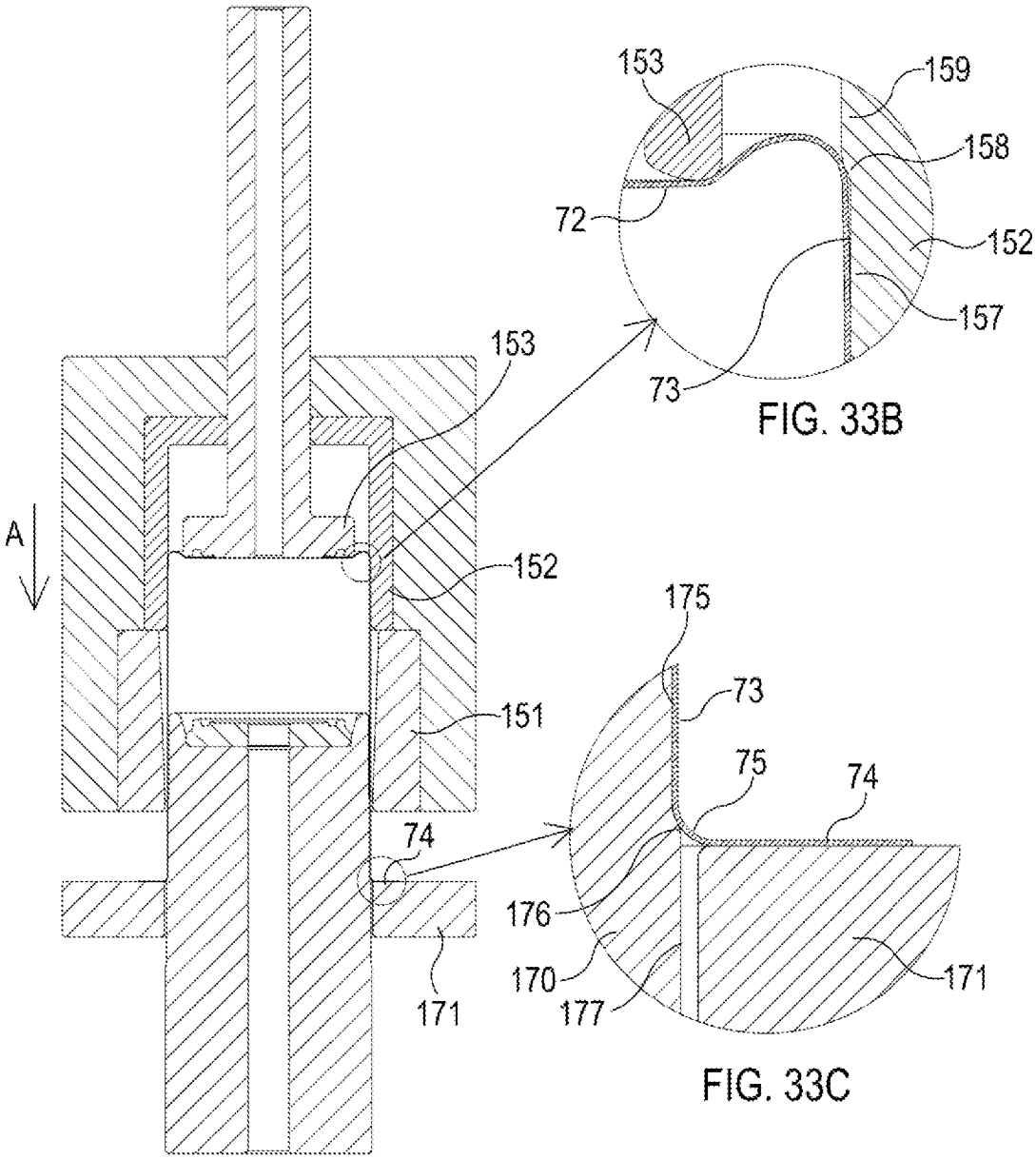
FIG. 33A shows a cross sectional view of the tooling apparatus of FIG. 32A moved to a position to start shaping the can body.
FIG. 33B and FIG. 33C show partial enlarged views of FIG. 33A.
Figures 34A, 34B, 34C, 34D, 34E:
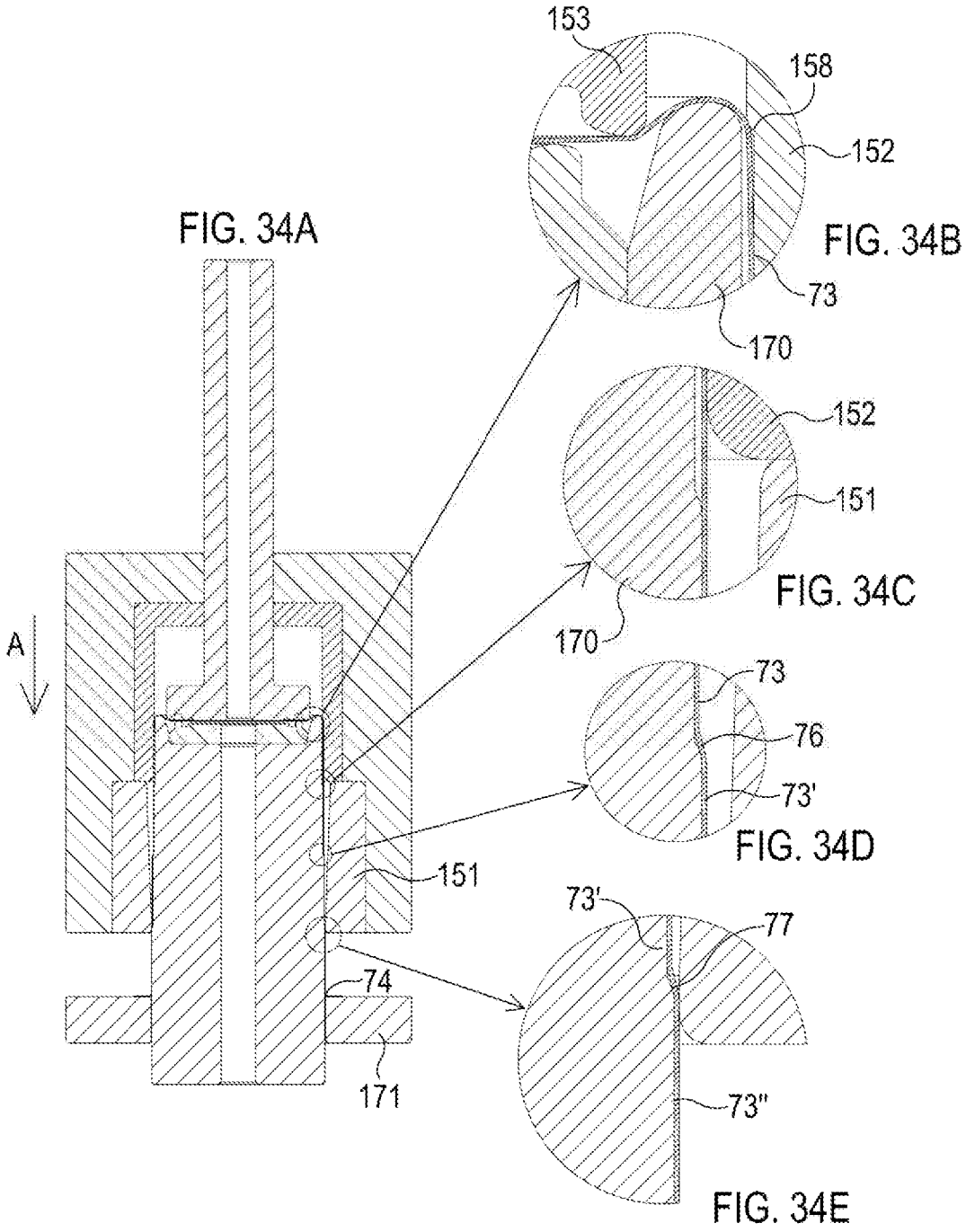
FIG. 34A shows a cross-sectional view of the tooling apparatus of FIG. 32A moved to a position to partially shape the can wall.
FIG. 34B, FIG. 34C, FIG. 34D and FIG. 34E show partial enlarged views of FIG. 34A.

Referring to FIGS. 33A, 33B and 33C, the upper tooling has been moved downwards in the direction of arrow A to a position wherein the pad 153 is in contact with the can base 72, the curved portion 158 of the of the shaping die 152 has come into contact with the can body 71 and the can body 71 has been pushed downwards to deflect the plate 171 downwards. The curved portion 176 of the shaping punch 170 has come into contact with the curved region 75 of the can body 71, such that any further downward movement of the upper tooling will start to shape the body-wall 73.

Referring to FIGS. 34A to 34E, the upper tooling has been moved further downwards in the direction of arrow A, and in this example, part of the body-wall 73 has been expanded to become a portion 73', joined by a curved region 76, and part of the portion 73' has been further expanded to become a portion 73" joined by a curved region 77. In this example, the curved portion 158 of the shaping die has not yet started to shape the can body-wall 73, due to the force applied by the outer base-forming tool 153. However, it is not necessary for the shaping shown in FIGS. 34A to 34E to be carried out before the shaping shown in FIGS. 35A to 35D.

Referring to FIGS. 35A to 35D, the upper tooling has been moved further downwards in the direction of arrow A towards a lowermost position, and part of the body-wall 73 has been reduced in diameter by the shaping die 152 to become a portion 111, joined by a curved region 112. The shaping die 152 has come into contact with the outer base-forming tool 153, and has pushed it towards the inner base-forming tool 172 to shape the base 72'. The curved region 75' has been formed by the radius 154 of the flange-control die 151, and wrinkling of the flange 74' has been supressed by clamping it between the face 155 of the flange-control die 151 and the plate 171.

Referring to FIGS. 36A and 36B, the upper tooling has moved upwards in the direction of arrow B, to return to the same position as shown in FIG. 32A, but with the shaped can body 71' now in place. The shaped can body 71' has been pushed fully off the shaping punch 170 by the plate 171 and its flange 74' is resting on the clamping ring 171. The positioning of the outer base-forming tool 153 prevents the can body 71' from remaining within the upper tooling. Compressed air is introduced into the can body 71' through channel 180 in the punch 170 to assist pushing the can body 71' off the shaping punch 170 and to prevent the creation of any vacuum within the can body.

A fourth method of reducing a can diameter will now be described with reference to FIGS. 37 to 40, in which a cylindrical metal cup having a flange is drawn to form a can body having a number of cylindrical body-wall portions of different diameters, using a punch having regions of corresponding diameters and a set of dies also having corresponding diameters. Using this method enables the base profile to be formed and the can body to be drawn to the height desired in the same manufacturing step. It is preferable that the number of portions of the punch of different diameter is greater than two, and further preferable that the number of portions of different diameter is greater than three.

FIGS. 37A, 37B and 37C illustrate an example of a two-part tooling apparatus used to draw a can body having a stepped body wall and a profiled base from a flanged cup 201. The tooling comprises a set of upper and lower tools, and a cup 201 is shown in position.

The flanged metal cup 201 comprises a base 202, a body-wall 203 and a flange 204. The cup 201 may be formed from pre-coated metal sheet, as described above. The flange 204 is connected to the body-wall 203 by a curved region 205. The flanged cup 201 is typically positioned using a moveable plate which is not shown in this Figure. It is preferable that the diameter of the cup 201 is greater than the largest cylindrical body-wall portion formed using the method provided, and the cup flange 204 may be clamped to suppress wrinkling during drawing, such that the clamped region becomes the flange 220 of the can body.

The upper tooling comprises a holder 221, an outer base-forming tool 222, a drawing die 223, a first step-forming die 226, a second step-forming die 228 and a third step-forming die 230. The holder 221 includes an air hole 232.

The drawing die 223 has a drawing profile 224 which is typically a radius, and a clamping face 225. The inside diameter of the drawing profile 224 is selected to determine the diameter of the can body adjacent to its open end.

The first step-forming die 226 has a step-forming profile 227, which has an internal diameter that is smaller than the inside diameter of the drawing profile 224 by at least twice the thickness of the body-wall 203.

The second step-forming die 228 has a step-forming profile 229, which has an internal diameter that is smaller than the inside diameter of the step-forming profile 227 by at least twice the thickness of the body-wall 203.

The third step-forming die 230 has a step-forming profile 232, which has an internal diameter that is smaller than the inside diameter of the step-forming profile 229 by at least twice the thickness of the body-wall 203.

The lower tooling includes a stepped punch 240, a clamping sleeve 241 having a clamping face 242, and an inner base-forming tool 243.

The stepped punch 240 has a cylindrical portion 244 having a diameter selected to determine the diameter of the can body adjacent to its open end, which is smaller than the inside diameter of the drawing profile 224 by just over twice the thickness of the body-wall 203.

The cylindrical portion 244 is joined by a curved portion 245 to an adjacent cylindrical portion 246 which is smaller than the inside diameter of the step-forming profile 227 by just over twice the thickness of the body-wall 203.

The cylindrical portion 246 is joined by a curved portion 247 to an adjacent cylindrical portion 248 which is smaller than the inside diameter of the step-forming profile 229 by just over twice the thickness of the body-wall 203.

The cylindrical portion 248 is joined by a curved portion 249 to an adjacent cylindrical portion 250 which is smaller than the inside diameter of the step-forming profile 231 by just over twice the thickness of the body-wall 203.

The clamping sleeve 241 is pushed upwards to the position in which it is shown by a device such as an air piston or springs (not shown).

Referring to FIGS. 38A, 38B and 38C, the upper tooling has been moved downwards in the direction of arrow A to a position wherein the cup body-wall 203 has been slid over the clamping sleeve 241, and the cup base 202 is clamped between the clamping faces 225 and 242 of the drawing die 223 and the clamping sleeve 241. Any further downward movement would result in drawing of the cup 201. A pressurised fluid such as compressed air may be fed through either of the channel 252 or the air hole 232, to pressurise either the outside or the inside of the can body as it is drawn in order to supress wrinkling of the body-wall during drawing.

Referring to FIGS. 39A and 39B, the upper tooling has been moved downwards to a lowermost position to draw the stepped can body 211 to the height desired. The clamping sleeve 241 is pushed downwards by the drawing die 253 in the process. The profiled base 212 has been formed between the outer base-forming tool 222 and the inner base-forming tool 243. The stepped body wall comprises cylindrical portions 213, 214, 215 and 216, joined by curved portions 217, 218 and 219 respectively, and the flange 220 is now clamped between the drawing die 223 and the clamping sleeve 241.

Referring to FIGS. 40A and 40B, the upper tooling has been moved upwards in the direction of arrow B to return to the same position as shown in FIG. 37A, but with the stepped can body 211 now in place. The stepped can body 211 has been pushed fully off the stepped punch 240 by the clamping sleeve 241 and its flange 220 is resting on the clamping sleeve 241. The positioning of the outer base-forming tool 222 prevents the stepped can body 211 from remaining within the upper tooling. Compressed air is introduced into the can body 211 through channel 251 in the stepped punch 240 to assist pushing the can body 211 off the stepped punch 240 and to prevent the creation of any vacuum within the can body.

It will be appreciated by the person skilled in the art that various modifications may be made to the above described embodiments, without departing from the scope of the present invention.

For example, in the methods described above the upper tooling is movable relative to the lower tooling. In an alternative example, the lower tooling may be moveable relative to the upper tooling, which may remain stationary. In yet another alternative, both the upper and lower sets of tooling may be moveable relative to one another.

Any of the methods of altering the diameter of one or more regions of a can body wall described above may be carried out more than once to further increase the diameter of a region or regions towards the open end of the can body, or to further reduce the diameter of a region or regions towards the closed end of the can body.

After the methods described above have been carried out to form the required features of the can body, the flange is unlikely to be further drawn into the body, and a conventional flange-trimming operation may be carried out. Further known forming methods such as curling the periphery of the flange may subsequently be carried out. Trimming or curling of the flange may be combined with one another or with other manufacturing steps. Trimming is generally preferred to be combined with breaking of the scrap piece that is trimmed off so that it may be easily removed from tooling.

In all of the methods described above, the metal cup from which the can body is produced may be made from sheet steel or aluminium, or an alloy containing either of these, and may be pre-coated with an organic coating. The organic coating may be a cured liquid, or the metal sheet may be coated with a polymer such as for example polypropylene or polyester such as polyethylene terephthalate (PET). The polymer may be applied by extruding or laminating a film onto the metal surface, and creating a bond using heat and pressure. Different polymer formulations may be co-extruded to create films or coatings having layered properties to best suit bonding, permeability, strength and surface finish properties. Opposing sides of the metal sheet may be coated with different materials. A lubricant may be applied to the sheet or may be provided by the coatings.

The metal cup may have been drawn from a circular blank or from a slightly non-circular blank intended to compensate for ear-forming characteristics due to anisotropy of the metal sheet. The metal cup may preferably be drawn to leave a flange, and then redrawn to leave a flange, or it may be drawn leaving no flange and then redrawn to leave a flange.

The metal cup may have been drawn and then redrawn, and the direction of the redraw may be the same as the direction of the first draw. Alternatively, the direction of a redraw may be the opposite to the direction of the first draw, thus turning the cup inside-out. This alternative is commonly known as reverse-redraw. The metal cup may have been redrawn more than once.

It is intended that the scope of this invention shall include any container manufactured using the methods provided and any container manufactured using the methods provided in combination with known methods and in particular those which are described by example herein.

Can bodies made from pre-coated metal are well-suited to step and/or taper forming because their coatings are smooth, robust, flexible and of consistent thickness. Can bodies formed from pre-coated metal provide the potential for significant cost savings (e.g. the cost of providing equipment and materials for cleaning and coating cans after forming can be avoided), thereby making unconventionally sized can bodies more viable. Whilst pre-coated metal is more expensive than non-pre-coated metal, this expense may be offset by the thickness-reducing processes described. A stack of nested can bodies additionally has a reduced footprint. In addition to reduced stockholding and logistics costs, nestable cans also offer the opportunity to differentiate over mainstream can bodies of conventional size and shape.

The invention claimed is:

1. A method of reducing a thickness and increasing a height of a cylindrical wall of a metal cup so as to form a can body, the method comprising:

positioning a wall-ironing punch inside the cup;

moving an annular wall-ironing die axially over a closed end of the cup towards an open end of the cup, but not beyond the open end of the cup, in order to iron the cylindrical wall from the closed end up to a position axially spaced from the open end;

forming a profile in a base of the cup at the closed end to form the can body, wherein said die is shaped such that when the profile is formed in the base of the cup the die passes across a region beyond said axially spaced position toward the open end without ironing that region; and moving the wall-ironing die back in an opposite direction to remove the can body from the die.

2. A method according to claim 1, wherein said position is between 1 mm and 20 mm from the open end of the cup.

3. A method as claimed in claim 1, wherein the step of moving the wall-ironing die back in the opposite direction is carried out with the punch positioned inside the can body in order to burnish a portion of the cylindrical wall.

4. A method as claimed in claim 3, wherein burnishing comprises reducing a thickness of the portion of the cylindrical wall by around 1%.

5. A method as claimed in claim 1, further comprising removing the punch from within the cup prior to moving the wall-ironing die back in the opposite direction.

6. A method according to claim 5, wherein the forming the profile in the base of the cup further comprises pressing a tool against an outer surface of the base of the cup at the closed end.

7. A method as claimed in claim 1, wherein the metal cup comprises a flange surrounding the open end, and the method further comprises applying a force to the flange to remove the can body from the punch.

8. A method as claimed in claim 7, wherein the step of moving the wall-ironing die back in the opposite direction is carried out with the punch positioned inside the can body in order to burnish a portion of the cylindrical wall and wherein the applying force to the flange occurs when the burnishing is complete.

9. A method as claimed in claim 1, wherein the punch comprises an internal longitudinal channel, and the method further comprises introducing compressed air into the can body through the channel to remove the can body from the punch.

10. A method as claimed in claim 1, wherein the cup is made from sheet metal pre-coated with a polymer such as polyester or polypropylene.

* * * * *